US012745813B2

(12) United States Patent
Zou et al.

(10) Patent No.: US 12,745,813 B2
(45) Date of Patent: Sep. 29, 2026

(54) HAIR WEFT AND PREPARATION PROCESS THEREOF

(71) Applicant: WELLNA CO., LTD, KL (HK)

(72) Inventors: Junna Zou, Rongcheng City (CN); Xiangpeng Lian, Rongcheng City (CN); Jiarong Sun, Rongcheng City (CN)

(73) Assignee: WELLNA CO., LTD, NT (HK)

( * ) Notice: Subject to any disclaimer, the term of this patent is extended or adjusted under 35 U.S.C. 154(b) by 0 days.

(21) Appl. No.: 19/241,318

(22) Filed: Jun. 17, 2025

(65) Prior Publication Data

US 2025/0311801 A1 Oct. 9, 2025

Related U.S. Application Data

(63) Continuation-in-part of application No. 19/062,044, filed on Feb. 25, 2025, now Pat. No. 12,433,361, which is a continuation of application No. 18/925,063, filed on Oct. 24, 2024, now Pat. No. 12,336,580, which is a continuation-in-part of application No. 18/815,791, filed on Aug. 26, 2024, now Pat. No. 12,268,260, which is a continuation-in-part of application No. 18/410,869, filed on Jan. 11, 2024, now abandoned.

(30) Foreign Application Priority Data

Jun. 10, 2025 (CN) ..... 202510772622.4

(51) Int. Cl.
*A41G 5/00* (2006.01)

(52) U.S. Cl.
CPC ..... *A41G 5/0046* (2013.01); *A41G 5/0073* (2013.01); *A41G 5/008* (2013.01)

(58) Field of Classification Search
CPC .... A41G 5/004; A41G 5/0046; A41G 5/0053; A41G 5/006; A41G 5/0066; A41G 5/008; A41G 5/0073
See application file for complete search history.

(56) References Cited

U.S. PATENT DOCUMENTS 5,413,124 A * 5/1995 Incando ..... A41G 5/008 132/201
8,905,048 B2 * 12/2014 Peterson ..... A41G 5/0046 132/201
2012/0260933 A1 * 10/2012 Ourique ..... A41G 5/006 132/201
2013/0167858 A1 * 7/2013 Lee ..... A41G 5/0066 132/54
2017/0202290 A1 * 7/2017 Thomas ..... A41G 5/006

FOREIGN PATENT DOCUMENTS

DE 202020107027 U1 * 1/2021 ..... A41G 5/0046

* cited by examiner

*Primary Examiner* — Rachel R Steitz
(74) *Attorney, Agent, or Firm* — Che-Yang Chen

(57) ABSTRACT

A hair extension includes an upper hair extension unit, a lower hair extension unit, and an opening base connected to the upper hair base of the upper hair extension unit and the lower hair base of the lower hair extension unit, wherein the opening base has one or more openings, wherein the upper hair members of the upper hair extension unit are extended downward, so as to be stacked on the of lower hair members of the lower hair extension unit.

15 Claims, 81 Drawing Sheets

A

B

C

D

E

HAIR WEFT AND PREPARATION PROCESS THEREOF

CROSS REFERENCE OF RELATED APPLICATION

This application is a non-provisional application that claims the benefit of foreign priority to Chinese Patent Application No. 202510772622.4, filed date Jun. 10, 2025; this application also is a Continuation-In-Part application that claims the benefit of priority under 35 U.S.C. § 120 to a non-provisional application, application Ser. No. 19/062,044, filed date Feb. 25, 2025, which is a Continuation application that claims the benefit of priority under 35 U.S.C. § 120 to a non-provisional application, application Ser. No. 18/925,063, filed date Oct. 24, 2024, which is a Continuation-In-Part application that claims the benefit of priority under 35 U.S.C. § 120 to a non-provisional application, application Ser. No. 18/815,791, filed date Aug. 26, 2024, which is a Continuation-In-Part application that claims the benefit of priority under 35 U.S.C. § 120 to a non-provisional application, application Ser. No. 18/410,869, filed date Jan. 11, 2024, which is a non-provisional application that claims the benefit of foreign priority to Chinese Patent Application No. 202311804410.7, filed date Dec. 25, 2023, the application Ser. No. 18/925,063 is also a non-provisional application that claims the benefit of foreign priority to Chinese Patent Application No. 202311405884.4, filed date Oct. 26, 2023, the entire contents of which are hereby incorporated by reference in their entirety.

BACKGROUND OF THE PRESENT INVENTION

Field of Invention

The present invention relates to artificial hairpiece, specifically to hair extension.

Description of Related Arts

The importance that people place on their appearance is increasing, and more and more people want to be able to change their image by changing their hairstyle. However, due to the limitations of factors such as the growth cycle and quality of hair, many people are unable to fulfill their personal hairstyle needs. In this case, hair extensions become people's first choice. As the most traditional product type in the hair product industry, hair weft has a place in the market for its wide coverage area on the head and large volume of hair.

Currently on the market, the hair weft is mostly handmade or machine-made, but the hair wefts prepared by the two production methods have obvious weft edge, which has a large thickness affecting the wearing comfort, and is not invisible enough causing obvious appearances. Further, both the above two kinds of hair wefts have folded hair, and the folded-back short hair will be in contact with the scalp when the wearer is in activities, resulting in a tingling sensation.

The CN Patent No. CN108835745A discloses a hair extension simulating human hair and a preparation method thereof. The hair extension includes a substrate, a hair strand, where an end of the hair strand passes through the substrate and is fixed to a back side of the substrate through an adhesive; the hair strand is flatly affixed to a front side of the substrate and is perpendicular to a length direction of the substrate. The preparation method includes: 1) making/preparing a substrate; 2) preparing a spacer; 3) preparing a hair transplantation marking area/marking paper; 4) binding auxiliary materials; 5) preparing a hair strand for hair transplantation; 6) hair transplantation; 7) cutting; 8) fixing; 9) finished product cutting: the substrate after smearing and baking is cut into the desired shape by using scissors or a knife mold; and the finished hair extension is thus made. The advantage is that the front side of the hair extensions made by the CN Patent is not required to be fixed by glue. However, the CN Patent has disclosed the production method of the hair extension but not disclosed the production method of hair wefts, and thus cannot solve the problem that the hair wefts have obvious weft edge, which has a large thickness affecting the wearing comfort, and is not invisible enough causing obvious appearances; the hair wefts have folded hair, and the folded-back short hair will be in contact with the scalp when the wearer activities, resulting in a tingling sensation.

With the development of the economy, more and more people begin to wear hair extensions. Wearing hair extensions has the effect of appearance modification, and has the advantages of simple and convenient changing hairstyles, saving time, and avoiding hair damage caused by hair perming, dyeing, and pulling. Also, the cost of doing hairstyles in the barbershop, bleaching and dyeing hair piece can be saved, which reduces expenses. Further, hairstyles can be changed at will to avoid frequent trips to the barbershop for hair styling causing damage to the hair quality. People can try a variety of hair extensions with different designs, with different fashion, which causes wearing hair extensions to become increasingly popular.

As the most traditional and oldest product type in the hair extension industry, a hair weft dominates the mainstream market with its wide head coverage and large hair volume.

However, the common hair weft products are mostly handmade or produced by a triple-head weft machine. The hand tied hair weft has a long production time and low production capacity. The machine-made hair weft, after a weft edge is folded twice by the triple-head weft machine, has an obvious folding edge and thicker weft edge, such that the wearing experience is poor. In addition, the two kinds of hair wefts have folded hair, increasing the production loss; further, the back-folded short hair will be in contact with the scalp when the wearer moves, resulting in a tingling sensation.

Currently, most hair extensions on the market are hand tied hair extensions, machine-made hair extensions or PU hair extensions. Regarding the hand tied hair extension, because of its delicate and complex production process, the production capacity is relatively low. Each hair extension requires experienced craftsmen to spend a lot of time hand-weaving, which not only leads to high processing costs, but also a very long production cycle.

During the hand-braiding process, in order to ensure the firmness and naturalness of the hair extension, a longer folded back hair (about 1.5 to 2 inches) is usually required. However, this also means that there will be a greater loss of raw materials during the production process, which increases costs.

After the hem of the hair extension is cut, additional processing steps are required to ensure the stability and comfort of the hair extension. Usually, a portion of the hair needs to be removed and then three strands of rope are tied to make the hair extension better fixed on the wearer's head. This process adds extra work and also increases the installation time of the hair extension.

Due to the characteristics of hand-knitting technology, the number of hair strands per unit area is small and the amount of hair is extremely small. This means that hand-braided hair extensions have a limited ability to increase hair volume, and those who wish to significantly increase hair volume or achieve a fuller hairstyle may need to use multiple hair extensions to achieve the desired effect.

Regarding the machine-made hair extension, during the manufacturing process, a machine is used to fold the hair roots in half twice, sew them with sewing threads, and then use a stitching machine to stitch them together. Although this manufacturing process helps improve the structural strength and durability of the hair extension, it also creates a problem: the edges of the hair extension become relatively thick. This thickened edge may cause discomfort to the user when wearing it, especially in the area close to the scalp, where the user may feel pressure or foreign body sensation, thus affecting the overall wearing experience.

Because the hair roots are folded in half, there will be some hair folded back at the folded edge. These short hairs are usually located at the edge of the hair extension. When the wearer turns his head, lowers his head or raises his head, these short hairs may pierce the scalp, causing discomfort or even pain. This tingling sensation not only affects the wearer's comfort experience, but may also make people feel irritable, especially when wearing it for a long time, the problem will be more obvious.

Due to daily friction, pulling, cleaning and maintenance, the sewing thread may gradually wear out. Once the sewing thread wears to a certain extent and breaks, it will cause part or all of the hair extension to be out of place, thus affecting its wearing effect. This situation will not only reduce the service life of the hair extension, but may also make the user feel embarrassed at a critical moment.

The PU hair extension products include the ordinary PU hair extension and the PU hair extension made by machine insertion. The edge design of the ordinary PU hair extension is too flat and lacks the necessary three-dimensional sense. This design results in the hair extension not being able to blend perfectly with the wearer's original hair after wearing it. Especially for those who want to achieve a natural transition effect, such as at the hairline or the top of the head, this lack of three-dimensionality will cause a clear dividing line between the hair extension and the original hair. The overall hairstyle therefore appears unnatural and gives people a "fake" feeling, which not only reduces the overall beauty of the wearer, but may also affect their self-confidence;

The surface of the weft edge is relatively smooth, which will produce obvious light reflection under direct sunlight. This reflective effect may make the hair extension too conspicuous and easy to be noticed by others. Especially in outdoor activities or sunny environments, this strong reflection phenomenon will enhance the presence of the hair extension, thereby reducing the naturalness of the overall hairstyle and making the hair extension easier to be discovered by others.

The machine-insertion technology for the PU hair extension can ensure the stability and invisible effect of the hair extension to a certain extent, the density of the implant needles is limited, which limits the increase in hair volume. For those who want to achieve a full and thick effect, this limitation may be an obvious disadvantage.

In addition, higher processing costs and longer production cycles mean that consumers need to pay more and wait longer to receive the products. Coupled with the inevitable loss of raw materials during the production process, this further pushes up the cost of the final product.

SUMMARY OF THE PRESENT INVENTION

The present disclosure is intended to solve at least one of the technical problems of the prior art. To this end, a first aspect of the present disclosure proposes a hair weft, including:

a first hair weft, including a hair transplantation base and a first hair strand; wherein the hair transplantation base includes a mesh base and a spacer disposed above the mesh base; the spacer is configured to clamp the first hair strand after the first hair strand passes through the mesh base and the spacer; the mesh base is configured to affix the first hair strand to a side of the mesh base after the spacer and the mesh base are separated; and a second hair weft, including a second hair strand; wherein a top of the second hair strand is fixed through a stitching line and a glue; wherein the second hair weft is cut and affixed flush to a bottom of the first hair weft, forming the hair weft.

In some embodiments, a material of the mesh base is a non-stretchy, densely perforated, ultra-thin mesh silk yarn.

In some embodiments, a material of the spacer is PVC artificial leather.

The embodiments of the present disclosure further propose a preparation method of the hair weft, including:

Step 1, preparing the hair transplantation base: cutting the mesh base and the spacer to a predetermined shape, marking a hair transplantation area on the spacer, and aligning the mesh base and the spacer to be bound together;

Step 2, preparing the first hair strand and placing the first hair strand in a predetermined area;

Step 3, preparing the first hair weft: after passing the first hair strand placed in the predetermined area through the spacer and the mesh base, cutting the first hair strand disposed between the spacer and the mesh base, fixing the first hair strand on a side of the mesh base, and cutting the first hair strand on the other side of the mesh base shorter, to obtain the first hair weft;

Step 4: preparing the second hair weft: fixing a top of the second hair strand that is organized to a same height through two stitching lines and further fixing with the glue;

Step 5, preparing the hair weft: cutting the first hair weft and the second hair weft, and affixing the second hair weft flush to the bottom of the first hair weft; and Step 6, cleaning treatment: soaking the hair weft in an alkaline solution, and soaking the hair weft in a softener.

In some embodiments, the Step 2 includes:

organizing the first hair strand to a uniform height;

fixing a middle part of the first hair strand;

placing the first hair strand in a transplantation area of a transplantation machine; and placing the mesh base and the spacer in turn above the transplantation area.

In some embodiments, the Step 3 includes:

utilizing a curved hook at a top of a transplantation machine to sequentially hook the first hair strand located below the mesh base in the hair transplantation area, and utilizing the spacer to clamp the first hair strand until the first hair strand is completely transplanted in the hair transplantation area;

cutting the first hair strand located between the spacer and the mesh base, affixing the first hair strand to the mesh base through an adhesive, and drying; and cutting the first hair strand on the side of the mesh base away from the spacer to 0.1 to 2 cm, to obtain the first hair weft.

In some embodiments, the Step 4 includes:

organizing the second hair strand to a uniform height;

forming the two stitching lines on the top of the second hair strand through a double-needle sewing machine;

applying a tape 1.2 to 1.5 inches from the top of the second hair strand; and applying a preprepared glue to evenly coat the tape to the top of the second hair strand, and drying.

In some embodiments, the Step 6 includes:

putting 100 g of the hair weft into 1 kg of 40° C. water, adding 2 g to 3 g of sodium hypochlorite solution, and soaking for 5 minutes;

cleaning the hair weft for three times using 40° C. water;

after the cleaning, putting the hair weft into 1 kg of 50° C. water, adding 30 g of softener, and soaking for 10 minutes; and after the cleaning, putting the hair weft into 1 kg of 50° C. water, adding 40 g of softener, and soaking for 10 minutes.

The embodiments of the present disclosure provide a hair weft and a preparation process thereof, which have the following beneficial effects compared with the prior art:

By providing the hair transplantation base, the first hair strand, the first hair weft, the second hair weft, the finished hair weft, and cleaning and processing, a hair weft close to the state of human hair growth is obtained. There is no weft edge in the conventional sense of the traditional hair weft. After wearing, the hair weft blends in with the wearer's own hair, which is more invisible. No hair back occurs, which enhances the wearing experience, solving the problems of wearing discomfort caused by the weft edge being too thick and too hard, poor breathability, and irritation of the skin when wearing due to the issue of hair return, etc., and it is more invisible after wearing, which protects the privacy of the wearer more and enhances the wearing experience.

The present invention is advantageous in that it provides a hair weft and preparing method thereof, wherein the hair weft comprises a first hair weft unit and a second hair weft unit, the first hair weft unit comprises a hair transplantation base and a first hair strand which is transplanted on the hair transplantation base, the second hair weft unit comprises a second hair strand which is attached to the hair transplantation base, so as to increase the hair volume of the hair weft product.

Another advantage of the present invention is to provide a hair weft and preparing method thereof, wherein the first hair weft unit may have an insufficient bristle density and volume which fail to meet the desired standards for a larger hair volume, wherein the second hair weft unit with a higher bristle density and volume is produced and is combined with the first hair weft unit using an adhesive to achieve the required hair volume. Accordingly, combining two hair weft units compensates for the lower volume of the first hair weft unit to result in a final product that meets the volume requirements.

Another advantage of the present invention is to provide a hair weft and preparing method thereof, wherein the hair transplantation base is glued between the two hair strands, so as to ensure a strong bond and help in achieving a seamless integration of the two hair weft units.

Another advantage of the present invention is to provide a hair weft and preparing method thereof, wherein this method allows for flexibility in adjusting the hair volume by changing the density of either the first or the second hair weft unit.

Another advantage of the present invention is to provide a hair weft and preparing method thereof, wherein a top of the first hair strand body is extending from a top edge of the hair transplantation base and naturally draping over it in a curved manner, the second hair strand body is extending from a bottom edge of the hair transplantation base, the starting points of their extensions are different, with the more curled first hair strand overlaying the second hair strand, a layered and three-dimensional effect is created, so that the difference in starting points adds visual depth and texture, mimicking the natural layering of hair.

Another advantage of the present invention is to provide a hair weft and preparing method thereof, wherein the second hair strand has a higher density, providing greater thickness and being positioned closer to the scalp when the hair weft is worn on a head of the user, so that this arrangement simulates the natural decrease in hair density from the scalp toward outward, so as to enhance the sense of layering. In other words, this structure mimics the natural distribution of hair density, which is higher near the scalp and decreases outward, so as to provide a more realistic transition from scalp to ends. The layered structure also allows for versatile styling options, accommodating various looks and preferences.

Another advantage of the present invention is to provide a hair weft and preparing method thereof, wherein both hair weft units are positioned vertically during the assembly process, this ensures that the hair strands align properly and maintain the intended orientation.

According to another aspect, the present invention provides a hair weft, comprising:

a first hair weft unit comprising a first hair strand a hair transplantation base, wherein the first hair strand is fixed to the hair transplantation base; and a second weft unit comprising a second hair strand and an attaching base, wherein the second hair strand is fixed to the attaching base, wherein the attaching base is attached to the hair transplantation base.

According to an embodiment, the first hair strand comprises a first hair strand body and a first root portion integrally extended from the first hair strand body, wherein the first root portion is penetrating through the hair transplantation base and adhered to the hair transplantation base, wherein the first hair strand body and the first root portion are provided at two opposite sides of the hair transplantation base.

According to an embodiment, the hair transplantation base comprises a silk mesh and a glue layer applied on the silk mesh.

According to an embodiment, the second hair strand comprises a second hair strand body and a second root portion integrally extended from the second hair strand body, wherein the second root portion of the second hair strand is fixed to the attaching base.

According to an embodiment, the attaching base of the second weft unit is formed by a glue material, wherein the second root portion of the second weft unit is embedded in the attaching base.

According to an embodiment, the glue material of the attaching base of the second weft unit comprises a mixture of polyurethane glue, adhesive, and thinner.

According to an embodiment, in the glue material of the attaching base of the second weft unit, a weight content of polyurethane glue is ranged from 40%-60%, a weight content of adhesive is ranged from 10%-30%, and a weight content of thinner is ranged from 20%-40%.

According to an embodiment, the attaching base of the second weft unit comprises an attached tape.

According to an embodiment, the first hair strand body of the first hair strand and the second hair strand body of the second hair strand are provided at two opposite sides of the hair transplantation base.

According to an embodiment, a density of the first hair strand is lower than a density of the second hair strand.

According to an embodiment, the first hair strand body of the first hair strand is extended from a front surface of the hair transplantation base, a top end of the second hair strand body of the second hair strand is extended from a bottom edge of the attaching base corresponding to a position of a bottom edge of the hair transplantation base.

According to an embodiment, the first hair strand body is extended from a front surface of the hair transplantation base and is draping over the hair transplantation base in a curved manner and is layered on top of the second hair strand body.

According to an embodiment, the hair weft further comprises an attaching unit which is mounted to the second weft unit for detachably mounting the hair weft to a hair of a user.

According to an embodiment, the second hair weft unit is provided between the attaching unit and the first hair weft unit, wherein the second hair strand has a higher density than the first hair strand to create a layering effect when the hair weft is worn on the user.

According to an embodiment, the attaching unit comprises a clipping member which is mounted to the attaching base of the second hair weft unit.

According to an embodiment, the attaching unit comprises a double-sided binding tape which is attached to the attaching base.

According to another aspect, the present invention provides a preparation method of a hair weft, comprising the following steps:

prepare a first hair weft unit comprising a first hair strand and a hair transplantation base, wherein the first hair strand is affixed on the hair transplantation base; and affix an attaching base of a second hair weft unit to the hair transplantation base, wherein the second hair weft unit comprises a second hair strand fixed to the attaching base, wherein the first hair strand and the second hair strand are provided at two opposite sides of the hair transplantation base to increase a hair volume of the hair weft.

According to an embodiment, the step (a) comprises a step of guiding a first root portion of the first hair strand to penetrate through the hair transplantation base and then affixing the first root portion of the first hair strand to the hair transplantation base.

According to an embodiment, the step (b) comprises a step of applying a glue material to a second root portion of the second hair strand to form the attaching base, wherein the second root portion of the second hair strand is embedded into the attaching base.

The present invention also provides a preparation method of a hair weft, which has a high production efficiency and has no short hair folding back.

The present disclosure provides a preparation method of a hair weft, comprising the following steps.

S1: batching hair strands according to a target weight to obtain a hair handle;

S2: forming a first stitching line and a second stitching line on a top of the hair handle with a double-needle sewing machine to obtain the hair weft;

S3: forming a third stitching line between the first stitching line and the second stitching line of the hair weft with a single-needle sewing machine;

S4: pasting a tape along the third stitching line to cause the tape to cover the hair weft;

S5: applying a glue between the first stitching line and the third stitching line, and drying the hair weft;

S6: cutting the hair weft along the first stitching line;

S7: soaking the hair weft in a softener; and

S8: putting the hair weft into a centrifuge for dehydration and shaking, and combing the hair strands.

In some embodiments, in S2, the first stitching line is a cotton sewing thread and the second stitching line is a water-soluble sewing thread.

In some embodiments, the double-needle sewing machine has a gauge of 30-35 stitches per inch, and a spacing between the first stitching line and the second stitching line is 3-4 mm.

In some embodiments, in S3, the third stitching line is a cotton sewing thread, and a spacing between the third stitching line and the first stitching line is 1 mm.

In some embodiments, S5 comprises the following steps.

S51: applying a first glue between the first stitching line and the third stitching line on a front side of the hair weft, and drying the hair weft at a drying temperature of 45-50° C. for 15 minutes;

S52: applying a second glue between the first stitching line and the third stitching line on the front side of the hair weft, and drying the hair weft at a drying temperature of 45-50° C. for 15 minutes;

S53: applying a third glue between the first stitching line and the third stitching line on the front side of the hair weft, and drying the hair weft at a drying temperature of 45-50° C. for 120 minutes;

S54: applying a fourth glue between the first stitching line and the third stitching line on a back side of the hair weft, and drying the hair weft at a drying temperature of 45-50° C. for 15 minutes;

S55: applying a fifth glue between the first stitching line and the third stitching line on the back side of the hair weft, and drying the hair weft at a drying temperature of 45-50° C. for 15 minutes; and

S56: applying a sixth glue between the first stitching line and the third stitching line on the back side of the hair weft, and drying the hair weft at a drying temperature of 45-50° C. for 240 minutes.

In some embodiments, the S7 comprises the following steps.

S71: adding 2 g-3 g of a sodium hypochlorite solution to 1 kg of water at 40° C. to obtain a first solution, and soaking the hair weft in the first solution for 5 minutes;

S72: washing the hair weft with water at 40° C.;

S73: adding 30 g of the softener to 1 kg of water at 50° C. to obtain a second solution, and soaking the hair weft in the second solution for 10 minutes; and

S74: adding 40 g of the softener to 1 kg of water at 50° C. to obtain a third solution, and soaking the hair weft in the third solution for 10 minutes.

In some embodiments, S8 comprises the following steps: placing the hair weft into the third solution to be slightly moistened, unfolding and laying flat the hair weft, scraping out water, and drying the hair weft.

In some embodiments, S1 comprises the following step: dyeing the hair strands before the batching.

In some embodiments, the preparation method further comprises the following steps: S9: ironing and combing the hair weft, stacking the hair weft, and bundling and packaging for transportation.

The present disclosure provides a preparation method of a hair weft, including: batching hair strands according to a target weight to obtain a hair handle; forming a first stitching line and a second stitching line on a top of the hair handle with a double-needle sewing machine to obtain the hair weft; forming a third stitching line between the first stitching line and the second stitching line of the hair weft with a single-needle sewing machine; pasting a tape along the third stitching line to cause the tape to cover the hair weft; applying a glue between the first stitching line and the third stitching line, and drying the hair weft; cutting the hair weft along the first stitching line; soaking the hair weft in a softener; and putting the hair weft into a centrifuge for dehydration and shaking, and combing the hair strands. The hair weft prepared by the method of the present disclosure has a high production efficiency and has no short hair folding back, which is less lossy and less prone to hair loss compared to handmade hair wefts, and does not have the problems of wearing discomfort and poor breathability caused by too thick and too hard weft edge compared to the hair wefts made by a triple-head weft machine, and does not irritate the skin.

Another advantage of the present invention is to provide a hair weft and a preparation method thereof. The hair weft is a PU product and is different from an ordinary PU hair extension. The hair weft is made of two layers of hair weft units bonded together. The upper hair weft unit is fixed with two sewing lines with extremely narrow intervals to form a cluster of hair bundles. After being coated with glue and dried and fixed, the edge of the upper hair weft unit is in an irregular hair bundle shape, and the appearance is similar to that of a hand tied and hair extension. The lower hair weft unit is a PU hair extension. The upper and lower hair weft units are firmly bonded by glue to form a finished hair weft.

Another advantage of the present invention is to provide a hair weft and a preparation method thereof, wherein compared with hand tied hair weft, this hair weft is made of PU material has lower processing costs and shorter production cycles, and its production capacity is greatly improved. Due to its material characteristics, the PU weft edge is very strong and will not be affected by the breakage of the braided wire, thus extending its service life. In addition, this hair weft can be cut at will according to the needs of the wearer, with neat cuts and no hair loss. It can be used directly after cutting without additional processing, which greatly shortens the installation time. In terms of hair volume, this hair weft is far superior to hand tied hair weft, and can achieve 1 to 1.5 times the weight under the condition of the same edge width.

Another advantage of the present invention is to provide a hair weft and a preparation method thereof, wherein compared with the machine weft, the weft edge of this hair weft does not have the phenomenon of back-spinning, and the hair will not be reversely sewn on the edge, making the weft edge smoother and more natural. This design not only makes the weft edge appear softer and thinner, but also makes it almost imperceptible when worn, greatly improving the wearer's comfort. The PU edge is very strong and will not be affected by the breakage of the braided wire, thus extending the service life.

Another advantage of the present invention is to provide a hair weft and a preparation method thereof, wherein compared with the ordinary PU hair weft, the production process of the upper hair weft units adopts a segmented fixing method, that is, the hair is fixed in sections in advance with sewing thread. This process not only gives the weft edge a more three-dimensional effect, but also makes the hair weft and the wearer's original hair blend more naturally, and the dividing line is almost invisible. This three-dimensional design has an additional benefit, that is, due to the irregularity of the weft edge, the chance of direct light reflection is reduced, so even in the sun, the hair weft will not appear too bright, but present a more real and soft luster. Such improvements make the overall effect of the hair weft closer to the hair in its natural state, greatly enhancing the realism and beauty of wearing.

Another advantage of the present invention is to provide a hair weft and a preparation method thereof, wherein compared with injected PU hair weft, due to the abandonment of machine-insertion technology, the new hair weft is no longer limited by the needle density, which means that more hair strands can be implanted on the same size hair extension, thereby significantly increasing the hair volume of the hair weft and making it look thicker and more natural. In addition, due to different production processes, the processing cost of this hair weft unit is lower, which allows consumers to enjoy high-quality products at more affordable prices. At the same time, the production cycle has also been greatly shortened, which means faster supply speed and higher production capacity. This efficient production method can not only meet the needs of more consumers, but also provide merchants with greater flexibility and market competitiveness. In general, the new hair weft not only provides a better user experience, but also brings economic advantages.

Another advantage of the present invention is to provide a hair weft and a preparation method thereof, wherein the hair weft can not only be used as an ordinary weft, by sewing metal clips on the mesh yarn surface of the hair weft, it becomes a clip-in that is easy to install quickly, which is very suitable for temporary changes in style. In addition, if it is provided with a double-sided tape on the mesh yarn surface and then cut it appropriately, it can be transformed into a tape-in. This form of hair weft is more suitable for long-term wear and can be more firmly fixed on the hair. This diverse use method allows this hair extension to meet the needs of different occasions and personal preferences.

The present application provides a hair weft, comprising:

a first hair weft unit comprising a first hair strand and a first glue base, wherein the first hair strand is fixed to the first glue base; and a second weft unit comprising a second hair strand and a second glue base, wherein the second hair strand is fixed to the second glue base, wherein the first glue base is attached to the second glue base.

According to an embodiment, the first hair strand comprises a first hair strand body and a first root portion integrally extended from the first hair strand body, wherein the first root portion is embedded into the first glue base.

According to an embodiment, the first hair weft unit further comprises a first stitching line and a third stitching line which are fixed on the first hair strand.

According to an embodiment, the first glue base is provided between the first stitching line and the third stitching line.

According to an embodiment, a distance between the first stitching line and the third stitching line is smaller than 3 mm.

According to an embodiment, a distance between the first stitching line and the third stitching line is 0.5 mm to 2 mm.

According to an embodiment, a distance between the first stitching line and the third stitching line is 1 mm.

According to an embodiment, the first stitching line and the third stitching line are parallel cotton threads.

According to an embodiment, the first stitching line is applied on the first hair strand by a double-needle machine which is able to apply the first stitching line and a second stitching line, wherein the third stitching line is applied on the second hair strand by a single-needle machine between the first stitching line and the second stitching line, wherein the first stitching line and the third stitching line are cotton threads, wherein the second stitching line is water-soluble and is removed during a soaking process.

According to an embodiment, the second hair strand comprises a second hair strand body and a second root portion integrally extended from the second hair strand body, wherein the second root portion of the second hair strand is embedded into the second glue base.

According to an embodiment, the first glue base comprises one of polyurethane glue and polycarbonate glue.

According to an embodiment, the second glue base comprises one of polyurethane glue and polycarbonate glue.

According to an embodiment, the first glue base comprises one of polyurethane glue and polycarbonate glue, an adhesive and a thinner, wherein a weight content of polyurethane glue or polycarbonate glue is ranged from 40%-60%, a weight content of the adhesive is ranged from 10%-30%, and a weight content of the thinner is ranged from 20%-40%.

According to an embodiment, the second glue base comprises one of polyurethane glue and polycarbonate glue, an adhesive and a thinner, wherein a weight content of polyurethane glue or polycarbonate glue is ranged from 40%-60%, a weight content of the adhesive is ranged from 10%-30%, and a weight content of the thinner is ranged from 20%-40%.

According to an embodiment, a length of the first glue base is smaller than a length of the second glue base.

According to an embodiment, the second hair weft unit further comprises a mesh yarn attached on the second glue base.

According to an embodiment, an attaching unit is mounted to the second weft unit for detachably mounting the hair weft to a hair of a user.

According to an embodiment, the attaching unit comprises one of a clipping member and a double-sided binding tape.

The present invention further provides a preparation method of a hair weft, comprising the following steps.

(I) Prepare a first hair weft unit comprising a first hair strand and a first glue base, wherein the first hair strand is fixed to the first glue base.

(II) Prepare a second hair weft unit comprising a second hair strand and a second glue base, wherein the second hair strand is fixed to the second glue base.

(III) Affix the first glue base to the second glue base.

According to an embodiment, the step (I) of preparing the first hair weft unit comprises a step of forming a first stitching line and a second stitching line on the first hair strand before forming the first glue base.

According to an embodiment, the step (I) of preparing the first hair weft unit comprises the following steps.

Form a first stitching line and a second stitching line on a top of the first hair strand by a double-needle sewing machine to obtain a first hair weft material, the first stitching line is a cotton sewing thread and the second stitching line is a water-soluble sewing thread.

From a third stitching line between the first stitching line and the second stitching line of the first hair weft material with a single-needle sewing machine, the third stitching line is a cotton sewing thread, and a distance between the third stitching line and the first stitching line is smaller than 3 mm.

Attach a first masking tape along the third stitching line to cause the first masking tape to cover the first hair weft material.

Apply a glue material for forming the first glue base between the first stitching line and the third stitching line, and dry the first hair weft material.

Cut the first hair weft material along the first stitching line and remove the first masking tape.

According to an embodiment, the step (II) of preparing the second hair weft unit comprises the following steps.

Form a water-soluble sewing thread by a single-needle sewing machine on the second hair strand to provide a second hair weft material.

Stick a second masking tape on a top of the second hair weft material.

Apply a glue material for forming the second glue base on the hair strand at a position above the second masking tape.

Cut an excess weft edge and remove the second masking tape to obtain the second hair weft unit.

Another advantage of the present invention is to provide a hair extension with openings formed on a hair base that allow natural hair strands to pass through, in combination with the use of mounting tubes, hair strands of natural hair can be guided through the openings either from the front side or the rear side of the hair extension and then sleeved into the mounting tube, thereby securely attaching the hair extension to the user's natural hair. This structure not only provides flexibility in installation methods, allowing the mounting tubes to be positioned on either side of the hair base depending on styling needs, but also ensures a stable and reliable attachment. Additionally, a layer of natural hair can cover the hair extension to conceal the mounting tubes, enhancing the overall natural and realistic appearance. Furthermore, since this solution can adopt a non-adhesive, non-thermal bonding method, it offers reusability and causes no damage to the scalp or natural hair, thereby improving user comfort and convenience.

According to another aspect, the present invention provides a hair extension, comprising:

a hair base having one or more openings; and a plurality of hair members fixed to the hair base.

According to an embodiment, the hair base comprises a glue base, the one or more openings are penetrating through a thickness of the glue base.

According to an embodiment, the each of the plurality of hair members comprises a root part which is embedded in the glue base and a hair body part which is integrally extended from the root part, wherein the hair body part is extended out of the glue base from a bottom edge of the glue base.

According to an embodiment, the root part of each the hair member has an end edge embedded in the glue base, wherein a plurality of the openings are located between the end edges of the root parts and the bottom edge of the glue base, wherein multiple root parts of the hair members are located between two the adjacent openings.

According to an embodiment, the hair base comprises a glue base and an opening base connected to the glue base, wherein the each of the plurality of hair members comprises a root part which is embedded in the glue base and a hair body part which is integrally extended from the root part, wherein the one or more opening are formed in the opening base which is located above the plurality of hair members.

According to an embodiment, the opening base is integrally extended from the glue base.

According to an embodiment, the opening base is attached to the glue base.

According to an embodiment, the glue base has two upper side corner edges each is a curved edge.

According to an embodiment, the glue base has two lower side corner edges each is an orthogonal edge, wherein each of the upper side corner edges is an arc edge.

According to an embodiment, the glue base has multiple openings, wherein a distance between two adjacent openings is 0.1-20 mm, a distance between the openings and the bottom edge of the glue base is 0.1-10 mm.

According to an embodiment, each opening has a circular shape, a diameter of each opening is 0.1-3.5 mm, a distance between a side of the glue base and the corresponding opening adjacent to the side of the glue base is 0.1-10 mm.

According to an embodiment, the hair base further comprises a mesh yarn integrated with the glue base, wherein the one or more openings are penetrating through the mesh yarn and the glue base.

According to an embodiment, a double-sided binding tape is attached to the glue base, wherein the one or more openings are penetrating through the double-sided binding tape and the glue base.

According to an embodiment, the glue base comprises polyurethane.

According to an embodiment, one or more mounting tubes are provided for mounting the hair extension to natural hair of a user.

According to an embodiment, each mounting tube comprises a tube body and an inner flexible tube disposed in the tube body.

According to an embodiment, each mounting tube comprises a tube body defining an inner passage, wherein the tube body has inner threads in the inner passage.

According to an embodiment, the hair base further comprises one or more stitching lines formed on the glue base.

According to an embodiment, the hair base comprises a hair transplantation base having the one or more openings and a plurality of transplantation holes, wherein one or more the hair members are transplanted at each of the plurality of transplantation holes.

According to an embodiment, the plurality of hair members are located below the one or more openings.

According to another aspect, the present invention provides a hair extension, comprising:

two or more hair extension units; and an opening base connected to the two or more hair extension units.

According to an embodiment, the two or more hair extension units are attached to the opening base.

According to an embodiment, the opening base is integrally extended from one of the two or more hair extension units.

According to another aspect, the present invention provides a hair extension, comprising:

an upper hair extension unit which comprises an upper hair base and a plurality of upper hair members fixed to the upper hair base;

a lower hair extension unit which comprises a lower hair base and a plurality of lower hair members fixed to the lower hair base; and a foldable opening base connected to the upper hair extension unit and the lower hair extension unit, wherein the foldable opening base has one or more openings, wherein the foldable opening base is folded to allow the plurality of upper hair members and plurality of lower hair members to extend in a downward direction.

According to an embodiment, the foldable opening base comprises an upper end portion and a lower end portion, where the upper hair base and the lower hair base are respectively attached to the upper end portion and the lower end portion of the foldable opening base.

According to an embodiment, the foldable opening base is integrally extended from the lower hair base and comprises an upper end portion, where the upper hair base is attached to the upper end portion the foldable opening base.

According to an embodiment, each of the upper hair base and the lower hair base is embodied to comprises one of the following structures: each of the upper hair base and the lower hair base comprises a glue base for fixing the hair members; each of the upper hair base and the lower hair base comprises a glue base and one or more stitching lines provided on the glue base for fixing the hair members; each of the upper hair base and the lower hair base comprises a hair transplanting base for transplanting the hair members.

According to another aspect, the present invention provides a hair extension, comprising:

an upper hair extension unit comprising an upper hair base and a plurality of upper hair members fixed to the upper hair base;

a lower hair extension unit comprising a lower hair base and a plurality of lower hair members fixed to the lower hair base; and an opening base connected to the upper hair base and the lower hair base, wherein the opening base has one or more openings, wherein the plurality of upper hair members are extended downward, so as to be stacked on the plurality of lower hair members.

According to an embodiment, the opening base comprises an upper end portion and a lower end portion, wherein the upper hair base and the lower hair base are respectively attached to the upper end portion and the lower end portion of the opening base.

According to an embodiment, the opening base is integrally extended from one of the upper hair base and the lower hair base According to an embodiment, the one or more openings are located between the upper hair base and the lower hair base.

According to an embodiment, the opening base is adapted for being attached on a head of a user, the plurality of upper hair members are extended downward to cover the one or more openings.

According to an embodiment, the upper hair base comprises an upper glue base, wherein each of the plurality of upper hair members comprises an upper root part which is embedded in the upper glue base and an upper hair body part which is integrally extended from the upper root part, wherein the upper hair body part is extended out of the upper glue base from a bottom edge of the upper glue base.

According to an embodiment, the upper hair base further comprises one or more stitching lines provided on the upper glue base for fixing the plurality of upper hair members.

According to an embodiment, the upper hair base comprises a hair transplantation base, wherein each of the plurality of upper hair members comprises an upper root part which is penetrating a thickness of the hair transplantation base and an upper hair body part which is integrally extended from the upper root part.

According to an embodiment, the lower hair base comprises a lower glue base, wherein each of the plurality of lower hair members comprises a lower root part which is embedded in the lower glue base and a lower hair body part which is integrally extended from the lower root part, wherein the lower hair body part is extended out of the lower glue base from a bottom edge of the lower glue base.

According to an embodiment, the lower hair base further comprises one or more stitching lines provided on the lower glue base for fixing the plurality of lower hair members.

According to an embodiment, the lower hair base comprises a hair transplantation base, wherein each of the plurality of lower hair members comprises a lower root part which is penetrating a thickness of the hair transplantation base and a lower hair body part which is integrally extended from the lower root part.

According to an embodiment, the upper hair base further comprises an upper mesh yarn integrated with the upper glue base.

According to an embodiment, the lower hair base further comprises a lower mesh yarn integrated with the lower glue base.

According to an embodiment, the one or more stitching liens comprises two stitching lines, a distance between the two stitching lines is smaller than 3 mm.

According to an embodiment, the opening base comprises a glue base body and a mesh layer integrated with the glue base body, wherein the one or more openings are penetrating through the glue base body and the mesh layer.

According to an embodiment, each of the upper hair base and the lower hair base comprises one of a glue base, a glue base with one or more stitching lines, a hair transplantation base.

According to another aspect, the present invention provides a hair extension comprising:

two or more hair extension unis each comprising a hair base and a plurality of hair members fixed to the hair base; and a base, wherein the two or more hair extension units are attached to the base, wherein one of the hair bases of the two or more hair extension units has one or more openings.

BRIEF DESCRIPTION OF THE DRAWINGS

In order to more clearly illustrate the technical solutions in the specific embodiments or related art of the present disclosure, the accompanying drawings to be used in the description of the specific embodiments or related art will be briefly introduced below. It will be obvious that the accompanying drawings in the following description are some of the embodiments of the present disclosure, and that for those skilled in the art, other attachments can be obtained based on these accompanying drawings without putting in creative labor.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

The present specification provides steps for operating the method as described in the embodiments or flowcharts, but more or fewer steps may be included based on routine or unoriginal labor. When executed in a real-world system or server product, the methods may be executed sequentially or in parallel (e.g., a parallel processor or multi-threaded processing environment) as shown in the embodiments or the accompanying drawings.

Figure 1:
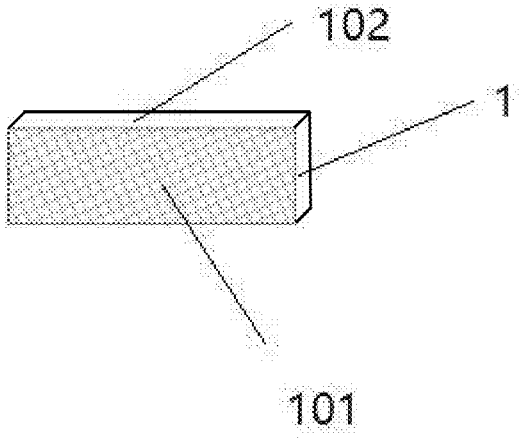
FIG. 1 is a structural schematic view of a hair transplantation base of a hair weft according to some embodiments of the present disclosure.
Figure 2:
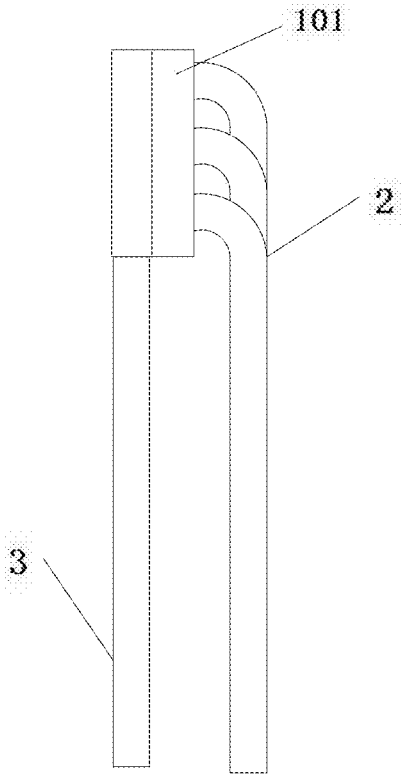
FIG. 2 is a structural schematic view of a first hair weft and a second hair weft of a hair weft after being affixed according to some embodiments of the present disclosure.

FIG. 1 is a structural schematic view of a hair transplantation base of a hair weft according to some embodiments of the present disclosure, and FIG. 2 is a structural schematic view of a first hair weft and a second hair weft of a hair weft after being affixed according to some embodiments of the present disclosure. The hair weft refers to skin weft, which can be directly braided onto the head. The embodiments of the present disclosure are intended to solve the problem that the hair wefts have obvious weft edge, which has a large thickness affecting the wearing comfort, and is not invisible enough causing obvious appearances; the hair wefts have folded hair, and the folded-back short hair will be in contact with the scalp when the wearer activities, resulting in a tingling sensation. Referring to FIGS. 1 and 2, the structure of the hair weft includes:

a first hair weft, including a hair transplantation base 1 and a first hair strand 2;

where the hair transplantation base 1 includes a mesh base 101 and a spacer 102 disposed above the mesh base 101; the spacer 102 is configured to clamp the first hair strand 2 after the first hair strand 2 passes through the mesh base 101 and the spacer 102; the mesh base 101 is configured to affix the first hair strand 2 to a side of the mesh base 101 after the spacer 102 and the mesh base 101 are separated;

a second hair weft, including a second hair strand 3; where a top of the second hair strand 3 is fixed through stitching line and glue;

where the second hair weft is cut and affixed flush to a bottom of the first hair weft to obtain the hair weft.

The present disclosure can solve the problem that existing hair wefts have folded hair and the folded-back short hair will be in contact with the scalp when the wearer activities, resulting in a tingling sensation, by affixing the second hair weft at the bottom of the first hair weft in a flush-fit manner. Moreover, by fixing the first hair strand 2 to one side of the mesh base 101, the mesh base has no obvious weft edge, which has a smaller thickness and is comfortable to wear. The second hair weft made by the second hair strand 3 is attached to the bottom of the first hair weft to make the finished hair weft, which has the effect of being invisible, such that the hair weft is not obvious after being worn. Because the first hair weft has a low density and volume of hair transplantation and cannot satisfy our demand for a large volume of hair, the second hair weft with a relatively large volume of hair is additionally made, and the first and second hair wefts are affixed together by means of an adhesive. To make the hair weft, the first and second hair wefts are placed vertically, and then the roots of the two hair wefts are affixed together by means of the adhesive.

In some embodiments, the material of the mesh base 101 is a non-stretchy, densely perforated, ultra-thin mesh silk yarn.

In the embodiments, the silk yarn may be Korean silk. The silk yarn is selected from the short fibers of silk by spinning and regeneration. Goods made from silk yarn or yarn woven in a plain arrangement are called silk. The texture of silk is tight and frivolous, with a fine and clean surface, lubricating and flat, glossy and soft, to be used as clothing material and decorative items. Korean silk is one of the series of silk fabrics produced by combining the characteristics of Korean silk products with Chinese weaving technology. The mesh base 101 made of Korean silk has no visible weft edges, which is less thick and is comfortable to wear.

In some embodiments, the material of the spacer 102 is PVC artificial leather.

The material of the spacer 102 in the embodiments is PVC artificial leather with a thickness of 0.4 mm. A curved hook carried at a top of a needle of a transplantation machine can pierce the spacer 102 and the mesh base 101 in turn when it moves up and down, and the curved hook at the top of the needle hooks the first hair strand 2 and brings the first hair strand 2 out of the pierced hole, and the spacer 102 shrinks after the needle has been withdrawn from the hole to clamp the first hair strand 2. The spacer 102 made of PVC artificial leather has better shrinkage and is cheap and easy to obtain.

Figure 3:
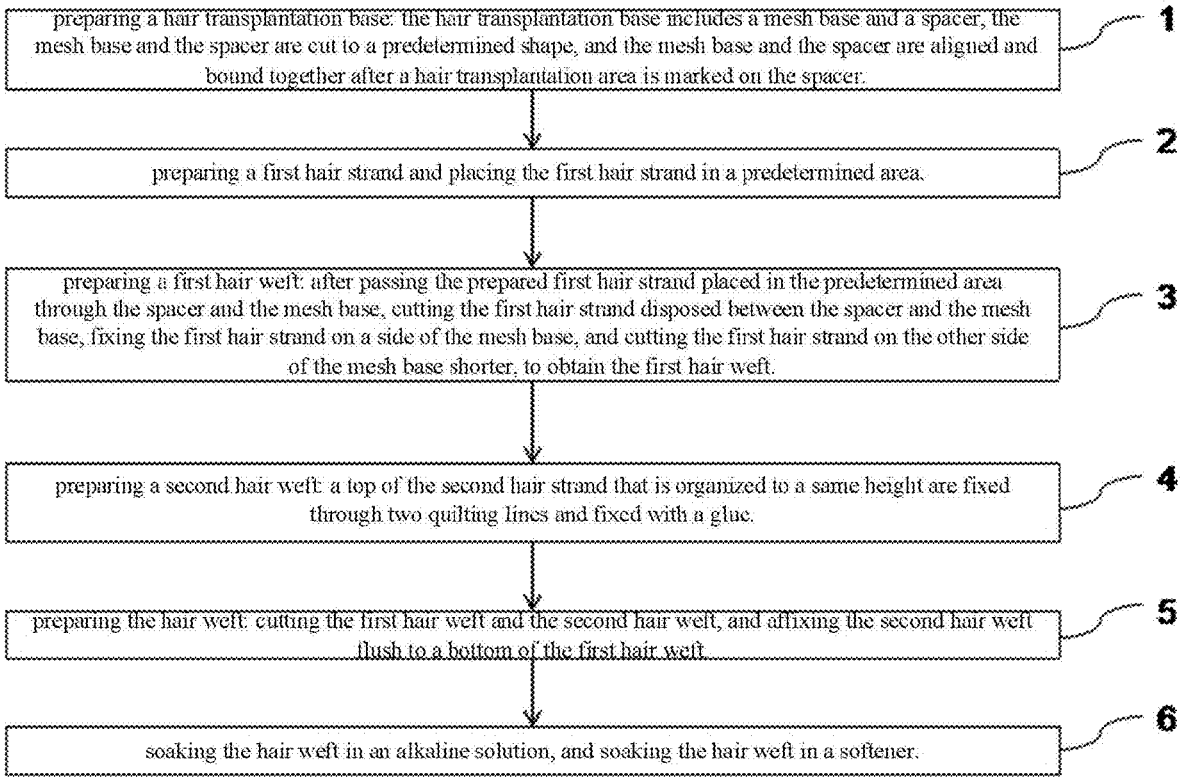
FIG. 3 is a flowchart of a preparation process of a hair weft according to some embodiments of the present disclosure.
Figure 4:
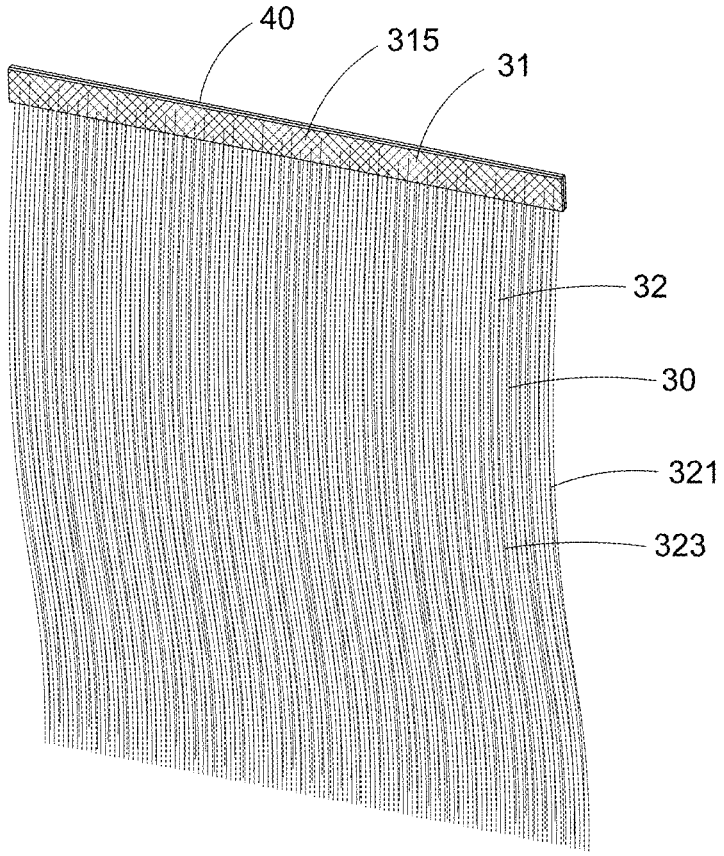
FIG. 4 is a perspective view of a hair weft according to a preferred embodiment of the present invention.
Figure 5A:
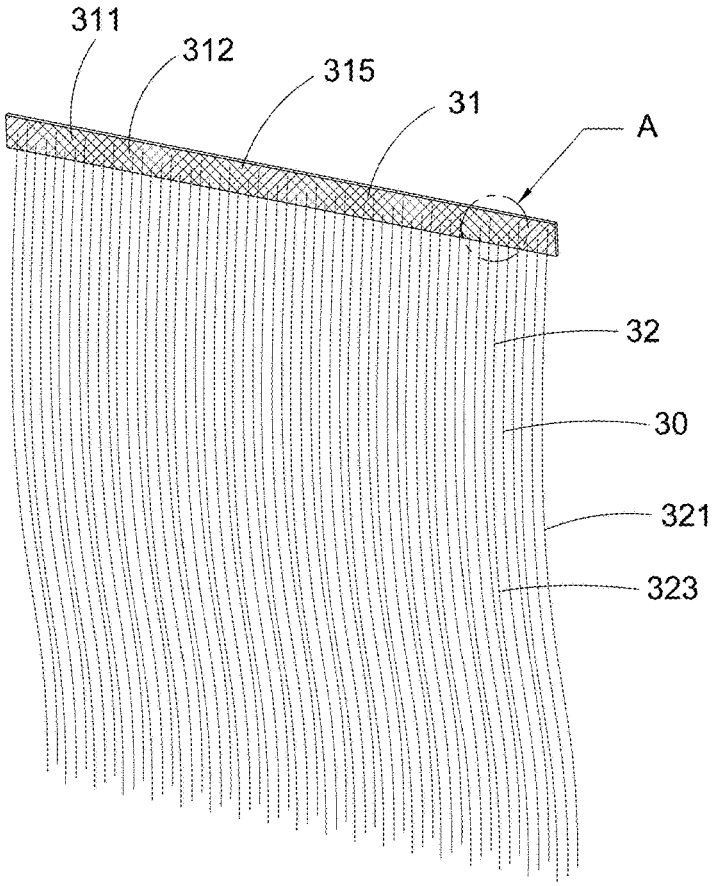
FIG. 5A is a perspective view illustrating a front side of a first hair weft unit of the hair weft according to the above preferred embodiment of the present invention.
Figure 5B:
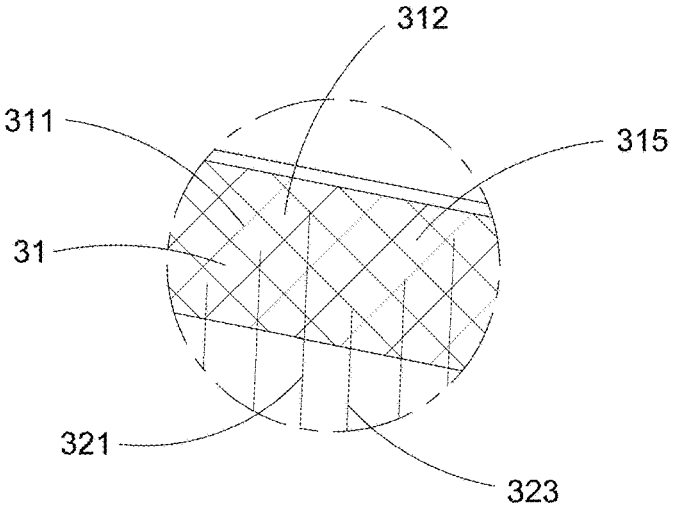
FIG. 5B is a partial enlarged view of area A in FIG. 5A.
Figure 6A:
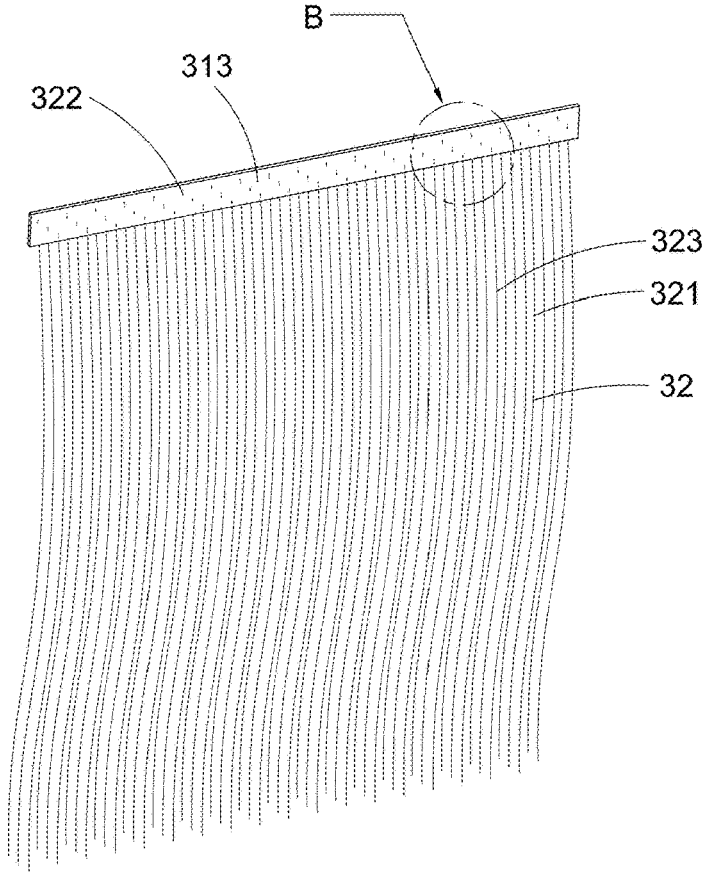
FIG. 6A is a perspective view illustrating a rear side of the first hair weft unit of the hair weft according to the above preferred embodiment of the present invention.
Figure 6B:
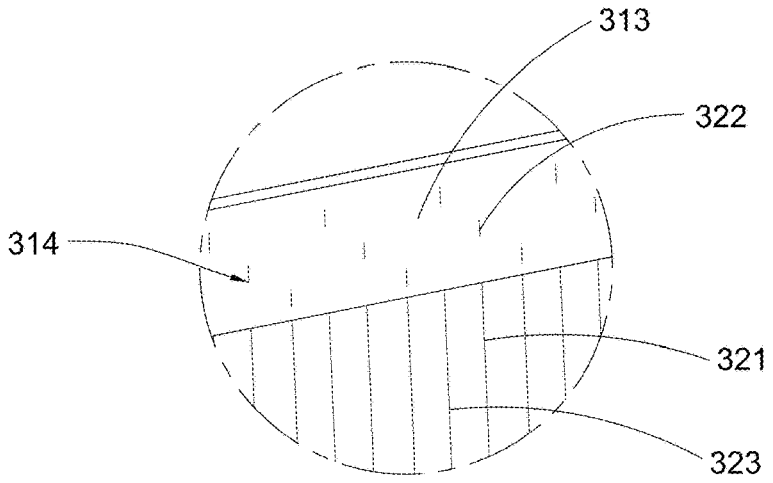
FIG. 6B is a partial enlarged view of area B in FIG. 5A.

FIG. 3 is a flowchart of a preparation process of a hair weft according to some embodiments of the present disclosure. Referring to FIG. 3, the embodiments of the present disclosure further provide a preparation process of a hair weft, including:

Step 1, preparing a hair transplantation base: the hair transplantation base includes a mesh base and a spacer, the mesh base and the spacer are cut to a predetermined shape, and the mesh base and the spacer are aligned and bound together after a hair transplantation area is marked on the spacer.

Specifically, the implementation steps of preparing the hair transplantation base include:

Step 101, cutting the mesh base and spacer to a desired shape and length.

Step 102, marking the desired hair transplantation area on the spacer with a marker.

Step 103, overlapping the mesh base and spacer, and binding and fixing the mesh base and the spacer with a stapler.

Step 2, preparing a first hair strand and placing the first hair strand in a predetermined area.

Specifically, the implementation steps of preparing a first hair strand and placing the first hair strand in the predetermined area include:

Step 201, organizing the first hair strand to a uniform height.

In step 201, a top of the first hair strand is tapped flush with a clapper board, and hair that is too short is lifted by hand to keep the overall height of the first hair strand consistent.

Step 202: fixing a middle part of the first hair strand.

In step 202, the middle part of the first hair strand is placed in two hair-beating splints with curved pins for fixing.

Step 203: placing the first hair strand in a transplantation area of a transplantation machine.

In step 203, the first hair strand is placed flat on top of the transplantation area of the transplantation machine.

Step 204: placing the mesh base and the spacer in turn above the transplantation area.

In step 204, the fabricated hair transplantation base is placed on top of the first hair strand, with the mesh base on the bottom and the spacer on the top.

Step 3, preparing a first hair weft: after passing the prepared first hair strand placed in the predetermined area through the spacer and the mesh base, cutting the first hair strand disposed between the spacer and the mesh base, fixing the first hair strand on a side of the mesh base, and cutting the first hair strand on the other side of the mesh base shorter, to obtain the first hair weft.

Specifically, the implementation steps of step 3 include:

Step 301, utilizing a curved hook at a top of a transplantation machine to sequentially hook the first hair strand located below the mesh base in the hair transplantation area, and utilizing the spacer to clamp the first hair strand until the first hair strand is completely transplanted in the hair transplantation area.

In step 301, a top of a needle of the transplantation machine is arranged with a curved hook, and the curved hook pierces the spacer 102 and the mesh base 101 in turn when the needle moves up and down; upon reaching the first hair strand, the curved hook on the top of the needle hooks some of the first hair strand, and brings some of the first hair strand out of the pierced hole, and the spacer shrinks after the machine needle is withdrawn from the hole, to clamp the some of the first hair strand. Step 301 is repeated until the first hair strand is completely transplanted in the hair transplantation area.

Step 302, cutting the first hair strand located between the spacer and the mesh base, affixing the first hair strand to the mesh base through an adhesive, and drying.

In step 302, the hair transplantation base after the hair transplantation is completed is removed from the first hair strand, and the hair strand between the mesh base and the spacer is cut through scissors to separate the mesh base from the spacer. An adhesive is applied to the first hair strand and dried in an oven. The first hair strand on the back of the mesh base is pressed down and ironed flat through an iron such that the first hair strand is parallel to the mesh base. The adhesive is applied again to the first hair strand on the back of the mesh base and dried in the oven.

Step 303: cutting the first hair strand on the side of the mesh base away from the spacer to 0.1 to 2 cm, to obtain the first hair weft.

In step 303, the first hair strand on the back of the mesh base is trimmed to 0.1 to 2 cm through electric push shears to obtain the first hair weft.

Step 4: preparing a second hair weft: a top of the second hair strand that is organized to a same height is fixed through two stitching lines and fixed with a glue.

Specifically, the implementation steps of step 4 include:

Step 401, tapping the top of the second hair strand flush with a clapper board, and hair that is too short is lifted by hand to keep the overall height of the second hair strand consistent.

Step 402, forming the two stitching lines on the top of the second hair strand through a double-needle sewing machine, to obtain a fixed preparatory hair weft.

Step 403, applying a masking tape 1.2 to 1.5 inches from a top of the preparatory hair weft to prevent the glue from penetrating into the second hair strand at a bottom during a subsequent brushing step, thereby achieving a shaping effect.

Step 404, mixing polyurethane glue, adhesive, and thinner in proportion to obtain a special glue for making the weft edge.

Step 405, applying the glue at a position above the masking tape, utilizing a scraper to repeatedly scrape the glue such that the glue contacts the second hair strand uniformly for fixing, and placing the second hair weft in an oven for drying.

Step 406, repeating step 405 three times to obtain the second hair weft.

Step 5, preparing the hair weft: cutting the first hair weft and the second hair weft, and affixing the second hair weft flush to a bottom of the first hair weft.

Specifically, the implementation steps of step 5 include:

Step 501, cutting the first hair weft and the second hair weft to production specifications.

Step 502, affixing the second hair weft flush to the bottom of the first hair weft to obtain the hair weft.

In step 502, the first hair weft and the second hair weft are placed vertically, and then the roots of the two hair wefts are affixed together by an adhesive.

Step 6, cleaning treatment: soaking the hair weft in an alkaline solution, and soaking the hair weft in a softener.

Specifically, the implementation steps of step 6 include:

Step 601, putting 100 g of the hair weft into 1 kg of 40° C. water, adding 2 g to 3 g of sodium hypochlorite solution, and soaking for 5 minutes.

Step 602: cleaning the hair weft three times using 40° C. water.

Step 603: after the cleaning, putting the hair weft into 1 kg of 50° C. water, adding 30 g of softener, and soaking for 10 minutes.

Step 604: after the cleaning, putting the hair weft into 1 kg of 50° C. water, adding 40 g of softener, and soaking for 10 minutes.

The purpose of step 601 to step 604 is to make the product softer and smoother and eliminate static electricity.

After step 6, step 7 of drying treatment and packaging treatment is further implemented for easy storage.

Specifically, the implementation steps of step 7 include:

Step 701, after the soaking, putting the hair weft into a centrifuge for dewatering and shaking, combing the hair weft through a dense-toothed comb, scraping off floating hairs on the hair weft, putting the hair weft into the water to be slightly wetted, unfolding and flatly laying the hair weft onto an iron plate, scraping off excess water through a brush, and putting the hair weft into a drying room at 50° C. for drying.

Step 702, finishing and packaging: after drying, ironing, combing, and folding into wefts, bundling and packaging the hair weft.

The appearance of the hair weft prepared by this process is similar to the wearer's own hair, and there is no weft edge in the conventional sense of the traditional hair weft, which solves the problems of wearing discomfort caused by the weft edge being too thick and too hard, poor breathability, and irritation of the skin when wearing due to the issue of hair return, etc., and it is more invisible after wearing, which protects the privacy of the wearer more and enhances the wearing experience.

It is to be noted that the hair weft product made by the present disclosure can be worn by sewing/pasting clips to make a clip hair product, or it can be worn by pasting a double-sided adhesive on the second hair weft and cutting.

Referring to FIGS. 4 to 16D of the drawings, a hair weft according a preferred embodiment of the present invention is illustrated, wherein the hair weft comprises a first hair weft unit 30 and a second hair weft unit 40 which is attached to the first hair weft unit 30 to increase a total hair volume of the hair weft.

More specifically, as shown in FIGS. 5A to 6B, the first hair weft unit 30 comprises a hair transplantation base 31 and a first hair strand 32 which is transplanted on the hair transplantation base 31. The first hair strand 32 comprises a plurality of first hair elements 321 each is fixed to the hair transplantation base 31. The material of the first hair elements 321 can be but not limited to real human hair, synthetic fiber, blended materials and animal hair. The first hair elements 321 made from real human hair can offer the most natural look and feel, and can be styled, dyed, and treated like natural hair. Artificial fibers, such as heat-resistant or low-temperature fibers, can be used for preparing the first hair elements 321 as then may not look as natural as human hair. The blended materials combine human hair with synthetic fibers to provide a balance between natural appearance and affordability. This mix aims to offer both the realistic look of human hair and the durability of synthetic fibers. The first hair elements 321 also may be made from hair of animals like horses or yak, so as to offer a natural texture.

The hair transplantation base 31 comprises a silk mesh 311 and a glue layer 312 applied to the silk mesh 311, the glue material of the glue layer 312 is filled into the mesh holes of the silk mesh 311, so that the hair transplantation base 31 is an integral rigid and smooth layer which is suitable for the hair transplantation process.

The material of the silk mesh 311 can be natural silk, synthetic silk, mesh or netting. The natural silk is lightweight and provides a very natural appearance, making the hair look as if it's growing directly from the scalp. Synthetic silk can be used to reduce costs or increase durability. Nylon mesh is one of the most common materials used for netting. It's inexpensive and durable, lightweight, and breathable. Polyester mesh is also commonly used. It offers good durability and elasticity while maintaining high breathability. Alternatively, mesh caps incorporate a small amount of elastic fibers to increase elasticity and comfort, making the hair extension fit more snugly to the head.

In this embodiment, the silk mesh 311 can be made of Korean Silk which is a high-quality silk base material often made from synthetic silk or specially designed fibers that mimic the texture and appearance of natural silk. Korean silk is known for its fine, soft texture and natural look, providing a scalp-like appearance, making the hair look as if it is growing from the scalp. It also offers good breathability and is commonly used in high-end hair extensions.

The glue layer 312 may comprise one or more of acrylic resin, epoxy resin, polyurethane, plasticizers such as phthalates, fillers such as calcium carbonate, and solvents such as ethyl acetate, ethanol.

The first hair strand 32 comprises a first root portion 322 and a first hair strand body 323, the first root portion 322 of the first hair strand 32 is penetrated through the hair transplantation base 31 and is then fixed to a rear surface of the hair transplantation base 31 by a fixing glue, the rear surface of the hair transplantation base 31 is a binding surface 313 for adhering the first root portion 322 of the first hair strand 32. The first hair strand body 323 is extended at a front side of the hair transplantation base 31. Both of the first root portion 322 and the first hair strand body 323 are formed by the plurality of the first hair elements 321 which are aligned with each other in a strand.

The hair transplantation base 31 is correspondingly formed with a plurality of transplantation holes 314 when the first root portion 322 of the first hair stand 32 is passing through the glue layer 312 of the hair transplantation base 31. The first root portion 322 and the first strand body 323 are extended at two opposite sides of the hair transplantation base 31.

Figure 10:
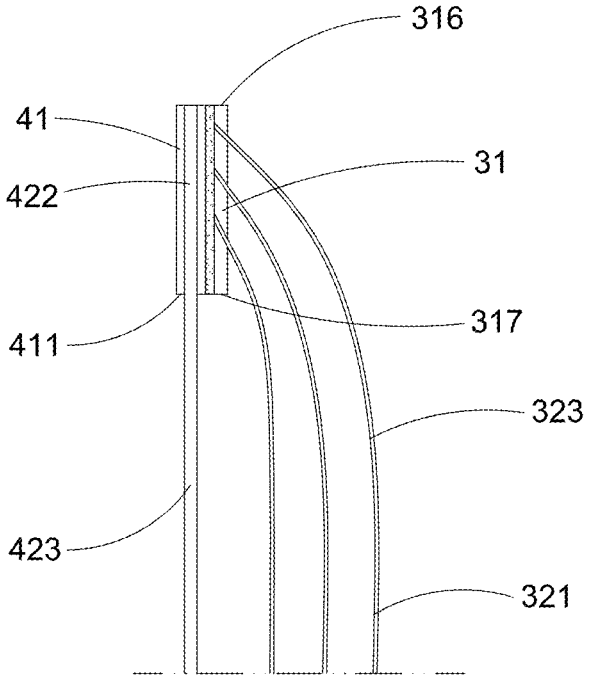
FIG. 10 is a sectional view illustrating the hair weft according to the above preferred embodiment of the present invention.

A top end of the first hair stand body 323 is planted on a front surface 315 of the hair transplantation base 31, and a top row of first hair elements 321 of the plurality of first hair elements 321 can be extended from a position on the front surface 315 adjacent to a top edge 316 of the hair transplantation base 31, as shown in FIG. 10, so that more first hair elements 321 are planted on the hair transplantation base 31.

Figure 7A:
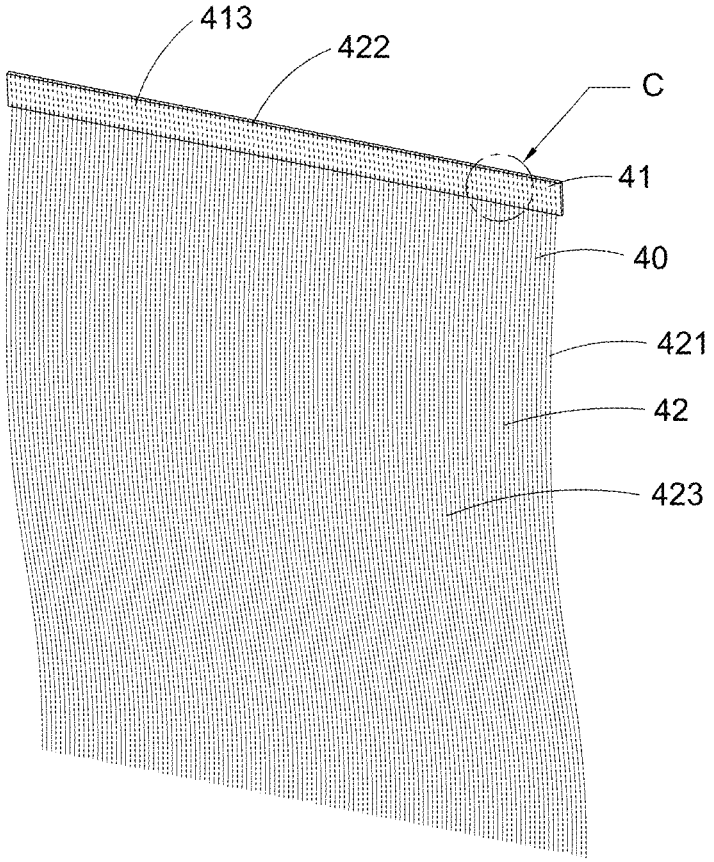
FIG. 7A is a perspective view illustrating a rear side of the first hair weft unit of the hair weft according to the above preferred embodiment of the present invention.
Figure 7B:
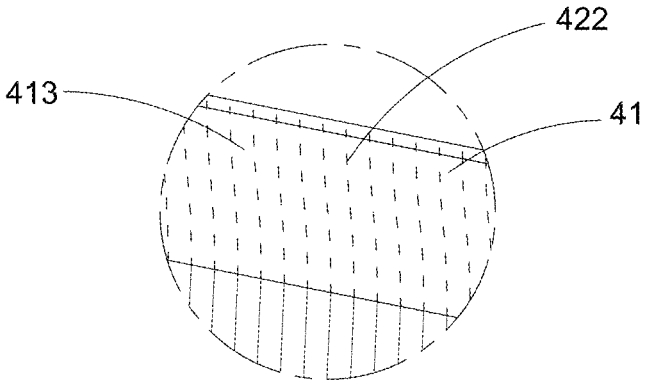
FIG. 7B is a partial enlarged view of area C in FIG. 5A.

Referring to FIGS. 7A and 7B, the second hair weft unit 40 comprises an attaching base 41 and a second hair strand 42 fixed to the attaching base 41. The attaching base 41 is adhered to the rear binding surface 313 of the hair transplantation base 31 by a binding glue, so as to fix and mount the second hair weft unit 40 to the first hair weft unit 30.

According to this embodiment, the attaching base 41 can be formed by a glue material, such as a mixture of polyurethane glue, adhesive, and thinner or diluent. Preferably, a weight content of polyurethane glue is ranged from 40%-60%, a weight content of adhesive is ranged from 10%-30%, and a weight content of thinner is ranged from 20%-40%.

The binding glue for attaching the attaching base 41 to the hair transplantation base 31 may contain one or more of epoxy resin, polyurethane, acrylic resin adhesive, phenolic resin adhesive, polyester resin adhesive, and neoprene adhesive.

Figure 16A:
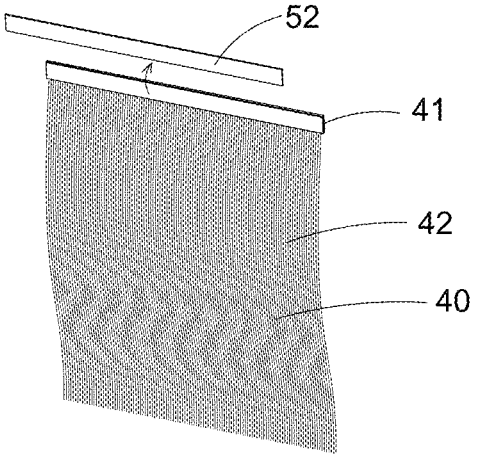
FIGS. 16A, 16B, 16C and 16D are schematic views illustrating the preparing of the hair weft by attaching the first hair weft unit to the second hair weft unit according to another alternative mode of the above preferred embodiment of the present invention.
Figure 16B:
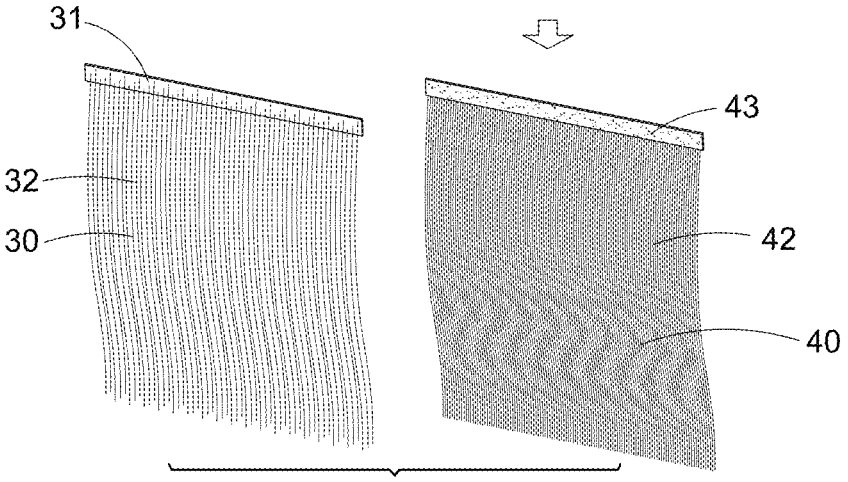
Figure 16C:
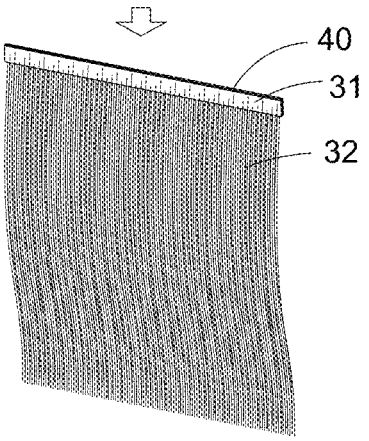
Figure 16D:
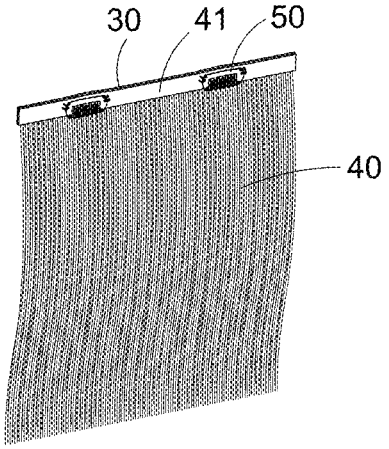

Alternatively, as another alternative mode, with reference to FIG. 16B, the attaching base 41 may be attached to the hair transplantation base 31 by a double-sided tape 43. In other words, the attaching base 41 and the hair transplantation base 31 can be adhered to two opposite sides of the double-sided tape 43.

The second hair strand 42 comprises a plurality of second hair elements 421, and the material of the second hair elements 421 can be but not limited to real human hair, synthetic fiber, blended materials and animal hair. The second hair strand 42 also comprises a second root portion 422 and a second hair strand body 423 integrally extended from the second root portion 422, the plurality of second hair elements 421 are arranged in rows to form the second root portion 422 and the second hair strand body 423.

In this embodiment, the second root portion 422 of the second hair strand 42 is embedded in the attaching base 41. During the preparing process of the second hair weft unit 40, run two or more rows of stitching 424 along the second root portion 422 of the second hair strand 42 using a sewing machine to obtain a secured preparatory hair weft, and then the glue material of the mixture of polyurethane glue, adhesive, and thinner is applied to the second root portion 422 of the second hair strand 42, and dried to form the attaching base 41 which is embedded with the second root portion 422 of the plurality of second hair elements 421. In this embodiment, the attaching base 41 is shaped and sized to couple with the hair transplantation base 31, so as to form an integral base for supporting the first hair strand 32 and the second hair strand 42. As shown in FIG. 10 of the drawings, the first hair strand body 323 of the first hair strand 32 and the second hair strand body 423 of the second hair strand 42 are provided at two opposite sides of the hair transplantation base 31, so that the two hair weft units are combined to result in a final product that meets a high volume requirement. Gluing the hair transplantation base 31 between the two hair strands ensures a strong bond and seamless integration of the two hair weft units, creating a cohesive and natural-looking final product.

More specifically, the first hair strand body 323 of the first hair strand 32 is extended from the front surface 315 of the hair transplantation base 31, and a top end of the second hair strand body 423 of the second hair strand 42 is extended from a bottom edge 411 of the attaching base 411 and is preferred to be extending from a position corresponding to a bottom edge 317 of the hair transplantation base 31.

According to this embodiment, a top row of the first hair elements 321 of the first hair strand body 323 is extended from the top edge 316 of the hair transplantation base 31 and is naturally draping over the hair transplantation base 31 in a curved manner, the second hair strand body 423 is straightly extended from the bottom edge of the hair transplantation base 31, the starting points of their extensions are different, with the more curled first hair strand body 323 overlaying the second hair strand 42, a sense of depth and layering is created, so as to enhance the overall realism of the transplanted hair and improve texture, making the transplanted hair look more voluminous and lifelike. In other words, the two hair strand bodies provide varying textures and layers, this visual depth and texture is like the natural growth patterns of hair, making the hair weft look more authentic and appealing.

In addition, the first hair strand 32 has a lower density while the second hair strand 42 can be configured to have a higher density. In other words, in a same designated area corresponding to an area in the hair transplantation base 31, the number of the first hair elements 321 is smaller than the number of the second hair elements 421, so that the varying densities of the two hair strands contribute to a more pronounced layered effect, further mimicking natural hair growth.

Figure 11:
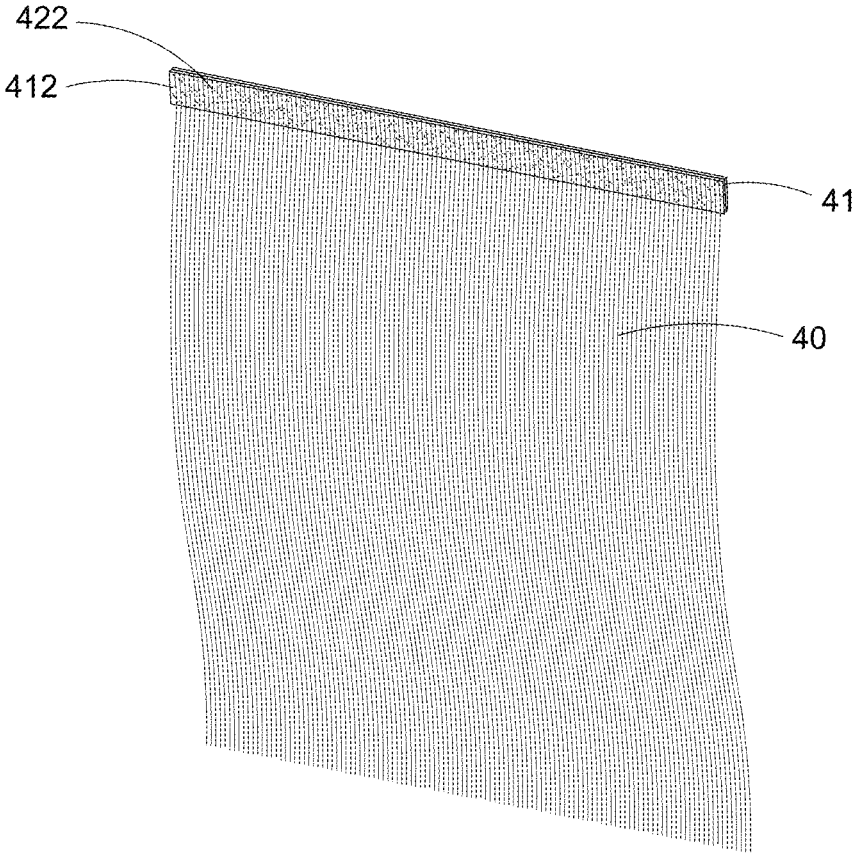
FIG. 11 is a perspective view illustrating a second hair weft unit of the hair weft according to an alternative mode of the above preferred embodiment of the present invention.
Figure 12:
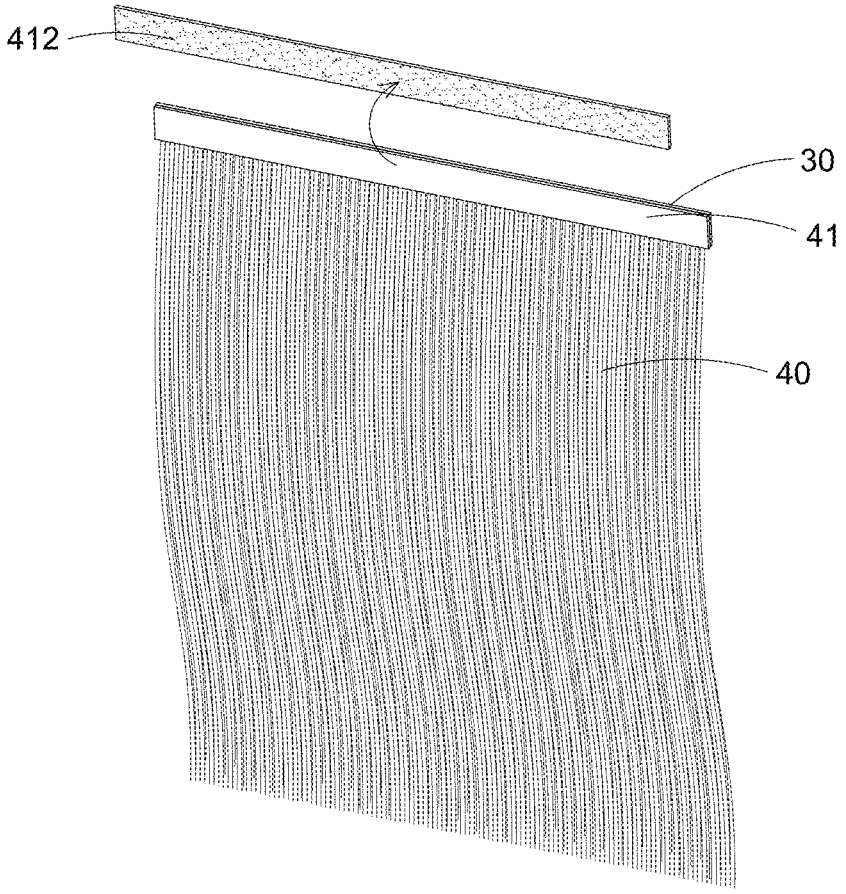
FIG. 12 is a schematic view illustrating the hair weft according to an alternative mode of the above preferred embodiment of the present invention.
Figure 13A:
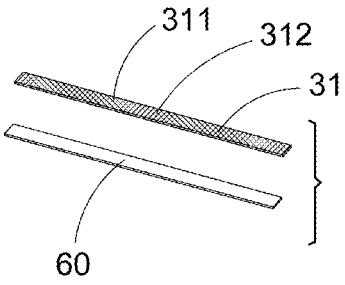
FIGS. 13A, 13B, 13C and 13D are schematic views illustrating the preparing of the first hair weft unit of the hair weft according to the above preferred embodiment of the present invention.
Figure 13B:
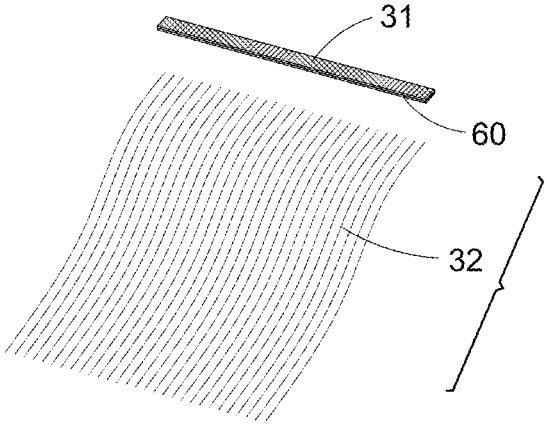
Figure 13D:
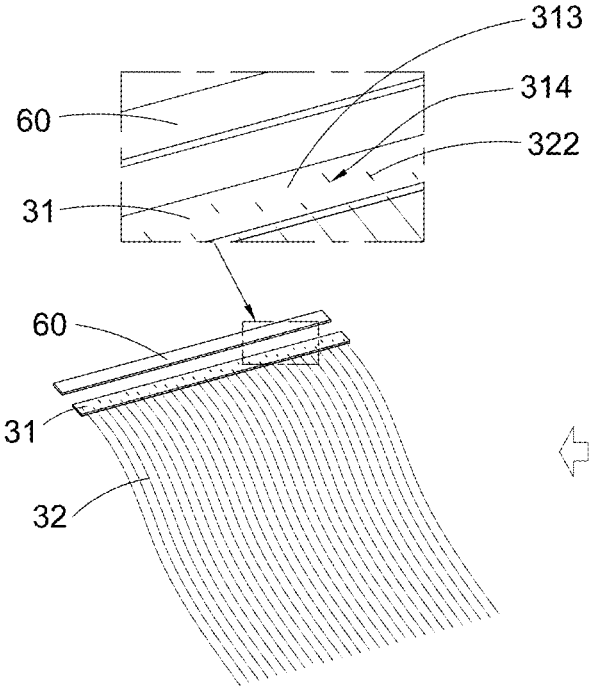
Figure 13C:
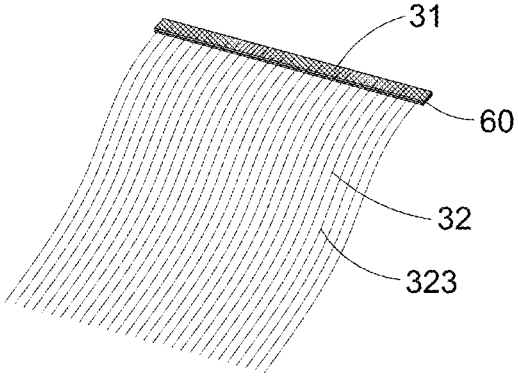
Figure 14A:
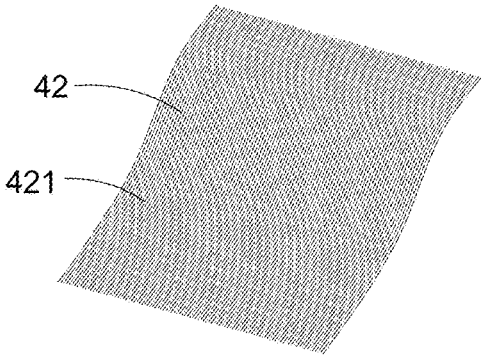
FIGS. 14A, 14B, 14C, 14D, 14E and 14F are schematic views illustrating the preparing of the second hair weft unit of the hair weft according to the above preferred embodiment of the present invention.
Figure 14B:
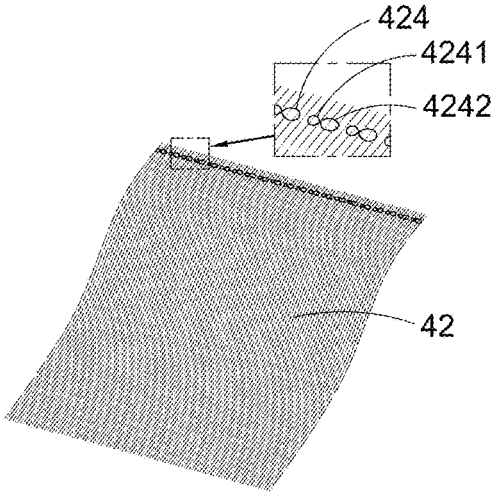
Figure 14D:
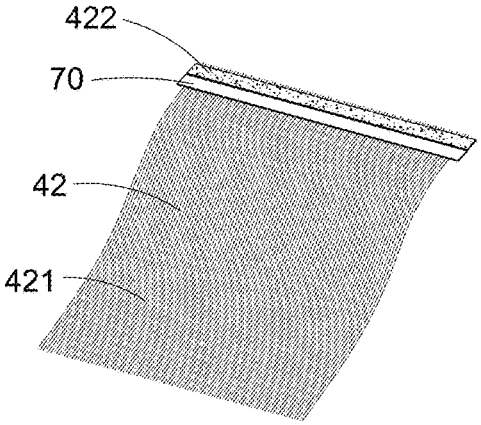
Figure 14C:
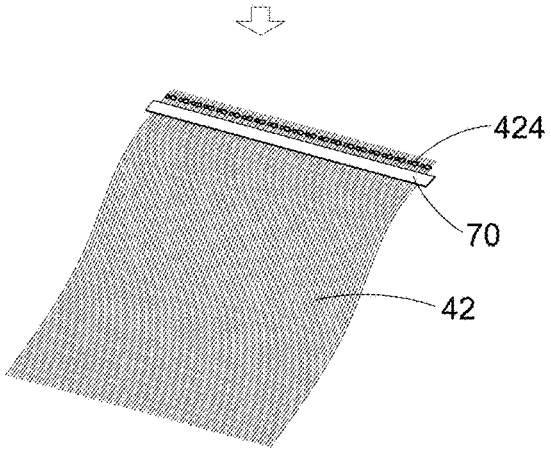
Figure 14E:
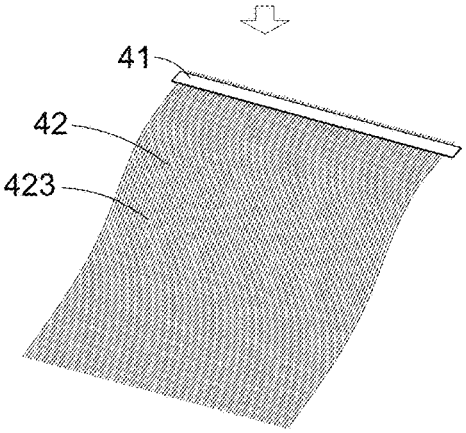
Figure 14F:
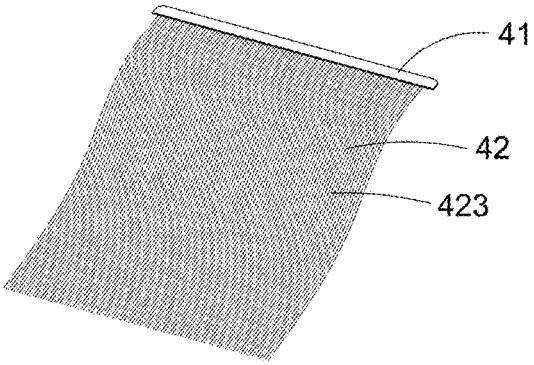
Figure 15A:
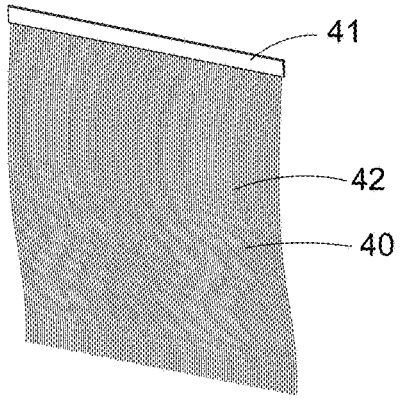
FIGS. 15A, 15B, 15C and 15D are schematic views illustrating the preparing of the hair weft by attaching the first hair weft unit to the second hair weft unit according to the above preferred embodiment of the present invention.
Figure 15B:
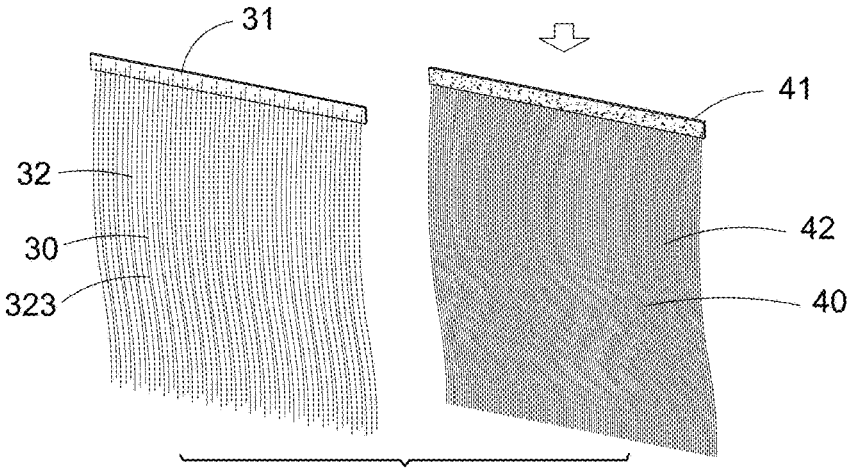
Figure 15C:
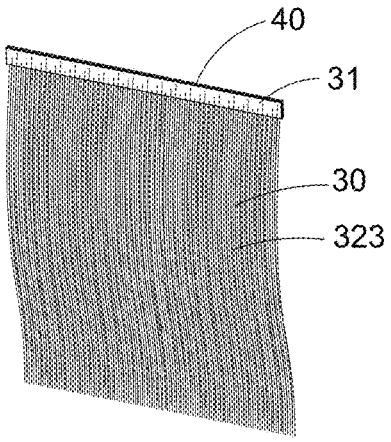
Figure 15D:
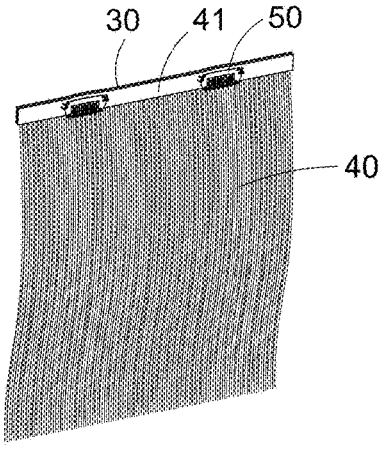

Referring to FIGS. 11 and 12 of the drawings, according to an alternative mode, the second hair weft unit 40 comprises an attaching base 41 and a second hair strand 42 fixed to the attaching base 41. The attaching base 41 in this embodiment is an adhering tape, and a second root portion 422 of the second hair strand 42 is adhered to an adhering surface 412 of the adhering tape, and the adhering tape is adhered to the rear binding surface 313 of the hair transplantation base 31 by a binding glue, so as to fix and mount the second hair weft unit 40 to the first hair weft unit 30.

The adhering tape can be a double-sided tape, so that the other side of the adhering tape which is not attached to the second hair strand 42 can be used for being adhered to the hair of the user, so as to wear the hair weft of the present invention on the user.

Referring to FIGS. 8A to 9B of the drawings, the hair weft further comprises an attaching unit 50 which is coupled to a rear side of the attaching base 41 of the second hair weft unit 40 for coupling the hair weft to the hair of the user. Accordingly, the attaching base 41 has a front surface 413 that is adhered to the hair transplantation base 31, and a rear surface 414 for mounting the attaching unit 50.

In this embodiment, the attaching unit 50 comprises a clipping element 51 which is used for clipping the hair weft on the hair of the user. The clipping element 51 comprises a fixing base 511 and a clipping member 512 movably coupled to the fixing base 511, so as to define a clipping groove 513 for clipping the hair of the user.

The fixing base 511 has a plurality of fixing holes 5111, the clipping element 51 further comprises a plurality of connecting strings 514 which are penetrating through the hair transplantation base 31 and the attaching base 41, as well as the corresponding fixing holes 5111 for connecting the fixing base 511 to the first hair weft unit 30 and the second hair weft unit 40.

Figure 8A:
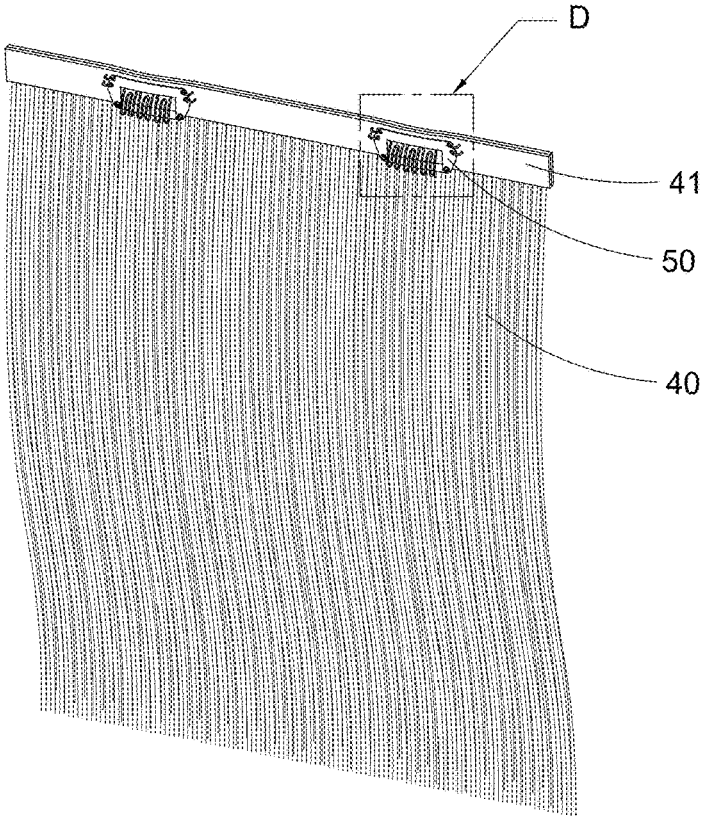
FIG. 8A is a perspective view illustrating a rear side of the hair weft according to the above preferred embodiment of the present invention, wherein a clipping element is in an open state.
Figure 8B:
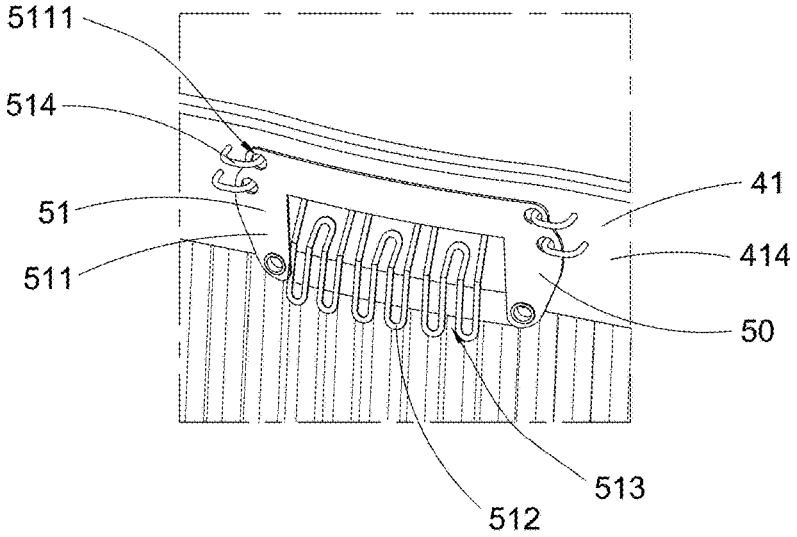
FIG. 8B is a partial enlarged view of area D in FIG. 8A.
Figure 9A:
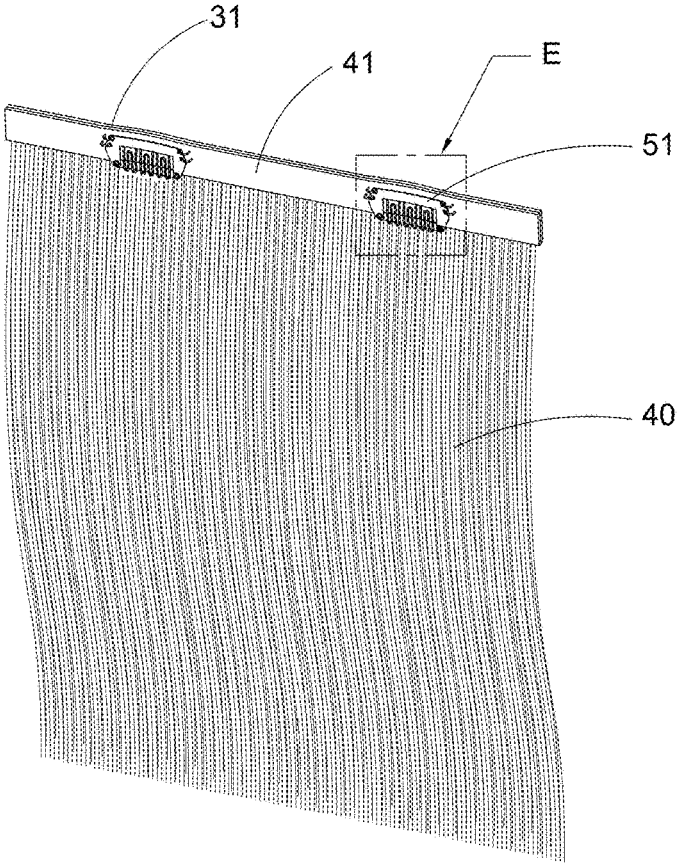
FIG. 9A is a perspective view illustrating the clipping element of the hair weft being in a closed state according to the above preferred embodiment of the present invention.
Figure 9B:
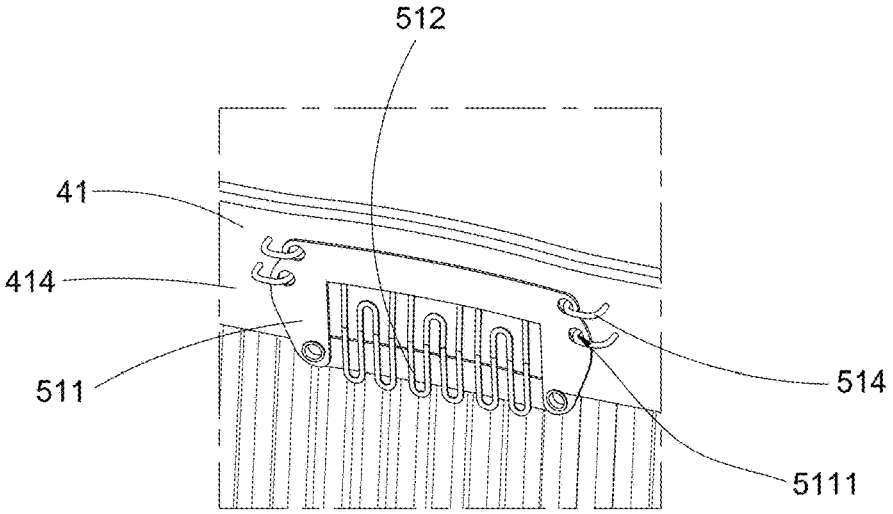
FIG. 9B is a partial enlarged view of area E in FIG. 9A.

As shown in FIGS. 8B and 9B of the drawings, the fixing base 511 has two sets of fixing holes 5111 at two end portions thereof, and the clipping element 51 comprises two connecting strings 514 mounted to each of the two sets of fixing holes 5111 respectively.

The fixing base 511 is made of a resilient material, and in a closed state, the clipping member 512 is attached to the fixing base 511. When in a use state, the two end portions of the fixing base 511 can be pressed to deform the fixing base 511, so that the clipping member 512 is spaced apart from the fixing base 511 to define the clipping groove 513.

When the hair weft of the present invention is worn on the head of the user, the attaching unit 50 is attached to the head of the user, the second weft unit 40 is provided under the first weft unit 30 and is more close to the scalp, so that by replicating the natural decrease in hair density from the scalp outwards, the hair weft of the present invention achieves a more authentic and lifelike look. The higher density of the second hair strand 42 positioned nearer the scalp creates a fuller and more secure attachment, potentially improving comfort and preventing slippage.

Referring to FIGS. 16A to 16D of the drawings, as an alternative mode, the hair weft further comprises an attaching unit 50 which is coupled to a rear side of the attaching base 41 of the second hair weft unit 40 for coupling the hair weft to the hair of the user. In this embodiment, the attaching unit 50 comprises a double-sided binding tape 52, one side of the double-sided binding tape 52 is attached to the rear surface 414 of the attaching base 41, the other side of the double-sided binding tape 52 is used for adhering the hair of the user during usage.

The person of ordinary skilled in the art should understand that in alternative modes, the hair weft may comprise two first hair weft units 30, the hair transplantation bases 31 of the two first hair weft units 30 are attached to each other, so as to form two layers of hair strands. The attaching unit 50 which may be the double-sided binding tape 52 can be attached to one of the first hair weft units 30 for mounting the hair weft to the hair of the user.

In another alternative mode, the hair weft may comprise the first hair weft unit 30 and the second hair weft unit 40, and the second hair weft unit 40 can be mounted to the front surface 315 of the first hair weft unit 30, and an upper portion of the first hair strand body 322 is sandwiched between the hair transplantation base 31 of the first hair weft unit 30 and the attaching base 41 of the second hair weft unit 40.

Referring to FIGS. 13A to 15D of the drawings, a preparing method of the hair weft according to the preferred embodiment of the present invention is illustrated. The preparing method comprises a process of preparing the first hair weft unit 30, a process of preparing the second hair weft unit 40, a process of attaching the second hair weft unit 40 to the first hair weft unit 30, a process of cleaning the hair weft unit, and a process of mounting the attaching unit 50 to the second hair weft unit 40.

The process of preparing the first hair weft unit 30 comprises a step of mounting a support piece 60 with the hair transplantation base 31, and a step of transplanting the first hair strand 32 on the hair transplantation base 31.

More specifically, referring to FIGS. 13A to 13D, the support piece 60 with a marked transplantation area is aligned with the hair transplantation base 31, the support piece 60 is shaped and sized to couple with the hair transplantation base 31 and then is fixed with the hair transplantation base 31. For example, a stapler can be used to fix the support piece 60 with the hair transplantation base 31. The hair transplantation base 31 is prepared by applying the glue layer 312 on the silk mesh 311.

When transplanting the first hair strand 32 on the hair transplantation base 31, a middle part of the material of the first hair strand 32 is fixed by two clamping plates each is provided with a curved pin, and then the material of the first hair strand 32 is placed in a transplantation area of a transplantation machine, the combination of the support piece 60 and the hair transplantation base 31 is placed on the first hair strand 32 in a manner that the hair transplantation base 31 is sandwiched between the support piece 60 and the hair transplantation base 31.

The transplantation machine is then in operation to drive needle hooks to guide the material of the first hair strand 32 to pass through the hair transplantation base 31 and the support piece 60. And then the portion of the material of the first hair strand 32 disposed between the support piece 60 and the hair transplantation base 31 is cut to leave a first root portion 322 of the first hair strand 32 on the rear binding surface 313 of the hair transplantation base 31. The support piece 60 is thus separated from the hair transplantation base 31. The length of the first root portion 322 is preferred to be ranged from 0.1 cm-2 cm. Finally, a fixing glue is applied to the first root portion 322 of the first hair strand 32 to the rear binding surface 313 of the hair transplantation base 31.

The support piece 60 can be a natural leather layer or a PVC artificial leather layer. In this embodiment, the support piece 60 is made of PVC artificial leather and has a thickness of 0.4 mm. After the needle hooks of the transplantation machine pierce the support piece 60 and the glue layer 312 of the hair transplantation base 31 in turn when the needle hooks move up and down, the material of the first hair elements 321 of the first hair strand 32 is guided to be out of the pierced transplantation holes 314, and the resilient support piece 60 shrinks after the needle has been withdrawn from the transplantation holes 314, so as to clamp and retain the first hair strand 32 in position.

Referring to FIGS. 14A to 14F, the process of preparing the second hair weft unit 40 comprises the steps of stitching a top of the second hair strand 42 to obtain a fixed preparatory hair weft unit, applying a masking tape 70 which is 1.2 inches to 1.5 inches from a top of the preparatory hair weft unit to define the second root portion 422 of the second hair strand 42, and applying a glue material on the second root portion 422 of the second hair strand 42 to form the attaching base 41 which is embedded with the second root portion 422 of the second hair strand 42.

Accordingly, the stitching 424 of the two stitching lines is formed on the second root portion 422 of the second hair strand 42 through a double-needle sewing machine. In this embodiment, the second hair weft unit 40 comprises a first stitching line 4241 and a second stitching line 4242, the two intersecting stitching lines 4241 and 4242 are arranged in an "8" pattern. The first stitching line 4241 is made of a water-soluble thread, and the second stitching line 4242 is a cotton thread. When exposed to the liquid glue material, the water-soluble thread of the first stitching line 4241 dissolves, causing the cotton thread of the second stitching line 4242 to detach. The purpose of these two stitching liens 4241 and 4242 is to keep the material of the second hair strand 42 of the second hair weft unit 40 flat and stable when placed on a glass surface for applying the glue material, preventing it from shifting or moving around.

The masking tape 70 is arranged to define the second root portion 422 and the second hair strand body 423 of the second hair strand 42 by preventing the glue material applied on the second root portion 422 to flow towards the second hair strand body 423 of the second hair strand 42.

The glue material can be a mixture of polyurethane glue, adhesive, and thinner or diluent. The preparation of the glue material comprises a step of mixing polyurethane glue, adhesive, and thinner, wherein a weight content of polyurethane glue is ranged from 40%-60%, a weight content of adhesive is ranged from 10%-30%, and a weight content of thinner is ranged from 20%-40%.

Referring to FIGS. 15A to 15D, in the process of attaching the second hair weft unit 40 to the first hair weft unit 30, the binding glue is applied between the attaching base 41 and the hair transplantation base 31, so as to for the hair weft comprising the first hair weft unit 30 and the second hair weft unit 40. The binding glue is made of one or more of epoxy resin, polyurethane, acrylic resin adhesive, phenolic resin adhesive, polyester resin adhesive, and neoprene adhesive.

Alternatively, the attaching base 41 and the hair transplantation base 31 are respectively adhered to two opposite sides of a double-sided tape, so as to assemble the first weft unit 30 with the second weft unit 401.

In the process of cleaning the hair weft unit comprising the first weft unit 30 and the second weft unit 40, 100 g of the hair weft is added into 1 kg of 40° C. water, 2 g to 3 g of sodium hypochlorite solution is added into the water, and soak for 5 minutes; and then clean the hair weft for three times using 40° C. water; after the cleaning, the hair weft is put into 1 kg of 50° C. water, 30 g of softener is added, and soak for 10 minutes; after the previously cleaning step, the hair weft is put into 1 kg of 50° C. water, 40 g of softener is added, and soak for 10 minutes, so as to make the product softer and smoother and eliminate static electricity.

After the above cleaning step with the water, a drying treatment is further implemented for easy storage. More specifically, after the soaking, the hair weft is put into a centrifuge for dewatering and shaking, the hair weft is combined through a dense-toothed comb to scrape off floating hairs on the hair weft, the hair weft is then put into the water to be slightly wetted, unfold and flatly lay the hair weft onto an iron plate, scrape off excess water through a brush, and then the hair weft is put into a drying room at 50° C. for drying.

In the process of mounting the attaching unit 50, the attaching unit 50 which can be embodied as a clipping element 51 is attached to the rear surface 414 of the attaching base 41 of the second weft unit 40 by the connecting strings 514 which are respectively penetrating through the attaching base 41 and the hair transplantation base 31.

As an alternative mode, a double-sided binding tape 5 is used as the attaching unit 50, one side of the double-sided binding tape 52 is attached to the rear surface 414 of the attaching base 41, the other side of the double-sided binding tape 52 is used for adhering the hair of the user during usage.

Figure 17:
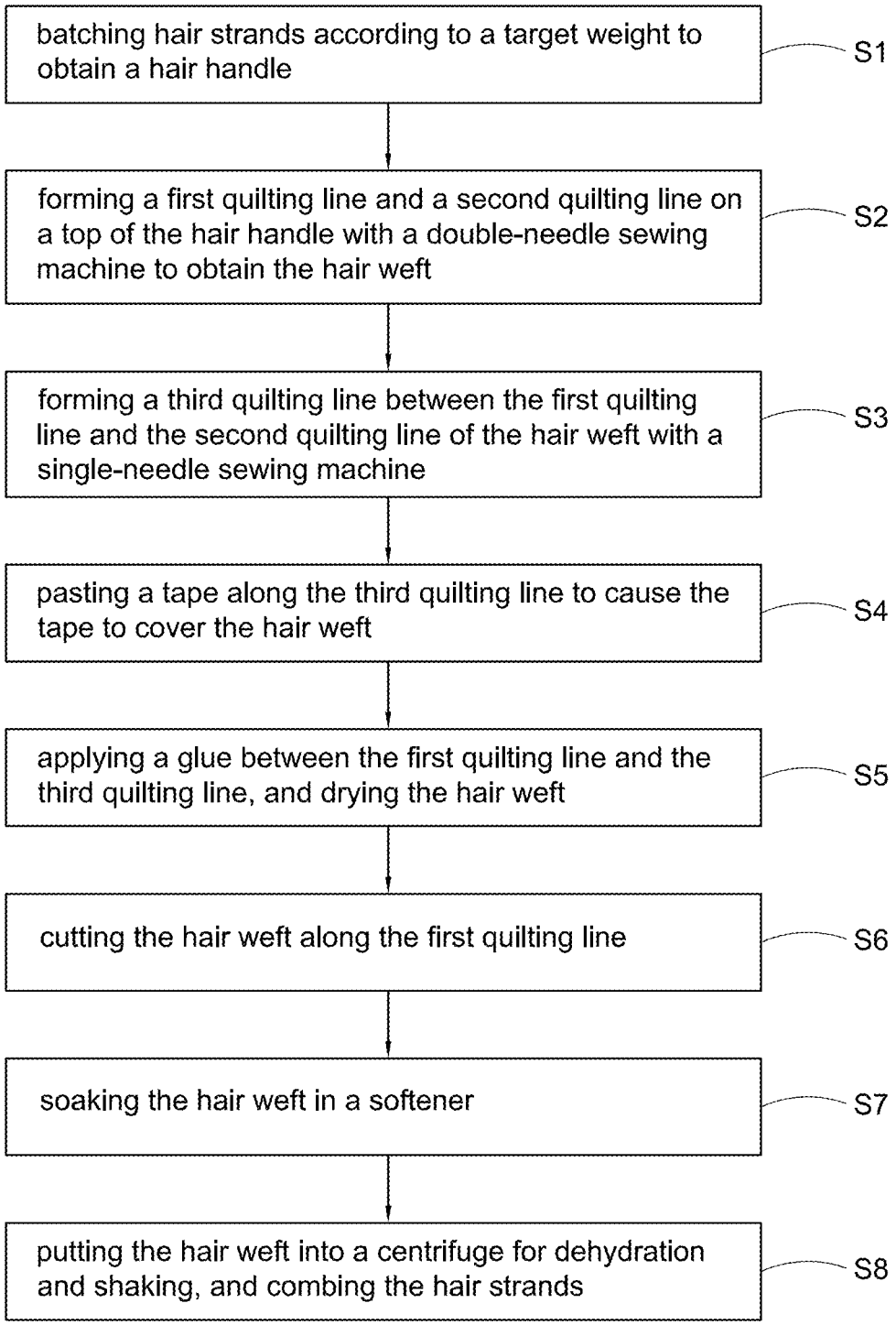
FIG. 17 is a flowchart of a preparation process of a hair weft according to another embodiment of the present invention.
Figure 18:
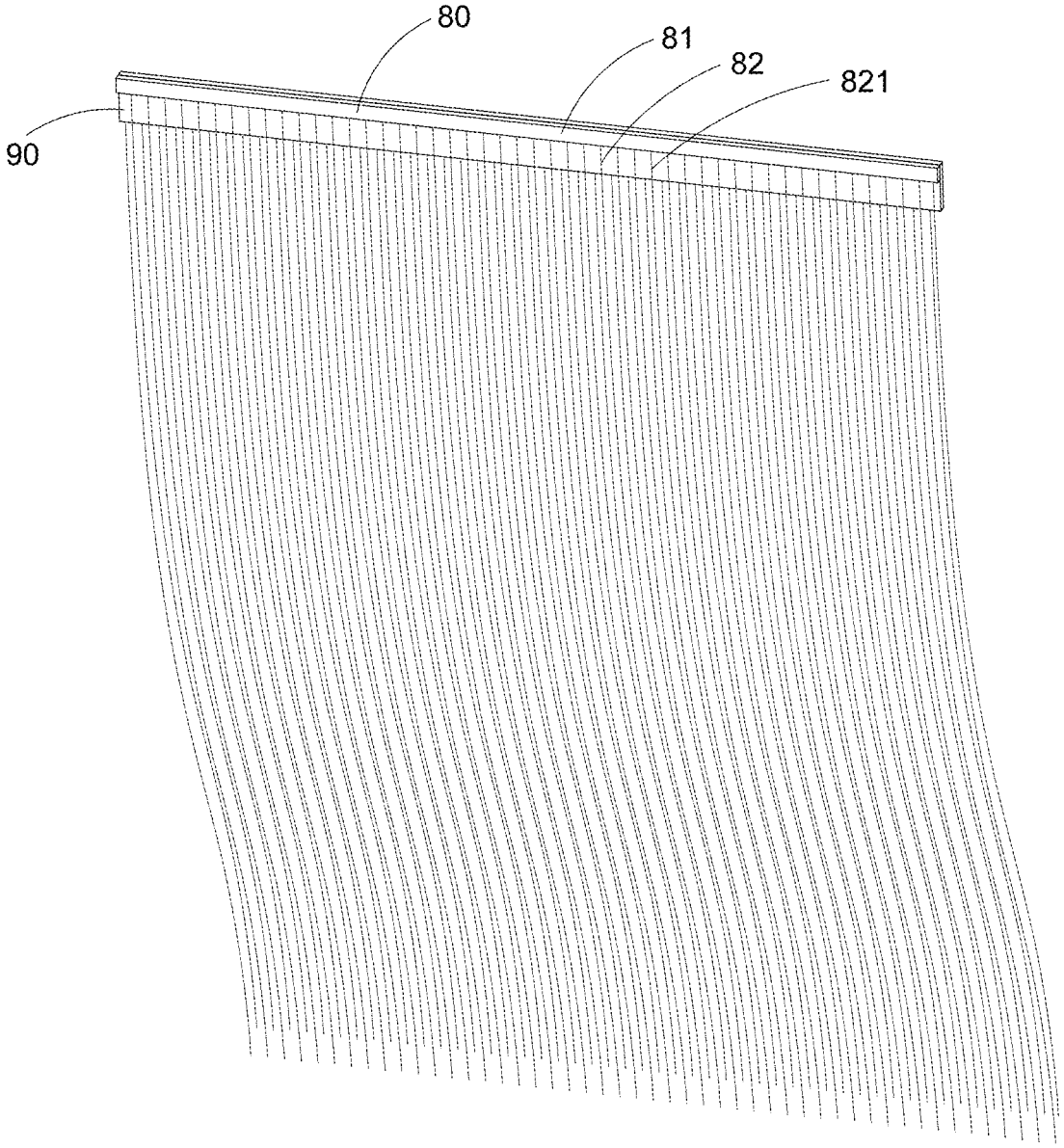
FIG. 18 is a perspective view of a hair weft according to another preferred embodiment of the present invention.

As shown in FIG. 17, a preparation method of a hair weft provided by the present disclosure includes the following steps, which are illustrated at blocks.

At block S1: batching hair strands according to a target weight to obtain a hair handle. In some embodiments, a 100 g weight of hair strands is taken as an example for making the hair handle.

At block S2: forming a first stitching line and a second stitching line on a top of the hair handle with a double-needle sewing machine to obtain the hair weft. Specifically, the first stitching line is a cotton sewing thread and the second stitching line is a water-soluble sewing thread. The double-needle sewing machine has a gauge of 30-35 stitches per inch, and a spacing between the first stitching line and the second stitching line is 3-4 mm. In this way, the hair weft may be secured for subsequent production.

At block S3: forming a third stitching line between the first stitching line and the second stitching line of the hair weft with a single-needle sewing machine. Specifically, the third stitching line is a cotton sewing thread, and a spacing between the third stitching line and the first stitching line is 1 mm. Since there are two cotton sewing threads, namely, the first stitching line and the third stitching line, and the spacing therebetween is only 1 millimeter, the hair weft may not have problems such as discomfort of wearing and poor breathability caused by the weft edge being too thick and too hard.

At block S4: pasting a tape along the third stitching line to cause the tape to cover the hair weft. Specifically, a textured paper tape is pasted along the third stitching line made of cotton, such that the textured paper tape covers the hair strands, thereby preventing glue from penetrating into the interior of the hair strands during the step of applying the glue, and shaping the hair weft.

At block S5: applying a glue between the first stitching line and the third stitching line, and drying the hair weft.

At block S6: cutting the hair weft along the first stitching line. Specifically, the protruding excess hair strands are cut off along the first stitching line made of cotton, retaining only 1 mm of hair strands above the third stitching line, which can make the weft edge of the hair weft invisible when wearing the hair weft, and the hair weft is stable while not being affected by the sewing threads.

At block S7: removing the textured paper tape and soaking the hair weft in a softener. Since the second stitching line is a water-soluble sewing thread, the second stitching line will dissolve and disappear when the hair weft is soaked.

At block S8: putting the hair weft into a centrifuge for dehydration and shaking, and combing the hair strands.

In step S5, the glue may be a mixture of a polycarbonate glue, an adhesive, and a diluent. In some embodiments, the step S5 comprises the following steps:

Step S51: applying a first glue between the first stitching line and the third stitching line on a front side of the hair weft, and drying the hair weft at a drying temperature of 45-50° C. for 15 minutes;

Step S52: applying a second glue between the first stitching line and the third stitching line on the front side of the hair weft, and drying the hair weft at a drying temperature of 45-50° C. for 15 minutes;

Step S53: applying a third glue between the first stitching line and the third stitching line on the front side of the hair weft, and drying the hair weft at a drying temperature of 45-50° C. for 120 minutes;

Step S54: applying a fourth glue between the first stitching line and the third stitching line on a back side of the hair weft, and drying the hair weft at a drying temperature of 45-50° C. for 15 minutes;

Step S55: applying a fifth glue between the first stitching line and the third stitching line at the back side of the hair weft, and drying the hair weft at a drying temperature of 45-50° C. for 15 minutes;

Step S56: applying a sixth glue between the first stitching line and the third stitching line on the back side of the hair weft, and drying the hair weft at a drying temperature of 45-50° C. for 240 minutes.

The glue is repeatedly scraped using a scraper each time the glue is applied, such that the glue is in uniform contact with the hair strands and serves to fix the hair strands.

In some embodiments, the step S7 comprises the following steps:

Step S71: adding 2 g-3 g of a sodium hypochlorite solution to 1 kg of water at 40° C. to obtain a first solution, and soaking the hair weft in the first solution for 5 minutes;

Step S72: washing the hair weft with water at 40° C.;

Step S73: adding 30 g of the softener to 1 kg of water at 50° C. to obtain a second solution, and soaking the hair weft in the second solution for 10 minutes;

Step S74: adding 40 g of the softener to 1 kg of water at 50° C. to obtain a third solution, and soaking the hair weft in the third solution for 10 minutes.

In some embodiments, the step S8 further comprises the steps of placing the hair weft into the third solution slightly moistened, unfolding and laying flat the hair weft, scraping out the water, and drying. Specifically, the dried hair weft is combed using a dense-toothed comb, floating hairs on the hair weft are scraped off, the hair weft is put into the third solution again to be slightly moistened and then unfolded and laid flat on an iron plate, the excess water is scraped off using a brush, and the hair weft is put into a drying room at 50° C. for drying.

It is to be understood that the hair extension may have a variety of different colors. Therefore, step S1 may further comprise the steps of dyeing the hair strands before batching, and obtaining a dyed hair handle after batching, thereby preparing a dyed hair weft.

Further, the preparation method may further comprise a step S9: ironing and combing the hair weft, stacking the hair weft, and bundling and packaging for transportation.

The present disclosure provides a preparation method of a hair weft, including: batching hair strands according to a target weight to obtain a hair handle; forming a first stitching line and a second stitching line on a top of the hair handle with a double-needle sewing machine to obtain the hair weft; forming a third stitching line between the first stitching line and the second stitching line of the hair weft with a single-needle sewing machine; pasting a tape along the third stitching line to cause the tape to cover the hair weft; applying a glue between the first stitching line and the third stitching line, and drying the hair weft; cutting the hair weft along the first stitching line; soaking the hair weft in a softener; and putting the hair weft into a centrifuge for dehydration and shaking, and combing the hair strands. The hair weft prepared by the method of the present disclosure has a high production efficiency and has no short hair folding back, which is less lossy and less prone to hair loss compared to handmade hair wefts, and does not have the problems of wearing discomfort and poor breathability caused by too thick and too hard weft edge compared to the hair wefts made by a triple-head weft machine, and does not irritate the skin.

Referring to FIG. 18 to FIG. 28 of the drawings, a hair weft according to another preferred embodiment of the present invention is illustrated. The hair weft comprises a first hair weft unit 80 and a second hair weft unit 90 attached to the first hair weft unit 80.

In this embodiment, the first hair weft unit 80 comprises a first glue base 81 and a first hair strand 82 which comprises a plurality of first hair elements 821 provided on the first glue base 81. The second hair weft unit 90 comprises a second glue base 91 and a second hair strand 92 which comprises a plurality of second hair elements 921 provided on the second glue base 91.

The first glue base 81 is the base of the first hair weft unit 80, serving as the foundation where the first hair strands 82 are attached. It plays a critical role in maintaining the integrity and stability of the weft. The first hair strand 82 is composed of a plurality of the first hair elements 821, these hair elements are embedded or attached to the first glue base 81. The plurality of first hair elements 821 gives the hair strand its volume and natural flow, simulating real hair growth patterns.

Similar to the first glue base 81, the second glue base 91 serves as the base for the second hair weft unit 90. Its structure is designed to complement the first glue base 81, providing a stable foundation for bonding the two units together. The second hair strand 92 is composed of a plurality of the second hair elements 921, this strand also contributes to the overall volume and density of the hair weft. The distribution and orientation of these hair elements 821 and 921 are designed to enhance the natural look and feel of the hair.

The presence of both the first and second hair weft units 80 and 90 allows for the layering of hair strands, significantly increasing the volume of the weft compared to single-layer designs. This multi-layered structure makes the hair appear fuller, more natural, and offers better coverage. The combination of multiple hair elements 821 and 921 ensures that the hair weft can achieve superior thickness while maintaining a lightweight feel, giving users a more luxurious appearance.

Each hair weft unit features hair elements that are designed to mirror the natural flow of human hair. The staggered arrangement of the hair strands from both the first and second weft units 80 and 90 prevents the formation of unnatural gaps or bunching. Additionally, the blending of the two layers creates a seamless appearance, making it difficult to distinguish between the natural hair of the wearer and the hair weft. The result is an overall effect that enhances realism, contributing to a softer, more natural look.

By utilizing two different layers with their respective weft edges, the hair weft achieves a superior texture, combining the best properties of both layers. The double-layer system distributes the weight of the hair more evenly, preventing the weft from feeling bulky or uncomfortable on the scalp. This contributes to a smoother and more comfortable fit for the wearer, especially during extended use.

The material of the first hair elements 821 and the second hair elements 921 can be but not limited to real human hair, synthetic fiber, blended materials and animal hair. The first hair elements 821 and the second hair elements 921 made from real human hair can offer the most natural look and feel, and can be styled, dyed, and treated like natural hair. Artificial fibers, such as heat-resistant or low-temperature fibers, can be used for preparing the first hair elements 821 and the second hair elements 921 as they may look as natural as human hair. The blended materials combine human hair with synthetic fibers to provide a balance between natural appearance and affordability. This mix aims to offer both the realistic look of human hair and the durability of synthetic fibers. The first hair elements 821 and the second hair elements 921 also may be made from hair of animals like horses or yak, so as to offer a natural texture.

In this embodiment, each of the first glue base 81 and the second glue base 91 can be made of a mixture of polycarbonate glue or polyurethane glue, adhesive, and thinner or diluent. Preferably, a weight content of polycarbonate glue or polyurethane glue is ranged from 40%-60%, a weight content of adhesive is ranged from 10%-30%, and a weight content of thinner is ranged from 20%-40%.

Figure 19:
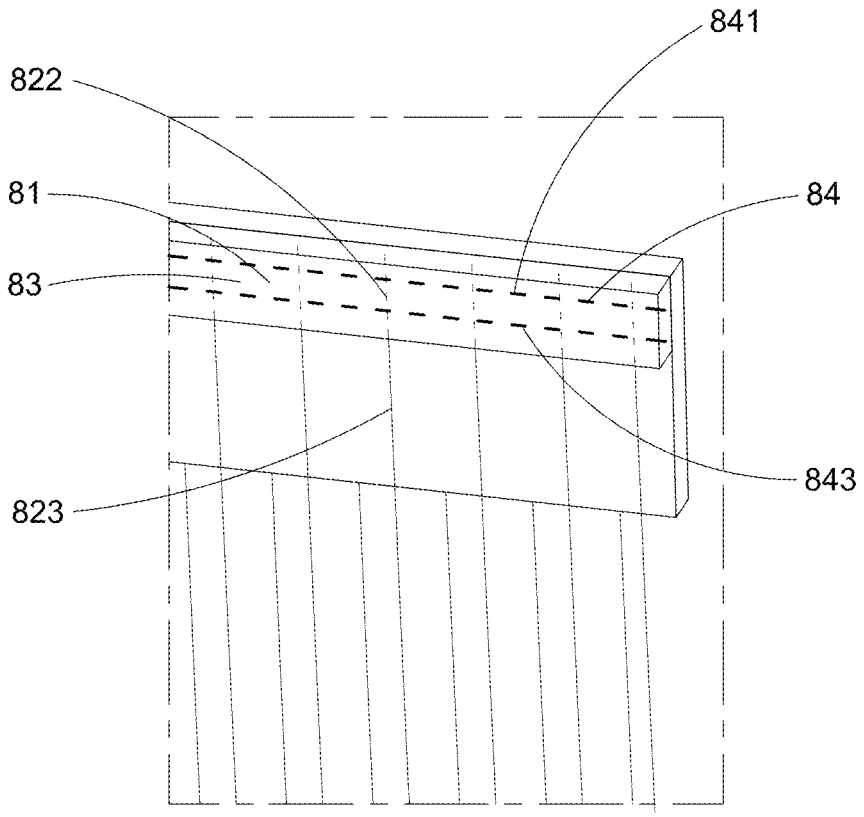
FIG. 19 is a partial enlarged view illustrating a first weft edge of the hair weft according to the above preferred embodiment of the present invention.

The first hair strand 82 comprises a first root portion 822 and a first hair strand body 823 integrally extended from the first root portion 822, the first root portion 822 is embedded into the first glue base 81 when the glue material is applied on the first hair strand 82, as shown in FIG. 19.

Figure 21:
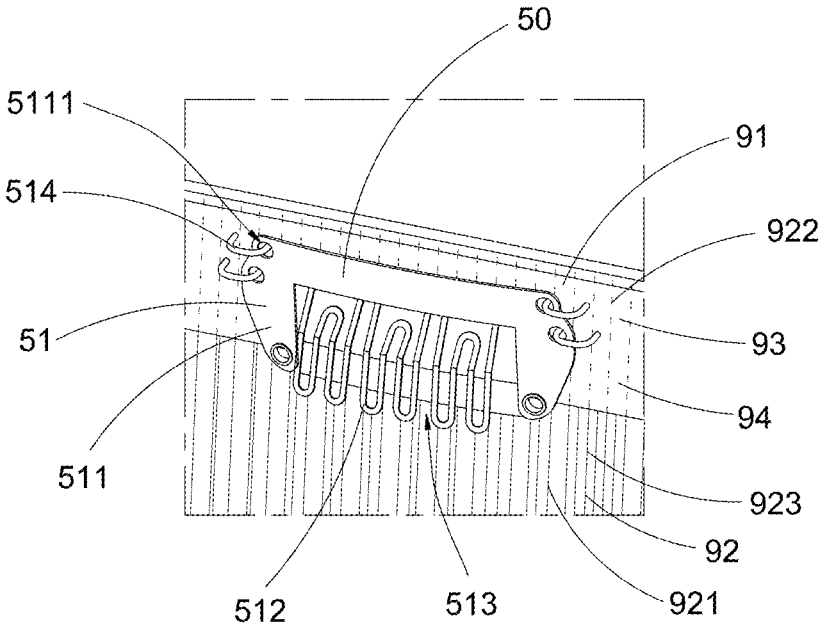
FIG. 21 is a partial enlarged view illustrating a second weft edge of the hair weft according to the above preferred embodiment of the present invention.

As shown in FIG. 21, the second hair strand 92 comprises a second root portion 922 and a second hair strand body 923 integrally extended from the second root portion 922, the second root portion 922 is embedded into the second glue base 91 when the glue material is applied on the second hair strand 92.

The integration of the root portions 822 and 922 into the corresponding glue bases 81 and 91 ensures a strong bond that minimizes the risk of hair shedding or separation. This structural feature contributes to the longevity and durability of the hair weft, making it suitable for regular wear. By extending the hair strand bodies 823 and 923 from their respective root portions 822 and 922, the design allows for natural movement and flexibility. This mimics the behavior of real hair, enhancing the realism of the hair extension. The strands can move freely, which prevents stiffness and ensures a more dynamic appearance when worn.

The integration of the root portions into the glue bases also creates a more natural transition from the glued area to the visible hair. This design minimizes the appearance of any artificial attachment points, making the hair weft blend more seamlessly with the wearer's natural hair.

The first hair weft unit 80 comprises a first weft edge 83 formed by the first glue base 81 and the first root portion 822 of the first hair strand 82, the second hair weft unit 90 comprises a second weft edge 93 formed by the second glue base 91 and the second root portion 922 of the second hair strand 92. Both of the first weft edge 83 and the second weft edge 93 are not formed with folded back hair.

Conventional hair extensions often involve folded-back hair at the weft edges, which can create a bulkier, less natural appearance, particularly at the base. By avoiding this folding process, the weft edges 83 and 93 of the hair wefts present a much smoother and more natural look, wherein the hair appears to flow directly from the base without any visible "loops" or folded hair sections.

Without the need to fold back the hair, the weft edges are thinner and less bulky. This thinner edge enhances the overall comfort for the wearer, as the hair extension sits more naturally and snugly against the scalp, avoiding any excess thickness that might cause discomfort or make the hair extension feel unnatural.

The non-folded design allows the hair strands 82 and 92 to extend directly from their root portions 822 and 922 without any interruptions caused by folding. This results in a more realistic flow of the hair, as it behaves in a manner closer to natural hair growth. The strands can lay flat, fall more fluidly, and move more naturally when the wearer is in motion.

In designs where hair is folded back, the folded section often creates points of tension or stress on the strands, making them more prone to breakage over time. By eliminating the folded-back structure, this design reduces the risk of hair strands breaking at the base. The glue base 81 and 91 directly embed the root portions 822 and 922, creating a stronger bond and increasing the longevity of the hair weft.

Folded-back hair can sometimes lead to tangling or matting at the weft edge, especially after prolonged use. By not folding the hair, the hair weft of the present invention remains tangle-free at the base, making it easier to maintain, comb, and style. This feature ensures that the hair extension retains its neat appearance over time.

The non-folded weft edges allow for a smoother transition between the weft and the wearer's natural hair. This seamless blending is crucial for achieving a more natural look, particularly when the hair extension is used in partial installations or when it is clipped into existing hair. The hair weft becomes almost imperceptible, enhancing the overall aesthetic.

The absence of folded-back hair also simplifies the process of cutting and styling the hair weft. The wearer or stylist can trim the weft edge without worrying about exposing loops of hair or compromising the structure of the weft. This flexibility allows for more customization and precision in achieving the desired hairstyle.

Not forming folded-back hair can streamline the production process. The manufacturing process of non-folded edges requires fewer steps, which can reduce production time and cost. Additionally, this method reduces the amount of material needed, as there is no need to fold extra hair strands into the glue bases 81 and 91.

The first hair weft unit 80 further comprises a stitching means 84 for fixing the first hair strand 82. In this embodiment, the stitching means 84 comprises a first stitching line 841 and a third stitching line 843, the first glue base 81 is applied between the first stitching line 841 and the third stitching line 843. A distance between the first stitching line 841 and the third stitching line 843 in this embodiment is smaller than 3 mm, preferred 0.5 mm to 2 mm, such as 1 mm or 2 mm. In this embodiment, the distance between the first stitching line 841 and the third stitching line 843 is embodied to be 1 mm.

The first weft edge 83, which is formed by the first glue base 81 between the first stitching line 841 and the third stitching line 843, and the first root portion 822 of the first hair strand 82, is fixed with two sewing lines with extremely narrow intervals to form a cluster of hair bundles. After being coated with glue and dried and fixed, the first weft edge 83 is in an irregular hair bundle shape, and the appearance is similar to that of a hand tied weft.

As shown in FIG. 19, the first stitching line 841 and the third stitching line 843 are applied in parallel to secure the first hair strand 82 of the first hair weft unit 80. These sewing lines ensure that the first root portion 822 of the first hair strand 82 is fixed in place while creating an aesthetic that mimics hand tied weft.

The glue material is applied between the first and third stitching lines 841 and 843, embedding the first root portion 822 and providing additional fixation to prevent any movement of the hair strands. The tight spacing of the stitching lines 841 and 843 and the application of glue create small clusters of hair strands, giving the first hair weft unit 80 a hand tied appearance. This irregular formation makes the hair weft look more natural, as hand tied wefts are typically characterized by subtle variations in hair distribution, resulting in a more authentic look.

Since, the two stitching lines 841 and 843 are positioned very close together, so that it is ensured that the first hair elements 821 are tightly secured. The first glue base 81 applied between them further locks the root portion 822 of the first hair strand 82 in place, providing additional strength and preventing the strands from coming loose or shifting over time. This increases the longevity of the hair weft by ensuring that the hair remains securely fastened, even with frequent use.

The narrow distance, 1 mm in this case, between the stitching lines 841 and 843 results in a thin weft edge 83. This thin edge is less bulky compared to traditional designs, enhancing the comfort of the hair weft when worn. The wearer will experience a smoother, more snug fit, as the hair weft conforms more naturally to the scalp without adding unnecessary bulk. The tightly packed stitching lines 841 and 843 allow the first hair elements 821 to be grouped into small bundles, which enhances the flow and movement of the hair. This design ensures that the first hair strand 82 falls naturally, without appearing overly rigid or synthetic. The irregular hair bundle shape also adds to the realistic aesthetic of the first hair weft unit 80.

In addition, by using two stitching lines in close proximity, the design optimizes the use of materials such as the glue material. The minimal distance between the lines reduces the amount of glue needed, while still providing a secure hold. This efficiency can lower production costs without compromising the quality or durability of the first hair weft unit 80.

The irregular hair bundle shape formed by this design allows for more versatile styling options. The clusters of hair can be shaped and styled more flexibly, which is particularly important for achieving more complex or voluminous hairstyles. The hand-tied-like appearance gives stylists and wearers greater freedom to create different looks while maintaining a natural aesthetic.

The use of stitching lines combined with the application of glue between them streamlines the production process. Compared to more complex hand tied or hair wefts prepared by machine insertion technology, this method allows for faster production without sacrificing the quality of the final product. The efficiency of this approach reduces labor time and costs, making it easier to scale production to meet consumer demand.

Since the first hair elements 821 are firmly embedded between the two stitching lines 841 and 843 and bonded with glue, the risk of hair loss or unraveling when the first hair weft unit 80 is cut is minimized. This allows the wearer or stylist to cut and shape the hair weft as needed without worrying about loosening the first hair elements 821, ensuring a cleaner and more precise cut.

In this embodiment, when the hair weft is worn on the wearer, the first hair weft unit 80 is an upper weft unit above the second weft unit 90. In other words, compared with the second hair weft unit 90, the first hair weft unit 80 is away from the skin of the head of the wearer. The first hair weft unit 80 is placed on top of the second weft unit 90, so that this layered arrangement ensures that the first hair weft unit 80 appears more prominently on the exterior of the hair weft, providing the desired coverage and volume while the second weft unit 90 lies closer to the scalp to offer a secure foundation.

The combination of the secure stitching, glue base, and thin weft edge results in a more comfortable and natural-feeling hair weft for the wearer. The hair extension formed by the first weft unit 80 will be less noticeable when worn, improving overall satisfaction, especially during extended wear.

The second hair weft unit 90 may further comprise a mesh yarn 94 on a side of the second glue base 91, the other side of the second glue base 91 of the second weft unit 90 is attached to the first glue layer 81 of the first weft unit 80 by a bonding glue, so as to form the final product of the hair weft of this embodiment.

The mesh yarn 94 provides a supportive framework that adds structural integrity to the second weft unit 90. It is positioned on one side of the second glue base 91 adjacent to the scalp when the hair weft is worn on the wearer, allowing the second hair strand 92 to be securely fixed while also enabling flexibility. The mesh yarn 94 adds additional support, ensuring that the hair strands in the second weft unit 90 remain securely in place. This stability is essential for maintaining the overall shape of the hair weft and preventing any sagging or displacement.

Figure 20:
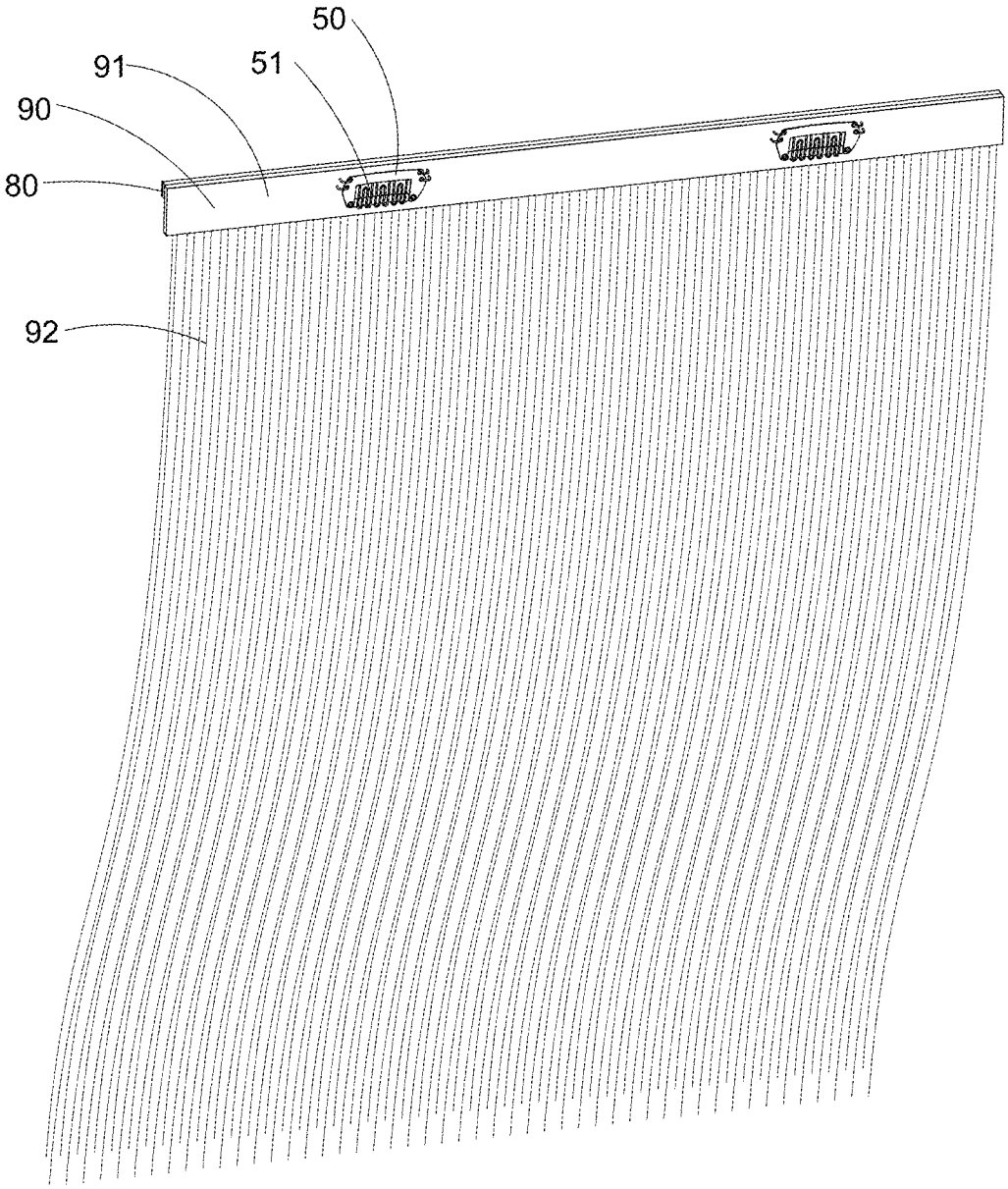
FIG. 20 is another perspective view of the hair weft according to the above preferred embodiment of the present invention.

The mesh yarn 94 is a type of yarn with a grid-like or netted structure, typically formed into an open, porous configuration. It is commonly made from polyester fibers or other synthetic fibers such as nylon or polypropylene. Due to its structural properties, the mesh yarn 94 offers both flexibility and mechanical strength. As shown in FIG. 20 and FIG. 21 of the drawings, an attaching unit 50 can be mounted on the second hair weft unit 90 at a side of the second hair weft unit 90 adjacent to the mesh yarn 94 for coupling the hair weft to the hair of the user. Accordingly, the second glue base 91 has a top surface that is adhered to the first glue base 81, and a bottom surface of the mesh yarn 94 for mounting the attaching unit 50.

In this embodiment, the attaching unit 50 comprises a clipping element 51 which is used for clipping the hair weft on the hair of the user. The clipping element 51 comprises a fixing base 511 and a clipping member 512 movably coupled to the fixing base 511, so as to define a clipping groove 513 for clipping the hair of the user.

The fixing base 511 has a plurality of fixing holes 5111, the clipping element 51 further comprises a plurality of connecting strings 514 which are penetrating through the first hair weft unit 80 and the second hair weft unit 90, as well as the corresponding fixing holes 5111 for connecting the fixing base 511 to the first hair weft unit 80 and the second hair weft unit 90.

The fixing base 511 has two sets of fixing holes 5111 at two end portions thereof, and the clipping element 51 comprises two connecting strings 514 mounted to each of the two sets of fixing holes 5111 respectively.

The fixing base 511 is made of a resilient material, and in a closed state, the clipping member 512 is attached to the fixing base 511. When in a use state, the two end portions of the fixing base 511 can be pressed to deform the fixing base 511, so that the clipping member 512 is spaced apart from the fixing base 511 to define the clipping groove 513.

When the hair weft of the present invention is worn on the head of the user, the attaching unit 50 is attached to the head of the user, the second weft unit 90 is provided under the first weft unit 80 and is more close to the scalp. The density of the two hair weft units 80 and 90 can be the same, or the second hair strand 92 has a higher density and is positioned nearer the scalp to create a fuller and more secure attachment.

Figure 22A:
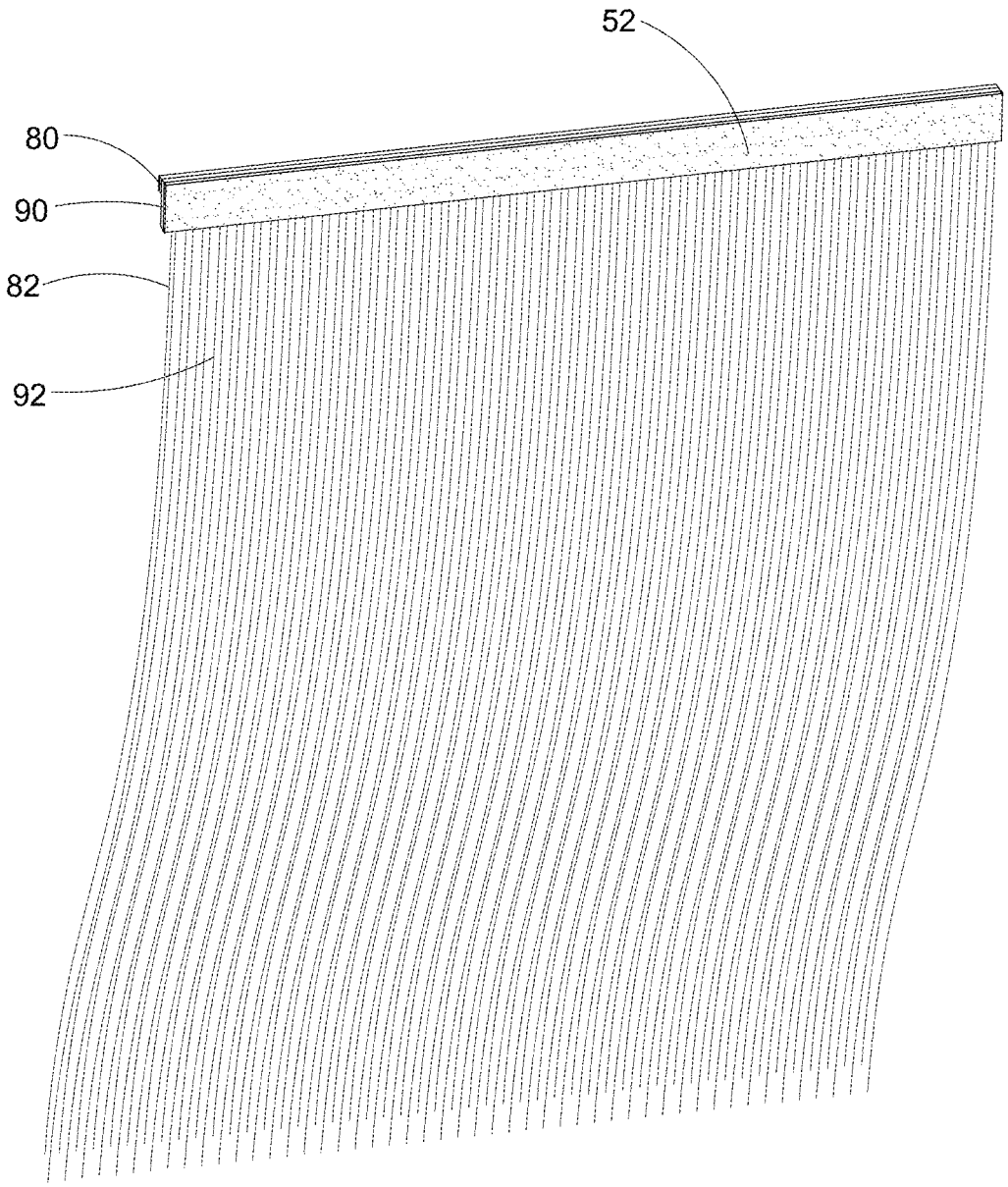
FIG. 22A is a perspective view of an alternative hair weft according to the above preferred embodiment of the present invention.
Figure 22B:
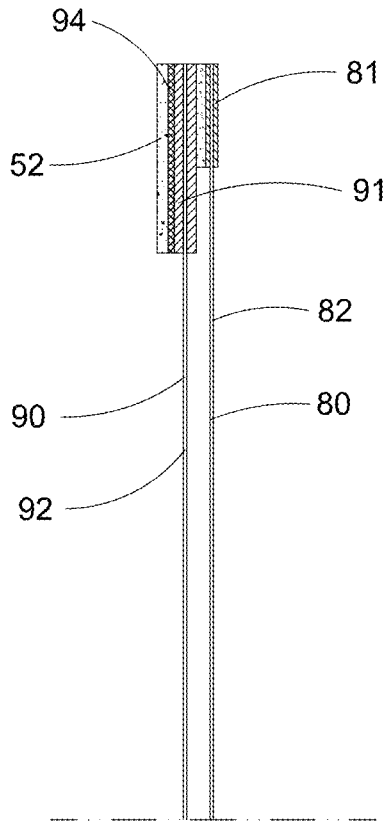
FIG. 22B is a sectional view of the above alternative hair weft according to the above preferred embodiment of the present invention.

Referring to FIG. 22A and FIG. 22B of the drawings, as an alternative mode, the hair weft further comprises an attaching unit 50 which is coupled to a bottom side of the second glue base 91 of the second hair weft unit 90 for coupling the hair weft to the hair of the user. In this embodiment, the attaching unit 50 comprises a double-sided binding tape 52, one side of the double-sided binding tape 52 is attached to the mesh yarn 94 of the second hair weft unit 90, the other side of the double-sided binding tape 52 is used for adhering the hair of the user during usage.

As shown in FIG. 22B, the mesh yarn 94 is located between the double-sided binding tape 52 and the second glue base 91, the second root portion 922 of the second hair strand 92 is located between the first glue base 81 and the mesh yarn 94. The mesh yarn 94 on the second glue base 91 increases surface roughness, which enhances the friction between the mesh yarn 94 and the inner adhesive side of the double-sided binding tape 52. This results in a stronger bond, reducing the risk of the double-sided binding tape 52 detaching from the second glue base 91 during wear. A firmer attachment between the double-sided binding tape 52 and the second glue base 91 leads to greater overall stability once the hair weft is affixed to the user's scalp. This minimizes shifting or lifting, even during physical activities or in humid conditions. The double-sided binding tape 52 can be shaped and sized to cover the mesh yarn 94, so that the mesh yarn 94 is hidden by the double-sided binding tape 52.

By incorporating the attaching unit 50, the clipping member 51 and the double-sided binding tape 52 make the hair weft easier to attach and blend with natural hair, making the hair weft suitable for various applications such as clip-ins or tape-ins.

By positioning the first hair weft unit 80 above the second unit 90, the hair weft creates a more natural appearance. The first weft unit 80, which is more visible, can be designed with more aesthetic considerations, while the second weft unit 90 remains close to the scalp to provide a secure base for the hair weft. This layer-like arrangement mimics the natural growth of hair, where the outer layers of hair cover and blend with the inner layers, giving the hair weft a fuller and more natural look.

The combination of the first and second hair weft units 80 and 90 enhances the blending capabilities of the weft. The variation in the arrangement of the first and second hair strands 82 and 92 provides better concealment of the weft when applied to the natural hair of the wearer. This creates a more natural transition between the hair of the wearer and the hair weft, minimizing visibility and making the attachment points nearly imperceptible.

Referring to FIG. 23A to FIG. 28 of the drawings, a preparing method of the hair weft is illustrated. The preparing method of the hair weft comprises a step of preparing the first hair weft unit 80, a step of preparing the second hair weft unit 90 and a step of bonding the first hair weft unit 80 and the second hair weft unit 90.

Figure 23A:
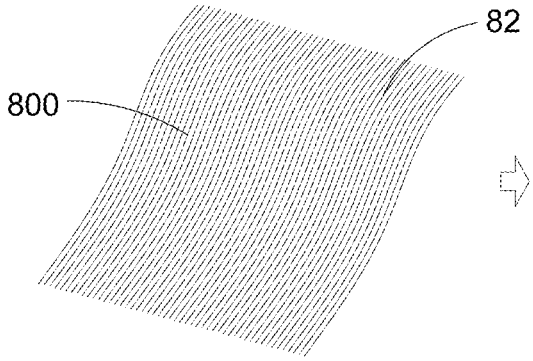
FIGS. 23A, 23B, 23C, 23D, 23E, 23F are schematic views illustrating the preparing of the first hair weft unit of the hair weft according to the above preferred embodiment of the present invention.
Figure 23B:
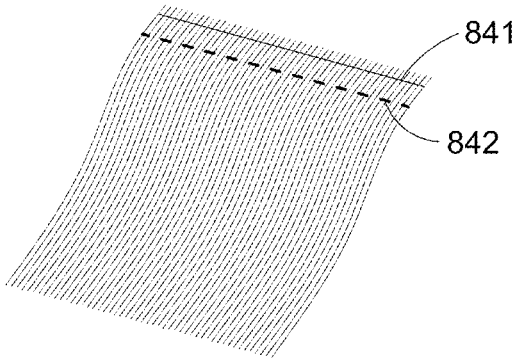

More specifically, as shown in FIGS. 23A to 23B, in the step of preparing the first hair weft unit 80, a double-needle sewing machine is used to quilt the first hair strand 82 on the top to get a fixed hair curtain. The first stitching line 841 uses a pure cotton sewing thread, and a second stitching line 842 uses a water-soluble sewing thread. The double-needle sewing machine has a stitch length of 30-35 stitches per inch, and the distance between the two needles is 3-4 mm.

Figure 23D:
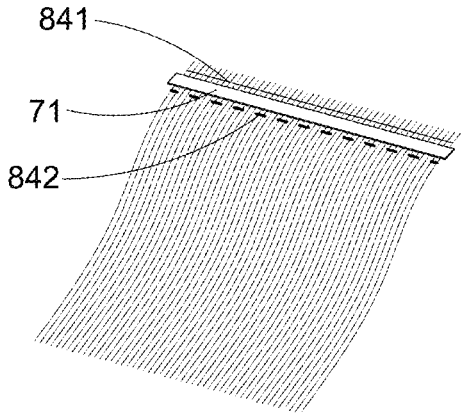
Figure 23C:
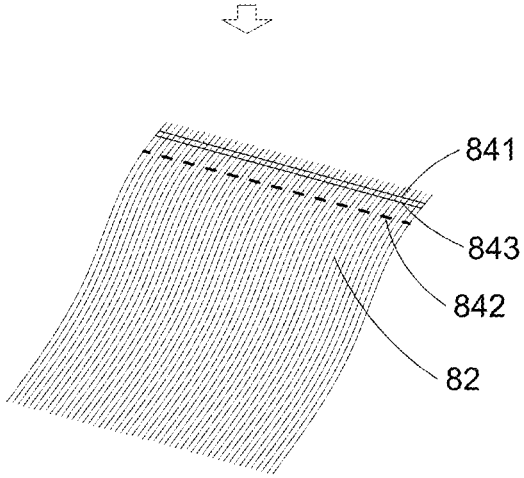

As shown in FIG. 23C, use a single-needle sewing machine to run another stitching line, the third stitching line 843, between the two stitching lines 841 and 842. Another pure cotton sewing thread is used for the third stitching line 843. The distance between the two pure cotton sewing lines in this embodiment is smaller than 3 mm, such as 1 mm in this embodiment.

A single double-needle sewing machine alone cannot achieve the extremely narrow stitching gap of 0.5-3 mm between the stitching lines 841 and 843. By combining the capabilities of both the double-needle and single-needle sewing machines, the process achieves an intricate level of stitching precision that enhances the aesthetic and structural qualities.

The double-needle machine forms the two initial stitching lines 841 and 842 with a 3-4 mm gap, while the single-needle machine adds the third stitching line 843 in between, filling in the gap with high accuracy. This combination produces a more tightly constructed hair curtain with minimized spacing, providing a smooth and seamless edge. The tightly stitched stitching lines 841 and 843 allow the first hair elements 821 to be grouped into small bundles, which enhances the flow and movement of the hair. This design ensures that the first hair strand 82 falls naturally, without appearing overly rigid or synthetic. The irregular hair bundle shape with the thin first weft edge 83 also adds to the realistic aesthetic of the first hair weft unit 80.

Alternatively, the first stitching line 841 and the third stitching line 843 may be subsequently formed one by one by a single-needle machine.

As shown in FIG. 23D, lay the first hair weft material 800 flat on a glass panel, and use a first masking tape 71 to stick it along the third cotton sewing line 843 to cover the first hair strand 82. This will prevent the glue material from penetrating into the bottom hair during the subsequent gluing step and also play a shaping role.

Figure 23E:
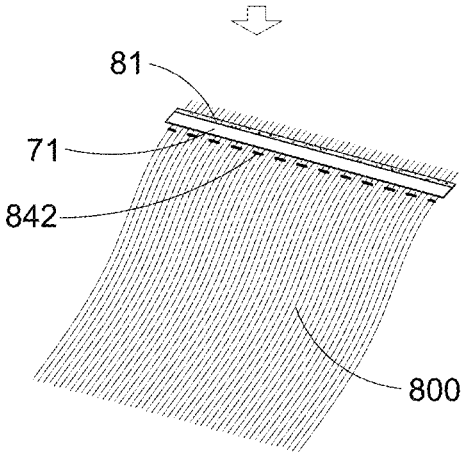

As shown in FIG. 23E, use a polycarbonate glue or polyurethane glue, an adhesive, and a diluent or thinner to mix in proportion to obtain the glue material for making the first weft edge 83.

Apply the glue material between two cotton sewing threads 841 and 843, and scrape repeatedly with a scraper to make the glue contact with the hair evenly and fix the first hair weft material 800. After finishing, put the first hair weft material 800 in a drying box for drying at a temperature of 45-50° C. for 15 minutes.

Take out the first hair weft material 800 and continue to apply the second coat of the glue material. After completion, put the first hair weft material 800 into the drying box for drying at a temperature of 45-50° C. for 15 minutes.

Take out the first hair weft material 800 and continue to apply the third coat of the glue material. After completion, put the first hair weft material 800 into the drying box for drying at a temperature of 45-50° C. for 120 minutes.

Take out the first hair weft material 800 apply the first coat of the glue material on the back, and put the first hair weft material 800 into the drying box for drying at 45-50° C. for 15 minutes.

Take out the first hair weft material 800 and continue to apply the second coat of the glue material. After completion, put the first hair weft material 800 into the drying box for drying at a temperature of 45-50° C. for 15 minutes.

Take out the first hair weft material 800 and continue to apply the third coat of the glue material. After completion, put the first hair weft material 800 into the drying box for drying at a temperature of 45-50° C. for 240 minutes.

Figure 23F:
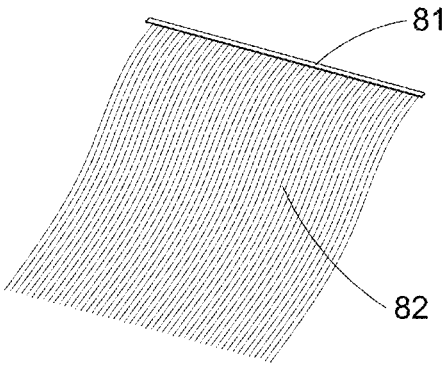

The excess hair 1.5 to 2 cm above the first stitching line 841 is cut to obtain the first hair weft unit 80, as shown in FIG. 23F.

Figure 27:
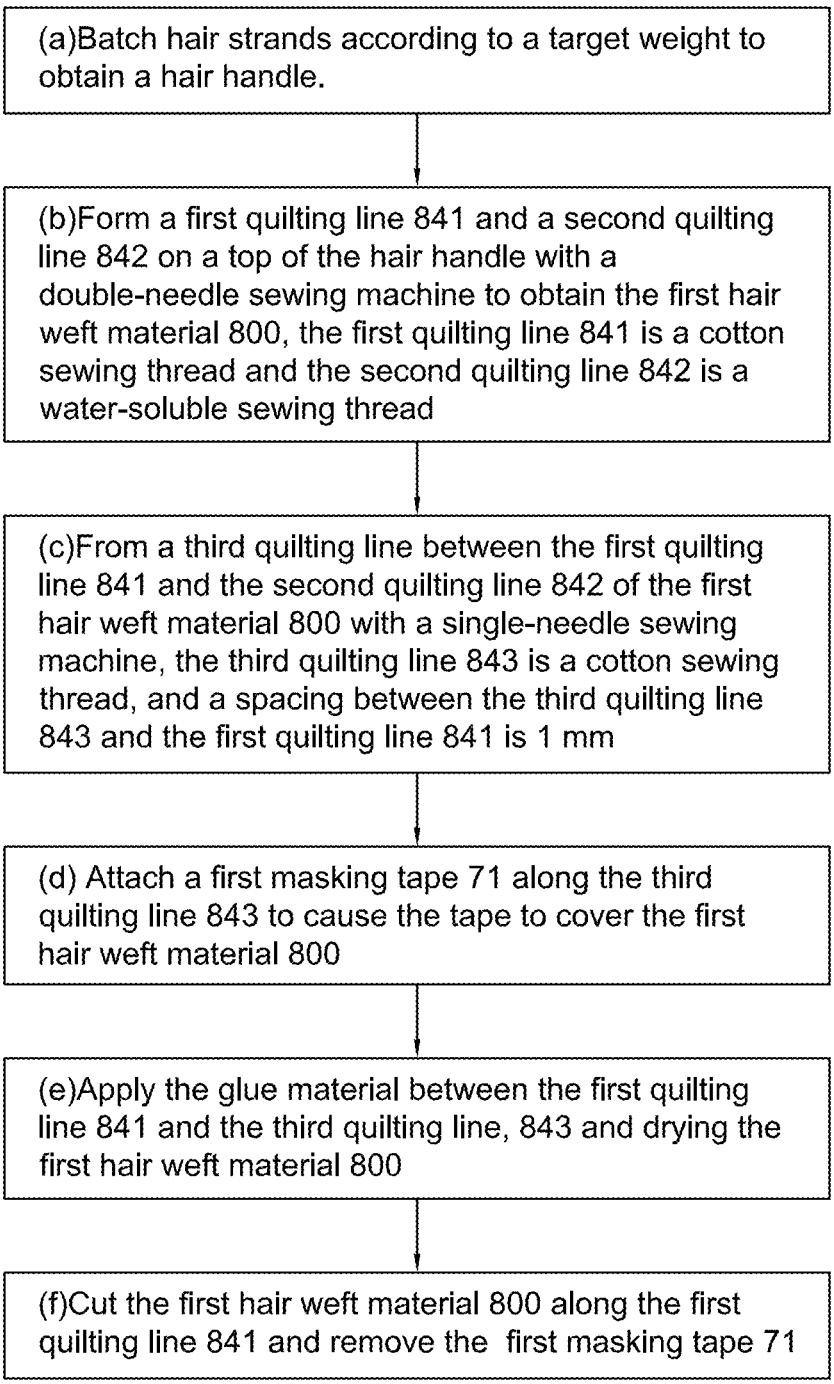
FIG. 27 is a flowchart of a preparation process of the first hair weft unit of the hair weft according to the above preferred embodiment of the present invention.

Accordingly, referring to FIG. 27, the step of preparing the first hair weft unit 80 comprises the following steps.

(a) Batch hair strands according to a target weight to obtain a hair handle.

(b) Form a first stitching line 841 and a second stitching line 842 on a top of the hair handle with a double-needle sewing machine to obtain the first hair weft material 800. Specifically, the first stitching line 841 is a cotton sewing thread and the second stitching line 842 is a water-soluble sewing thread. The double-needle sewing machine has a gauge of 30-35 stitches per inch, and a spacing between the first stitching line 841 and the second stitching line 842 is 3-4 mm.

(c) From a third stitching line between the first stitching line 841 and the second stitching line 842 of the first hair weft material 800 with a single-needle sewing machine. Specifically, the third stitching line 843 is a cotton sewing thread, and a spacing between the third stitching line 843 and the first stitching line 841 is 1 mm.

(d) Attach a first masking tape 71 along the third stitching line 843 to cause the tape to cover the first hair weft material 800. Specifically, a textured paper tape is pasted along the third stitching line 843 made of cotton, such that the textured paper tape covers the first hair strand 82, thereby preventing the glue material from penetrating into the interior of the first hair strand during the step of applying the glue material, and shaping the first hair weft material 800.

(e) Apply the glue material between the first stitching line 841 and the third stitching line, 843 and drying the first hair weft material 800.

(f) Cut the first hair weft material 800 along the first stitching line 841 and remove the first masking tape 71. Specifically, the protruding excess hair strands are cut off along the first stitching line made of cotton, retaining only 1 mm of hair strands above the third stitching line, which can make the weft edge of the hair weft invisible when wearing the hair weft, and the hair weft is stable while not being affected by the sewing threads.

Figure 24A:
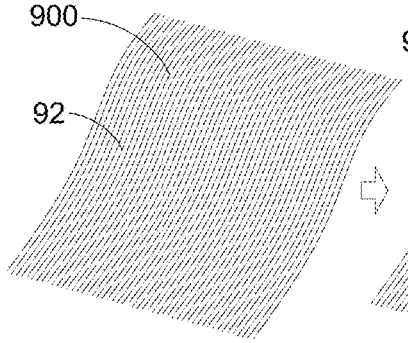
FIGS. 24A, 24B, 24C, 24D, 24E, 24F, 24G and 24H are schematic views illustrating the preparing of the second hair weft unit of the hair weft according to the above preferred embodiment of the present invention.
Figure 24B:
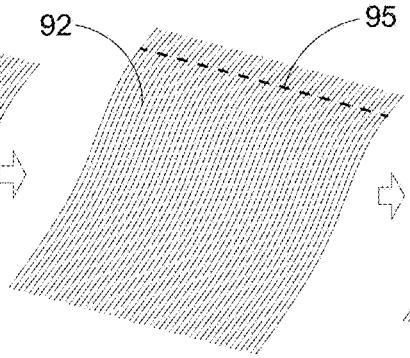

In the step of preparing the second hair weft unit 90, as shown in FIGS. 24A to 24B, a single-needle sewing machine is used to run a water-soluble sewing thread 95 about 4 to 5 cm away from the top of the second hair strand 92 to fix the second hair elements 92 to obtain a second hair weft material 900 and prevent the second hair elements 92 from spreading during production.

Figure 24C:
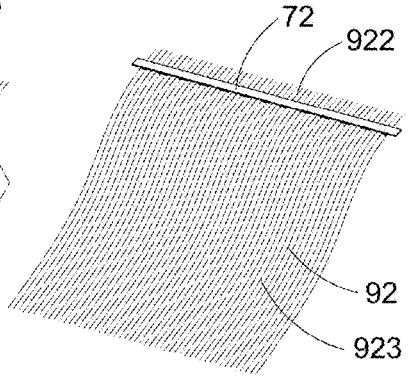

As shown in FIG. 24C, stick a second masking tape 72 about 1.2-1.5 cm away from the top of the second hair strand 92, so that the second masking tape 72 covers the hair to prevent the glue from penetrating into the bottom of the second hair strand 92 during the subsequent gluing step, and play a shaping role.

Figure 24E:
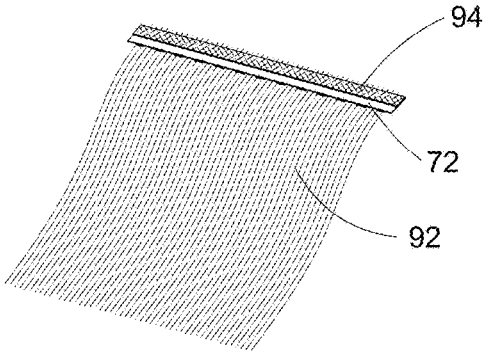
Figure 24D:
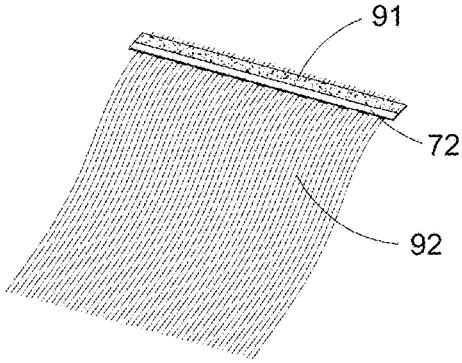

As shown in FIG. 24D, glue brushing and drying: Use a polycarbonate glue or polyurethane glue, an adhesive, and a diluent or thinner to mix in proportion to obtain the glue material for making the second weft edge 93.

Apply the glue material to the second hair strand 92 above the second masking tape 72 and use a scraper to scrape repeatedly to make the glue material contact with the second hair strand 92 evenly and fix it. After finishing, put it in the drying box for drying at a temperature of 50-55° C. for 10-15 minutes.

Take out the second hair weft material 900 and continue to apply the second coat of the glue material. After finishing, as shown in FIG. 24E, add a layer of mesh yarn 94 on the glue surface and scrape it with a scraper to make the mesh yarn 94 flat and put the second hair weft material 900 into the drying box for drying at a temperature of 50-55° C. for 60 minutes.

Figure 24F:
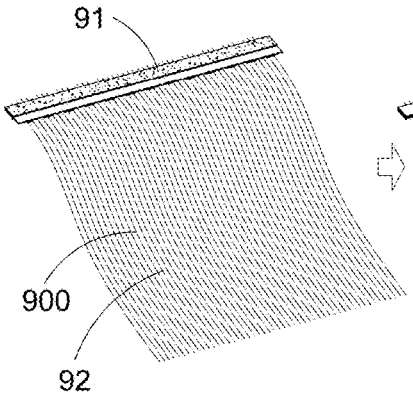

As shown in FIGS. 24F, take out the second hair weft material 900, apply the first coat of the glue material on the side without the mesh yarn 94, and then put the second hair weft material 900 into the drying box for drying at 50-55° C. for 30 minutes.

Take out the second hair weft material 900, apply a second coat of the glue material on the side without the mesh yarn 94, and put the second hair weft material 900 into the drying box for drying at a temperature of 50-55° C. for 240 minutes.

Figure 24G:
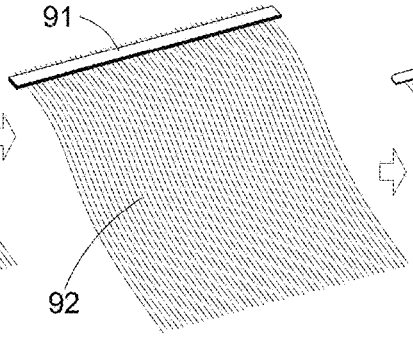
Figure 24H:
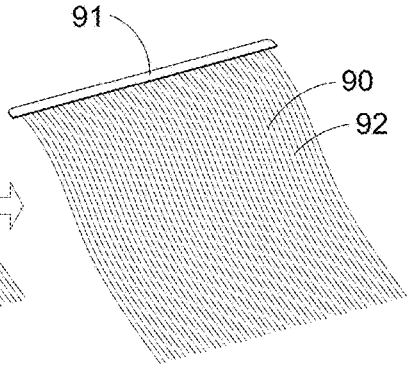
Figure 25A:
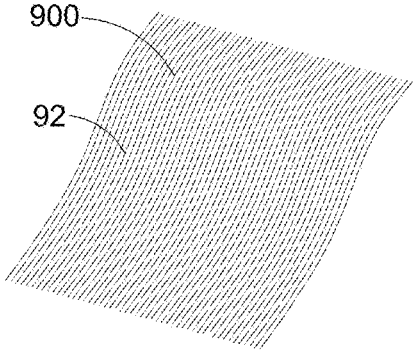
FIGS. 25A, 25B, 25C, 25D, 25E, 25F and 25G are schematic views illustrating the preparing of the second hair weft unit of the hair weft according to an alternative mode of the above preferred embodiment of the present invention.
Figure 25B:
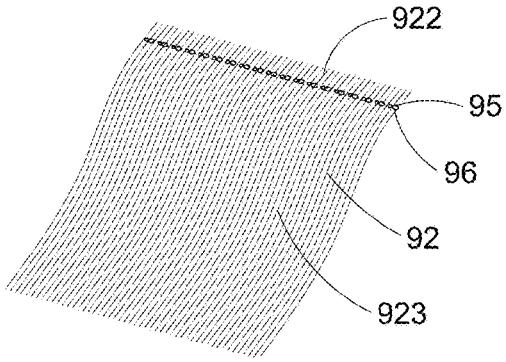
Figure 25D:
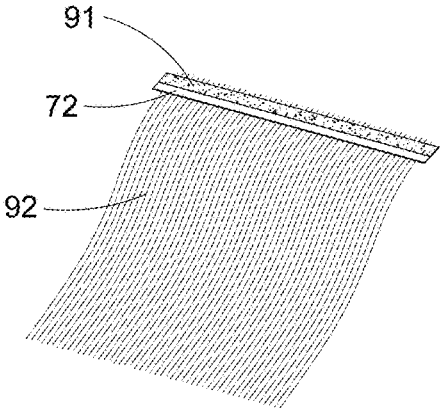
Figure 25C:
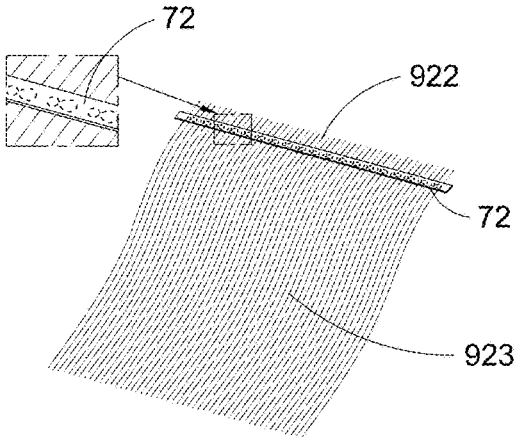
Figure 25E:
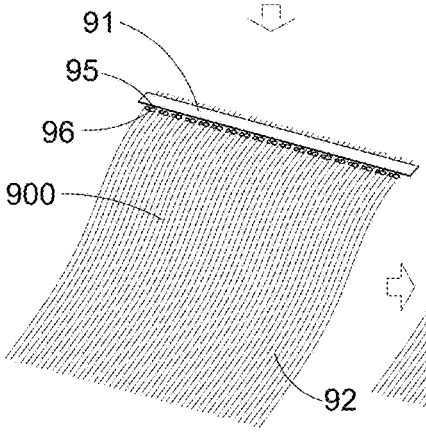
Figure 25F:
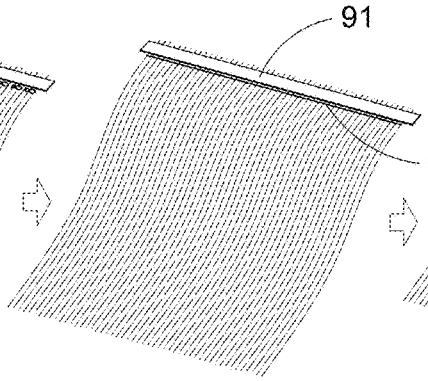
Figure 25G:
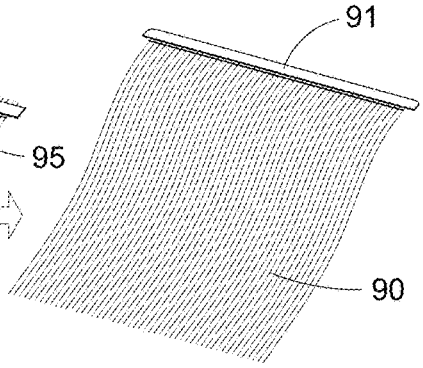
Figure 26:
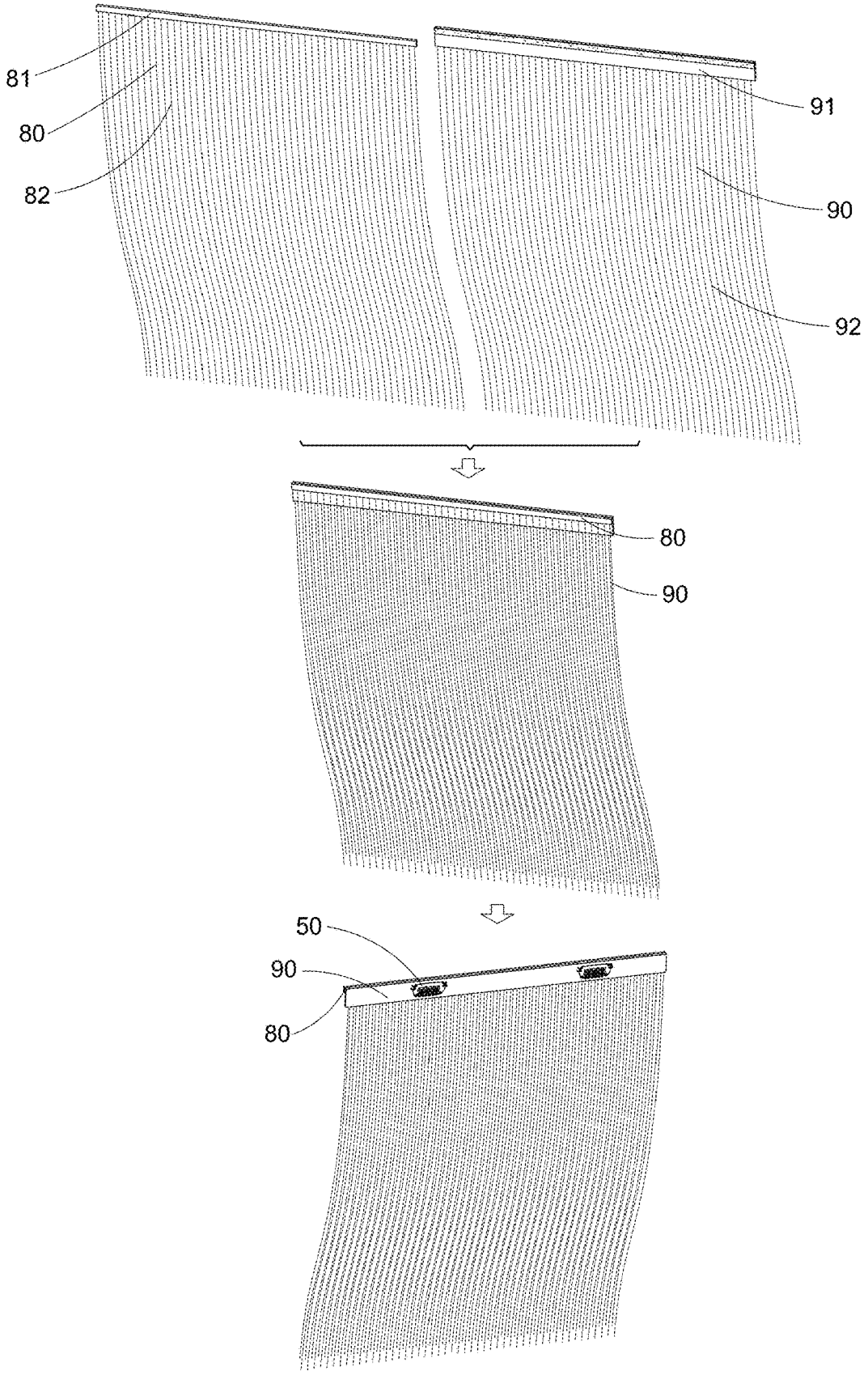
FIG. 26 is a schematic view illustrating the bonding of the two hair weft units of the hair weft according to the above preferred embodiment of the present invention.

Take out the second hair weft material 900, use the second masking tape 72 to stick out the weft edge height range of 0.8 to 1 cm, and then, as shown in FIGS. 24G to 24H, cut the excess weft edge to obtain the second hair weft unit 90.

Figure 28:
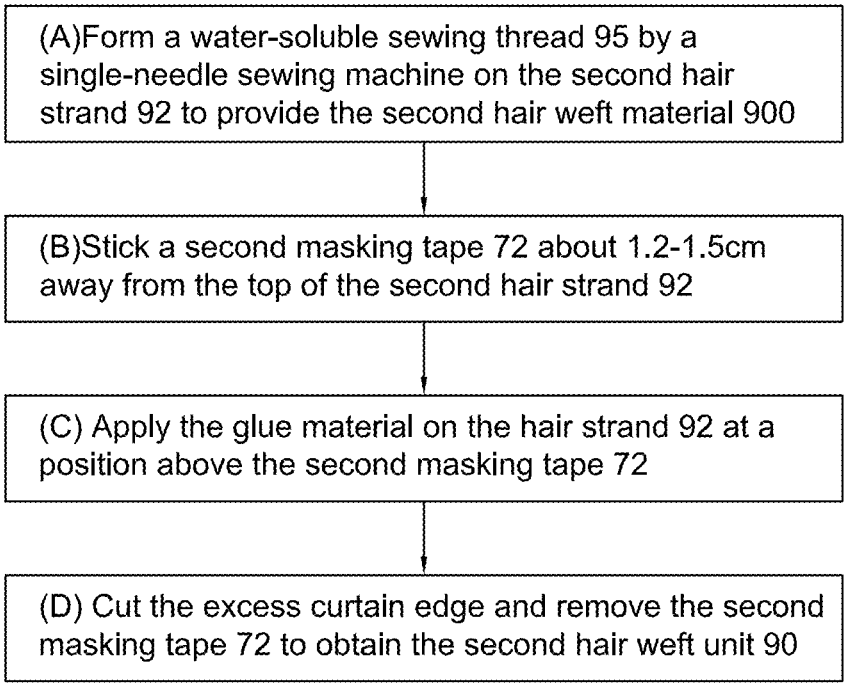
FIG. 28 is a flowchart of a preparation process of the second hair weft unit of the hair weft according to the above preferred embodiment of the present invention.
Figure 29A:
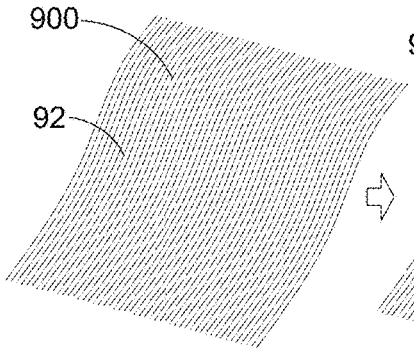
FIGS. 29A, 29B, 29C, 29D, 29E, 29F and 29G are schematic views illustrating the preparing of the second hair weft unit of the hair weft according to another alternative mode of the above preferred embodiment of the present invention.
Figure 29B:
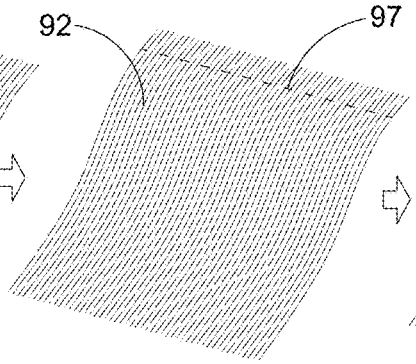
Figure 29C:
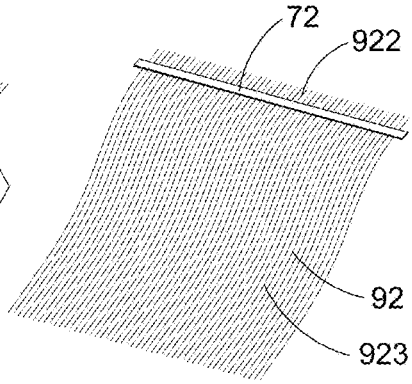
Figure 29D:
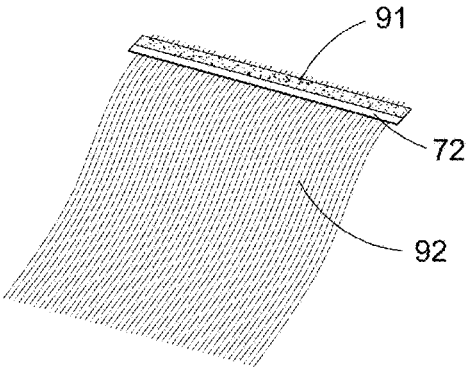
Figure 29E:
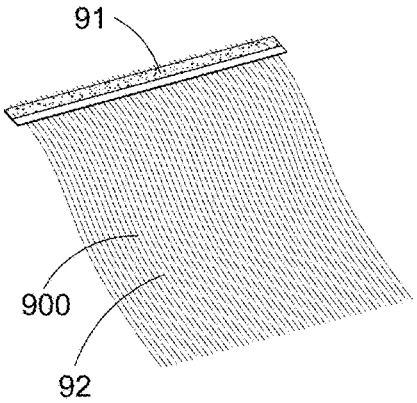
Figure 29F:
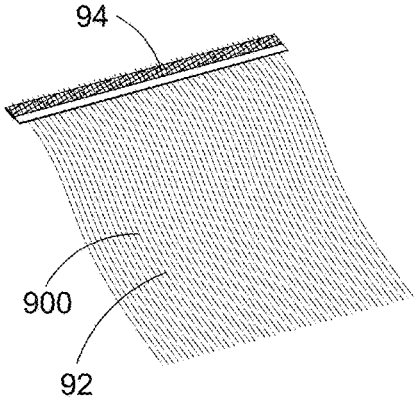
Figure 29G:
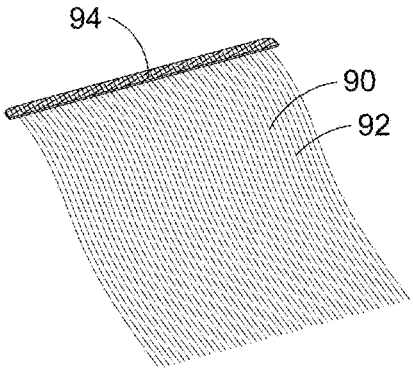
Figure 30:
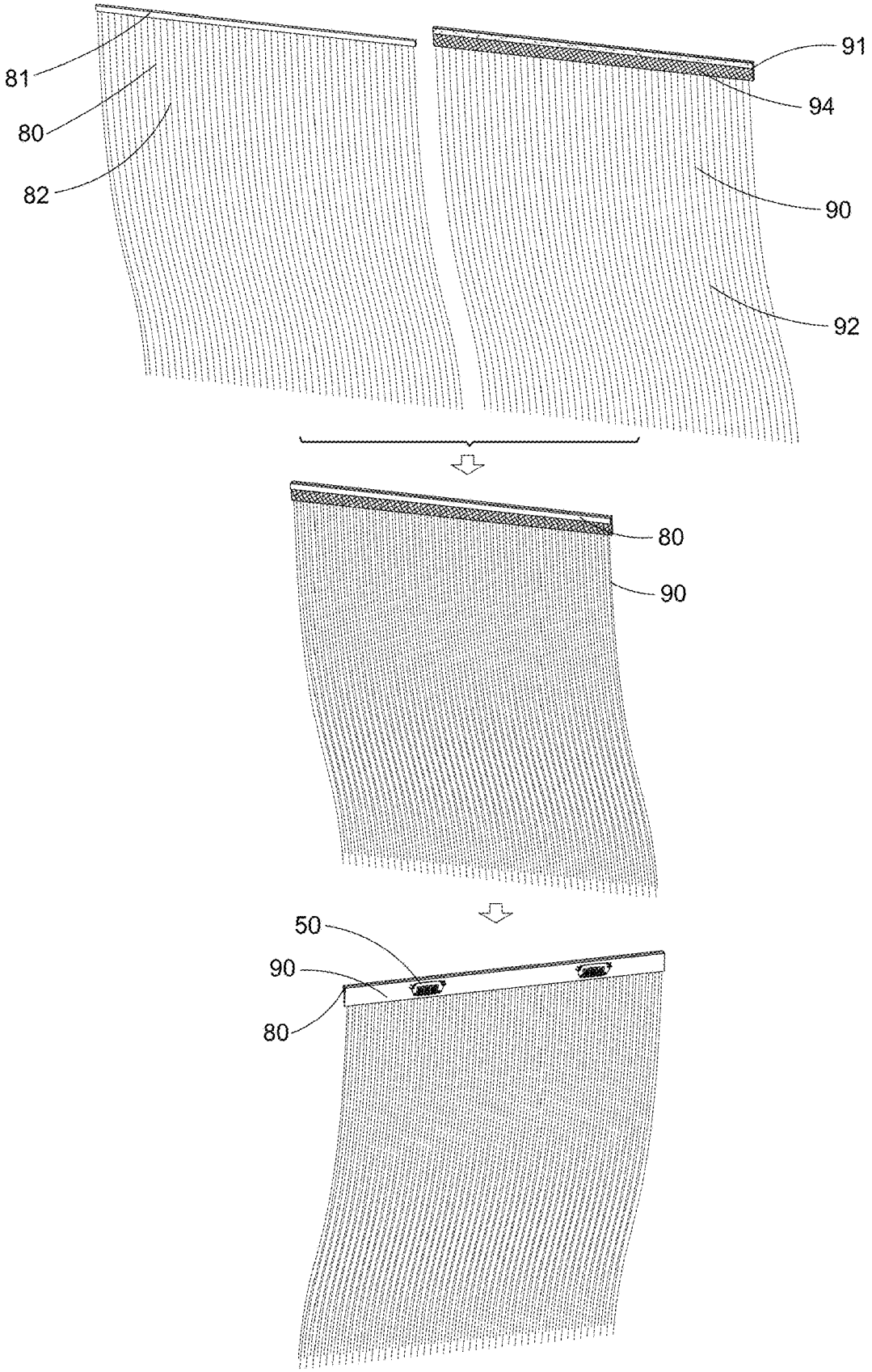
FIG. 30 is a schematic view illustrating the bonding of the two hair weft units of the hair weft according to the another alternative mode of the above preferred embodiment of the present invention.
Figure 31:
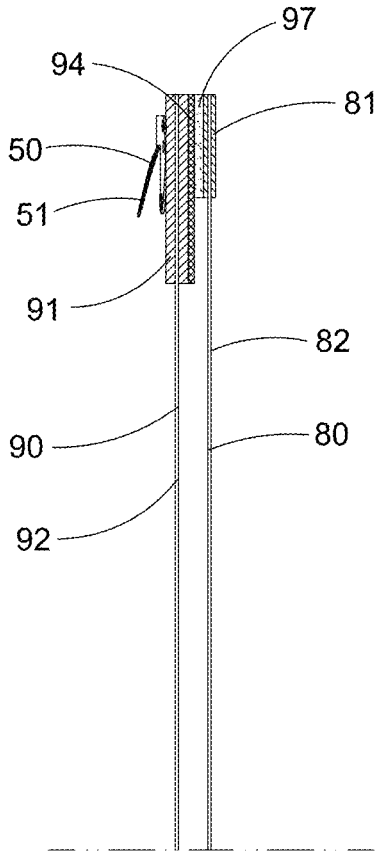
FIG. 31 is a sectional view of the hair weft according to the another alternative mode of the above preferred embodiment of the present invention.
Figure 32:
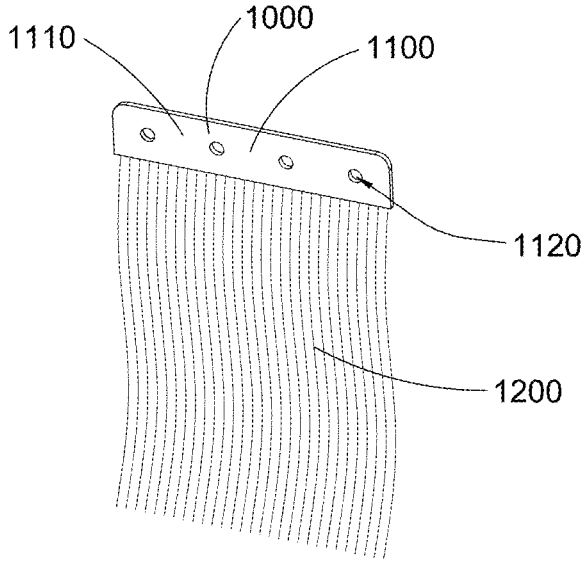
FIG. 32 is a perspective view of a hair extension according to a first preferred embodiment of the present invention.
Figure 33:
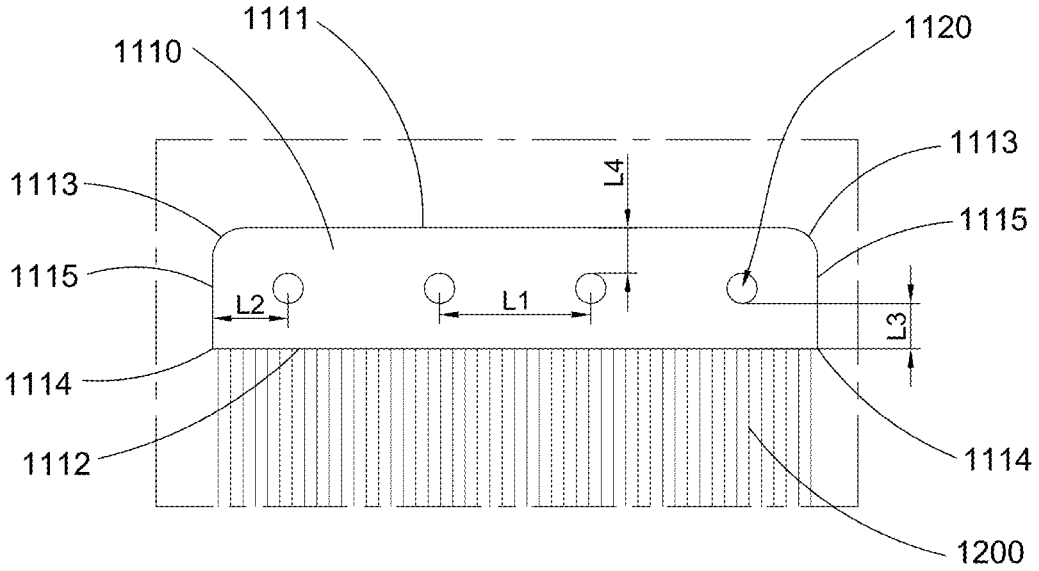
FIG. 33 is a partial enlarged view of the hair extension according to the above first preferred embodiment of the present invention.
Figure 34:
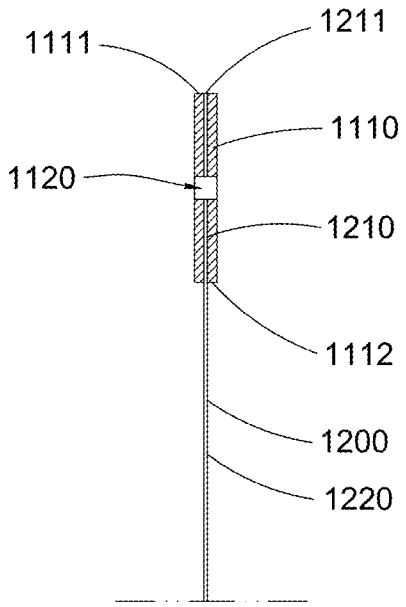
FIG. 34 is a sectional view of the hair extension according to the above first preferred embodiment of the present invention.
Figure 35A:
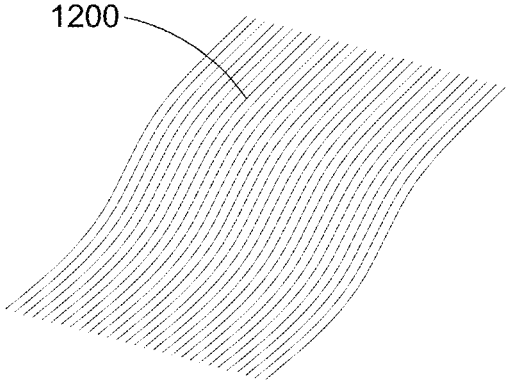
FIGS. 35A, 35B, 35C and 35D are schematic views illustrating the manufacturing process of the hair extension according to the above first preferred embodiment of the present invention.
Figure 35B:
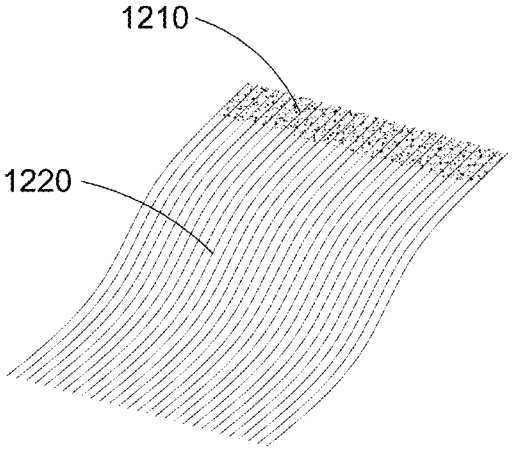
Figure 35D:
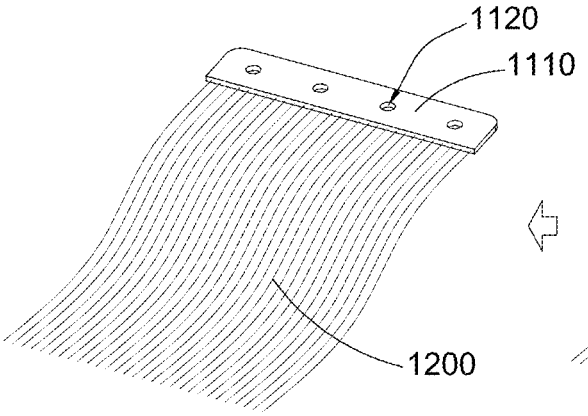
Figure 35C:
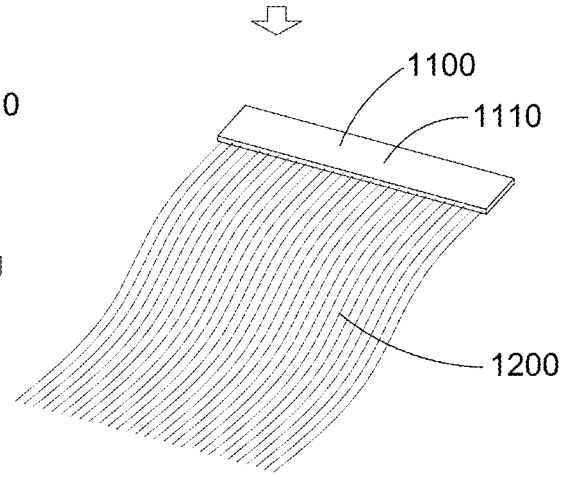

Accordingly, referring to FIG. 28, the step of preparing the second hair weft unit 90 comprises the following steps.

(A) Form the water-soluble sewing thread 95 by a single-needle sewing machine on the second hair strand 92 to provide the second hair weft material 900.

(B) Stick a second masking tape 72 about 1.2-1.5 cm away from the top of the second hair strand 92.

(C) Apply the glue material on the hair strand 92 at a position above the second masking tape 72.

(D) Cut the excess weft edge and remove the second masking tape 72 to obtain the second hair weft unit 90.

The step of preparing the second hair weft unit 90 may further comprise a step of attaching the mesh yarn 94 on the glue material on the second hair weft material 900. Preferably, when the mesh yarn 94 is attached to the second hair weft material 900, the other side of the second hair weft material 900 is applied with the glue material one or more times.

Alternatively, as shown in FIG. 25A to FIG. 25G of the drawings, a double-needle sewing machine is used to run a water-soluble sewing thread 95 and a cotton sewing thread 96 about 4 to 5 cm away from the top of the second hair strand 92 to fix the second hair elements 92 to obtain the second hair weft material 900 and prevent the second hair elements 92 from spreading during production. The two intersecting stitching lines, the water-soluble sewing thread 95 and the cotton sewing thread 96, can be arranged in an "8" pattern. In this alternative mode, the mesh yarn 94 may be omitted.

In the step of bonding the first hair weft unit 80 with the second hair weft unit 90, the top edges of the two hair weft units 80 and 90 are aligned, and the first weft edge 83 which has a smaller length is attached to the second weft edge 93 which has a larger length by a glue.

The preparing method may further comprise a step of soaking the hair weft. More specifically, the hair weft prepared by the first hair weft unit 80 and the second hair weft unit 90 is put in a softener. Since the second stitching line 842 and the water-soluble sewing thread 95 are water-soluble sewing thread, s the second stitching line 842 and the water-soluble sewing thread 95 will dissolve and disappear when the hair weft is soaked.

More specifically, in the soaking step of the hair weft, put 100 g of finished hair weft into 1 kg of 40° C. water, add 2-3 g of sodium hypochlorite solution, and soak for 5 minutes;

After soaking, wash three times with 40° C. water;

After cleaning, put the finished hair weft in 1 kg of 50° C. water, add 30 g of softener, and soak for 10 minutes;

After soaking, put the finished hair weft in 1 kg of 50° C. clean water, add 40 g of softener, and soak for 10 minutes.

After soaking, the hair weft can be put into a centrifuge for dehydration and drying, a dense-tooth comb can be used to comb the hair weft to scrape off the floating hair on the product, then the hair weft can be put into water to moisten it slightly, spread it flat on an iron plate, use a brush to scrape off excess water, and put the hair weft into a drying room at 50° C. for drying.

Further, the preparation method may further comprise a step of ironing and combing the hair weft, stacking the hair weft, and bundling and packaging for transportation Referring to FIGS. 29A to 31 of the drawings, a hair weft according another alternative mode of the above preferred embodiment of the present invention is illustrated, in this embodiment, the hair weft comprises the first hair weft unit 80, the second hair weft unit 90 attached to the first hair weft unit 80 and the attaching unit 50 attached to the second hair weft unit 90.

In this embodiment, the mesh yarn 94 is integrated with the second glue base 91 and is located between the first glue base 81 and the second root portion 922 of the second hair strand 92. The mesh yarn 94 is attached to the first glue base 81 by a binding glue layer 97, so as to be hidden within the first glue base 81 and the second glue base 91. The binding glue layer 97 contains one or more of epoxy resin, polyurethane, acrylic resin adhesive, phenolic resin adhesive, polyester resin adhesive, and neoprene adhesive.

Similar to the above embodiment, the attaching unit 50 can be embodied to comprise a clipping element 51 which is used for clipping the hair weft on the hair of the user. The clipping element 51 comprises a fixing base 511 and a clipping member 512 movably coupled to the fixing base 511, so as to define a clipping groove 513 for clipping the hair of the user.

The fixing base 511 has a plurality of fixing holes 5111, the clipping element 51 further comprises a plurality of connecting strings 514 which are penetrating through the first glue base 81 and the second glue base 91, as well as the corresponding fixing holes 5111 for connecting the fixing base 511 to the first hair weft unit 80 and the second hair weft unit 90.

The clipping element 51 is thus attached to the rear side of the second glue base 91 of the second hair weft unit 90 which is a side away from the first hair weft unit 80. Unlike the double-side tape 52, the clipping element 51 is not able to completely cover the second weft unit 90, but the mesh yarn 94 is not exposed, the second glue base 91 is actually exposed. This eliminates visible seams or netting and creates a smooth, clean finish that enhances the natural appearance of the hair weft. Encapsulating the mesh yarn 94 protects it from external friction, moisture, or damage, which contributes to the longevity and structural integrity of the hair weft.

In addition, when the product of the hair weft is not provided with the attaching unit 50, the mesh yarn 94 is also preferred to be located between the first glue base 81 and the second root portion 922 of the second hair strand 92. In other words, the mesh yarn 94 is located at a side of the second weft unit 90 facing toward the first weft unit 80.

Referring to FIGS. 32 to 37F of the drawings, a hair extension according to a first embodiment of the present invention is illustrated, the hair extension 1000 comprises a hair base 1100 and a plurality of hair members 1200 which is fixed to the hair base 1100. The hair base 1100 in this embodiment comprises a glue base 1110 which has one or more openings 1120 for natural hair of the user to pass through, so as to allow the hair extension 1000 to be worn on the user.

The hair extension 1000 can be embodied as the above mentioned second hair weft units 40 and 90 which are further provided with the openings 1120. The second hair weft units 40 and 90 which are respectively provided with the openings 1120 in the attaching base 41 and the second glue base 91 can be directly worn on the user without the first hair weft units 30 and 80.

Each of the hair members 1200 comprises a root part 1210 and a hair body part 1220 integrally extended from the root part 1210. The root part 1210 is embedded into the glue base 1110 to form an edge portion for attaching to the natural hair of the user. The root part 1210 has an end edge 1211 which is embedded in the glue base 1110, the end edge 1211 is located above the openings 1120. The glue base 1110 has a top edge 1111 and a bottom edge 1112, each opening 1120 is located at a position between the top edge 1111 and the bottom edge 1112 of the glue base 1110. Multiple root parts 1210 are located between two adjacent openings 1120. A distance L1 between two adjacent openings 1120 is 0.1-20 mm, a distance L2 between a side edge 1115 of the glue base 1110 and the opening 1120 adjacent to the side edge 1115 is 0.1-10 mm, a distance L3 between the opening 1120 and the bottom edge 1112 of the glue base 1110 is 0.1-10 mm, preferably, 0.5-4 mm, so as to prevent the root part 1210 at a position under the corresponding opening 1120 to be detached from the glue base 1110. A distance L4 between the opening 1120 and the top edge 1111 of the glue base 1110 is 0.1-10 mm. The opening 1120 can be configured to have any shape, such as triangle, square, rectangular, circular, and oval. In this embodiment, each opening 1120 is shown have a circular shape and a diameter of the opening 1120 is 0.1-3.5 mm.

The glue base 1110 has two upper side corner edges 1113 each is a curved edge, preferred an arc edge. The glue base 1110 has two lower side corner edges 1114 each is an orthogonal edge. The arc-shaped upper side corner edges 1113 contribute to a smoother transition between the upper boundary of the glue base and the user's scalp or surrounding hair. This curved contour reduces the risk of irritation or pressure points, especially when the extension is worn for extended periods. The rounded design of the upper corners also offers aesthetic benefits, as it more naturally mimics the contours of the scalp or hairline, making the hair extension less detectable and more realistic in appearance.

The orthogonal lower side corner edges 1114 provide a stable base geometry at the lower portion of the glue base. These right-angled edges enhance the structural alignment and adherence of the glue base to the user's head, ensuring secure placement and minimizing unintended lifting or curling of the base during wear.

In addition, when the hair extension 1000 is cut from an integral hair extension material, the formation of the right-angled lower side corner edges 1114 serves a structural function. Specifically, the orthogonal cutting used to generate these right-angled edges ensures that the root parts 1210 of the hair members 1200 are preserved and not severed during the cutting process. The right-angled geometry provides a precise and protective cutting boundary, allowing the hair extension 1000 to be trimmed or segmented without encroaching on the embedded root parts 1210. This protects the integrity and bonding strength of the hair members 1200, which rely on their root parts being securely embedded in the glue base 1110 for durability and wear resistance. Preventing damage to the root parts 1210 during cutting maintains the structural cohesion of the hair extension 1000, ensuring that the hair members 1200 remain securely anchored and do not loosen or fall out during use The material of the hair members 1200 can be but not limited to real human hair, synthetic fiber, blended materials and animal hair. The hair members 1200 made from real human hair can offer the most natural look and feel, and can be styled, dyed, and treated like natural hair. Artificial fibers, such as heat-resistant or low-temperature fibers, can be used for preparing the hair members 1200 as then may not look as natural as human hair. The blended materials combine human hair with synthetic fibers to provide a balance between natural appearance and affordability. This mix aims to offer both the realistic look of human hair and the durability of synthetic fibers. The hair members 1200 also may be made from hair of animals like horses or yak, so as to offer a natural texture.

The glue base 1110 can be formed by a glue material which comprises a polyurethane glue, such as a mixture of polyurethane glue, adhesive, and thinner or diluent. Preferably, a weight content of polyurethane glue is ranged from 40%-60%, a weight content of adhesive is ranged from 10%-30%, and a weight content of thinner is ranged from 20%-40%.

Figure 38:
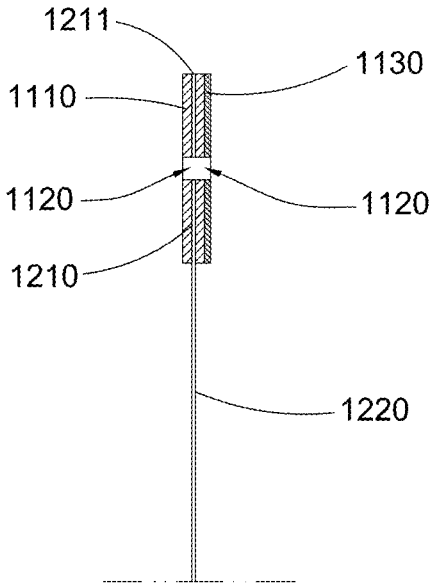
FIG. 38 is a sectional view of a hair extension according to a first alternative mode of above first preferred embodiment of the present invention.
Figure 39A:
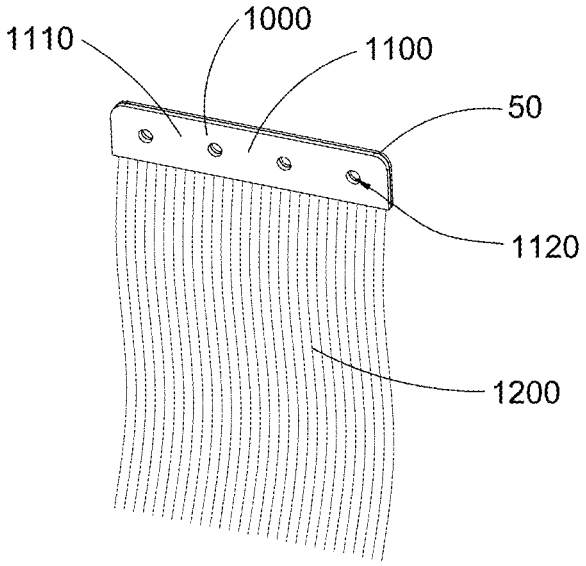
FIG. 39A is a perspective view of a hair extension according to a second alternative mode of above first preferred embodiment of the present invention.
Figure 39B:
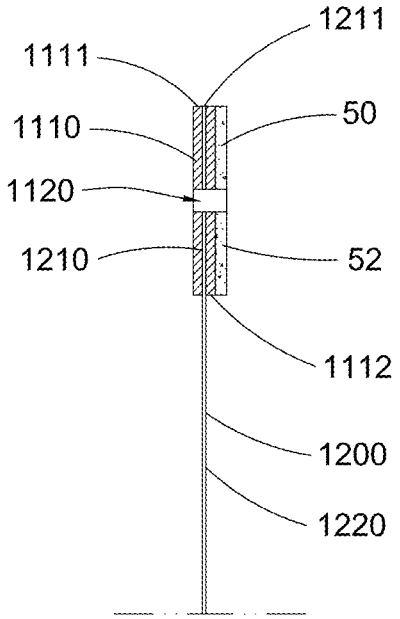
FIG. 39B is a sectional view of the hair extension according to the second alternative mode of above preferred embodiment of the present invention.
Figure 40A:
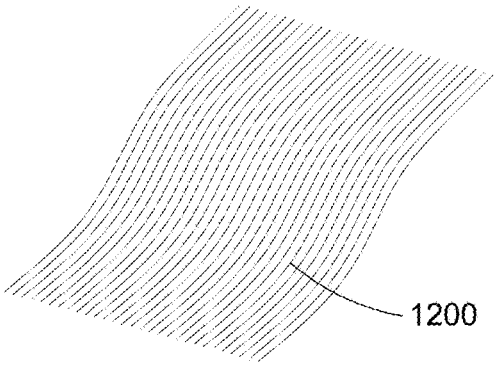
FIGS. 40A, 40B, 40C, 40D and 40E are schematic views illustrating the manufacturing process of the hair extension according to the second alternative mode of the above first preferred embodiment of the present invention.
Figure 40B:
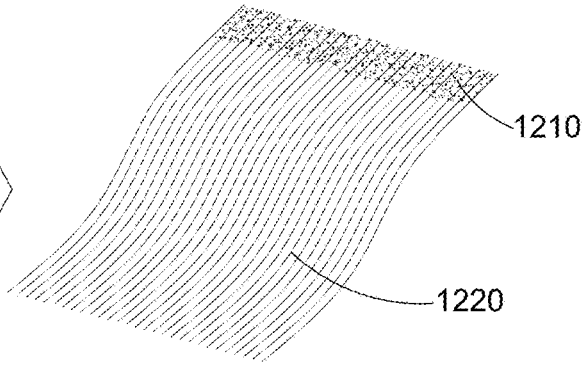
Figure 40C:
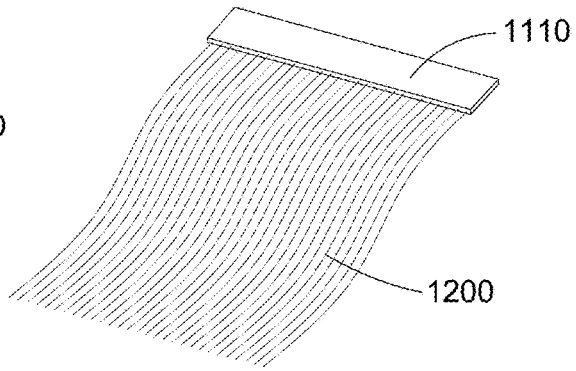
Figure 40D:
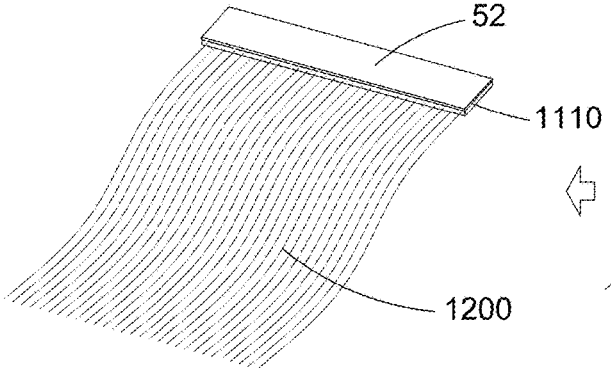
Figure 40E:
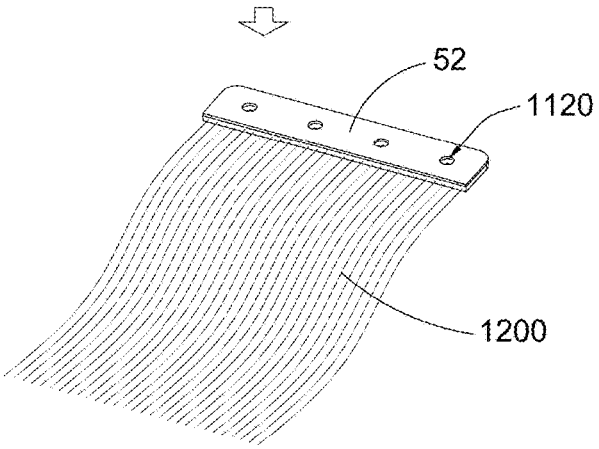

In this embodiment, a row of openings 1120 is formed in the glue base 1110 and each opening 1120 is penetrating through a thickness of the glue base 1110. As shown in FIG. 38 of the drawings, the hair base 1100 may further comprise a mesh yarn 1130 attached to the glue base 1110.

As shown in FIGS. 39A to 40E of the drawings, an attaching unit 50 which is attached to the glue base 1110. The attaching unit 50 may be embodied as a double-sided binding tape 52. One side of the double-sided binding tape 52 is attached to the glue base 1110, the other side of the double-sided binding tape 52 is used for adhering the natural hair of the user during usage. Each opening 1120 is penetrating through the glue base 1110 and the double-sided binding tape 52.

Figure 41:
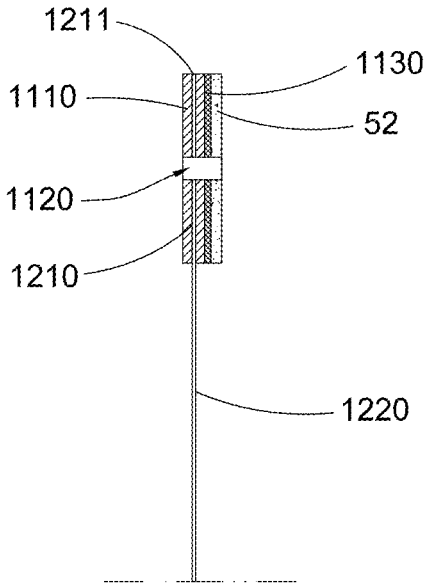
FIG. 41 is a sectional view of a hair extension according to a third alternative mode of above first preferred embodiment of the present invention.
Figure 42A:
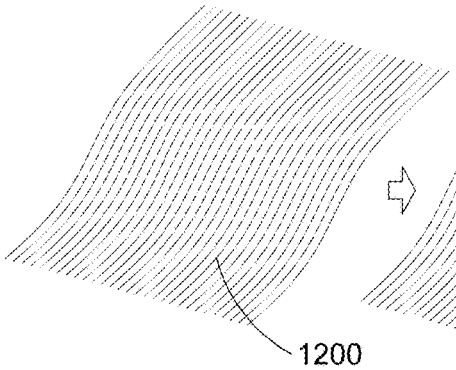
FIGS. 42A, 42B, 42C, 42D, 42E, 42F and 42G are schematic views illustrating the manufacturing process of the hair extension according to the third alternative mode of the above first preferred embodiment of the present invention.
Figure 42B:
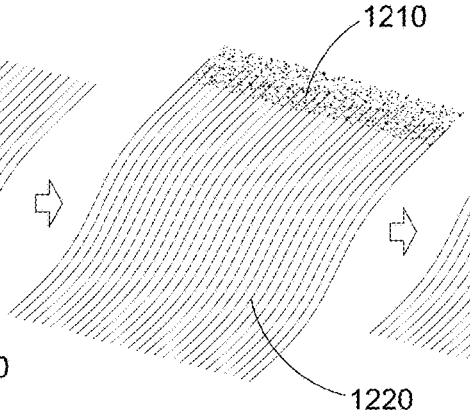
Figure 42C:
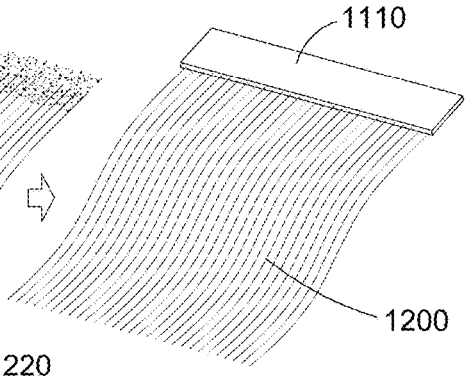
Figure 42D:
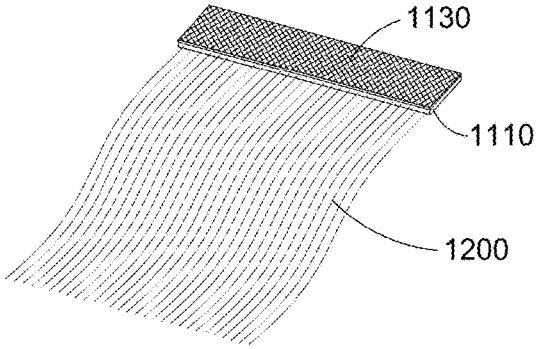
Figure 42E:
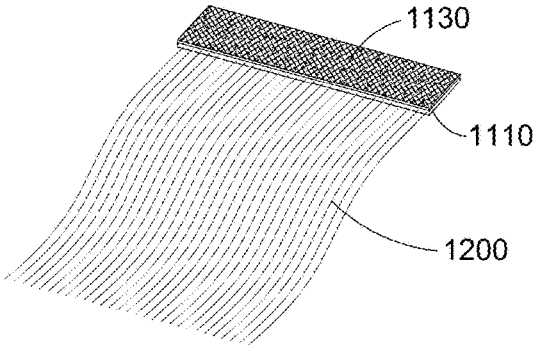
Figure 42F:
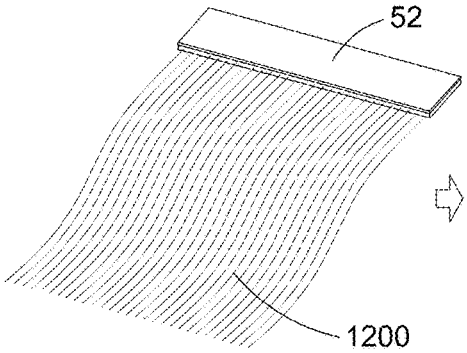
Figure 42G:
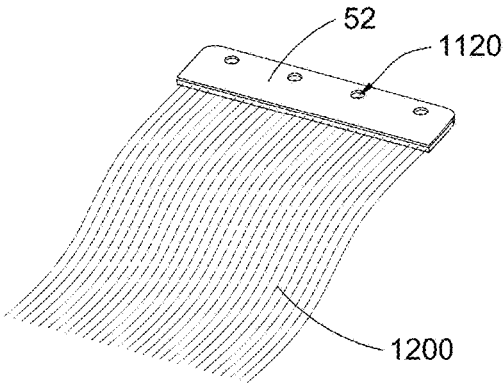

As shown in FIGS. 41 to 42G of the drawings, the hair base 1100 may further comprise a mesh yarn 1130 which is integrated with the glue base 1110, each opening 1120 is penetrating through the glue base 1110 and the mesh yarn 1130. The mesh yarn 1130 provides a supportive framework that adds structural integrity to the hair base 1100. The mesh yarn 1130 can be positioned on one side of the glue base 1110 adjacent to the scalp when the hair weft is worn on the wearer, allowing the hair members 1200 to be securely fixed while also enabling flexibility. The mesh yarn 1130 adds additional support, ensuring that the hair members 1200 remain securely in place. This stability is essential for maintaining the overall shape of the hair extension 1000 and preventing any sagging or displacement.

The mesh yarn 1130 is a type of yarn with a grid-like or netted structure, typically formed into an open, porous configuration. It is commonly made from polyester fibers or other synthetic fibers such as nylon or polypropylene. Due to its structural properties, the mesh yarn 1130 offers both flexibility and mechanical strength. As shown in FIG. 41 of the drawings, the mesh yarn 1130 can be positioned between the double-sided binding tape 52 and the glue base 1110, each opening 1120 is penetrating through the double-sided binding tape 52, the glue base 1110 and the mesh yarn 1130. The mesh yarn 1130 on the glue base 1110 increases surface roughness, which enhances the friction between the mesh yarn 1130 and the inner adhesive side of the double-sided binding tape 52. This results in a stronger bond, reducing the risk of the double-sided binding tape 52 detaching from the glue base 1110 during wear. A firmer attachment between the double-sided binding tape 52 and the glue base 1110 leads to greater overall stability once the hair extension 1000 is affixed to the user's head. This minimizes shifting or lifting, even during physical activities or in humid conditions. The double-sided binding tape 52 can be shaped and sized to cover the mesh yarn 1130, so that the mesh yarn 1130 is hidden by the double-sided binding tape 52.

Alternatively, the mesh yarn 1130 also may be attached on a side of the glue base 1110 at a side that is away from the scalp of the user. When the hair extension 1000 is worn on the user, the natural hair of the user can be covered on the mesh yarn 1130 and the glue base 1110 to hide the mesh yarn 1130.

Figure 43A:
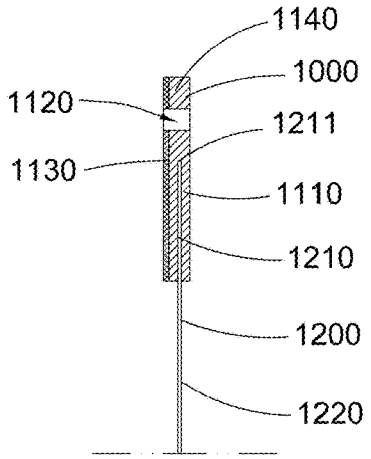
FIG. 43A is a sectional view of a hair extension according to a fourth alternative mode of above first preferred embodiment of the present invention.

Referring to FIG. 43A of the drawings, as another alternative mode of the above embodiment, the hair base 1100 further comprises an opening base 1140 which is integrally extended from the glue base 1110, the one or more openings 1120 are formed in the opening base 1140, but not in the glue base 1110. A mesh yarn 1130 may also integrated with the opening base 1140 and the glue base 1110. In this embodiment, unlike the above embodiment in which the formation of the opening 1120 may cause the cut off of the portion of the root part 1210 of the hair members 1200 at the position corresponding to the opening 1120. The opening base 1140 is not embedded with any of the hair members 1200.

Each opening 1120 is located at a position above the end edge 1211 of the root part 1210 of each hair member 1200, so that the opening 1120 will not cause the portion of any root part 1210 of each hair member 1200 to be cut off.

In the step of preparing the hair extension 1000, a single-needle sewing machine may be used to run a water-soluble sewing thread about 4 to 5 cm away from the top of the hair members 1200 to fix the hair members 1200 to obtain a hair extension material and prevent the hair members 1200 from spreading during production.

And then, stick a masking tape about 1.2-1.5 cm away from the top of the hair members 1200, so that the masking tape covers the hair to prevent the glue from penetrating into the bottom of the hair members 1200 during the subsequent gluing step, and play a shaping role.

Use a polycarbonate glue or polyurethane glue, an adhesive, and a diluent or thinner to mix in proportion to obtain the glue material for making the glue base 1110.

Apply the glue material to the hair members 1200 above the masking tape and use a scraper to scrape repeatedly to make the glue material contact with the hair members 1200 evenly and fix it. After finishing, put it in the drying box for drying at a temperature of 50-55° C. for 10-15 minutes.

A layer of mesh yarn 1130 may be further applied on the glue surface and scrape it with a scraper to make the mesh yarn 1130 flat and put the hair extension material into the drying box for drying at a temperature of 50-55° C. for 60 minutes. Then, the hair extension material can be taken out and applied with several coats of the glue material on the side without the mesh yarn 1103 and dried at 50-55° C. for 30 minutes.

After the glue base 1110 is formed, the hair members 1200 are fixed in the glue base 1110. Then, openings 1120 are formed in the glue base 1110 by an opening punching arrangement.

An additional mount of the glue material may be applied to the position above the end edges 1211 of the hair members 1200, so that the opening base 1140 can be formed above the end edges 1211 of the hair members 1200.

Figure 43B:
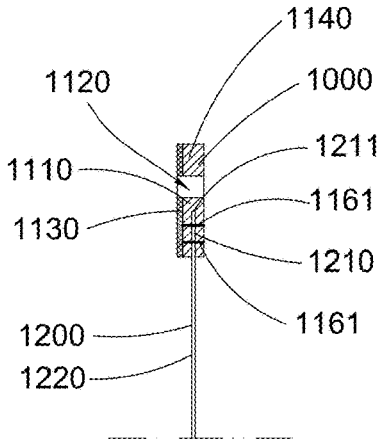
FIG. 43B is a sectional view of a hair extension according to a fifth alternative mode of above first preferred embodiment of the present invention

Referring to FIG. 43B of the drawings, as another alternative mode of the above embodiment, the hair extension 1000 comprises a hair base 1100 and a plurality of hair members 1200 which is fixed to the hair base 1100. The hair base 1100 in this embodiment comprises a glue base 1110 which has one or more openings 1120 for natural hair of the user to pass through, so as to allow the hair extension 1000 to be worn on the user. The glue base 1110 is further provided with a stitching means 1160 for fixing the hair members 1200.

The stitching means 1160 comprises one or more stitching lines 1161 for fixing the hair members 1200. As an example, the stitching means 1160 may comprise two stitching lines which are formed by cotton threads, the glue material of the glue base 1110 is applied on the stitching lines 1161. The glue material can be further applied to the position above the hair members 1200 and the stitching liens 1161 so as to form an opening base 1140 which is integrally extended from the glue base 1110.

In other words, the hair extension 1000 can be embodied as the above first hair weft unit 80 with the openings 1120. The manufacturing process of the hair extension 1000 is similar as the preparing method of the first hair weft unit 80 except that an additional step of forming the openings 1120 is required.

Figure 44:
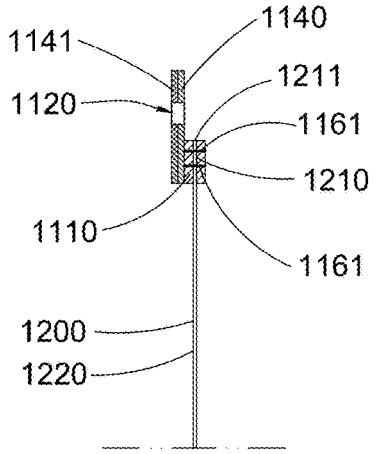
FIG. 44 is a sectional view of a hair extension according to a sixth alternative mode of above first preferred embodiment of the present invention.
Figure 45A:
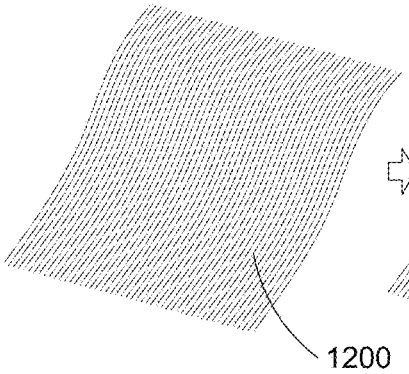
FIGS. 45A, 45B, 45C, 45D, 45E, 45F, 45G, 45H and 45I are schematic views illustrating the manufacturing process of the hair extension according to the sixth alternative mode of the above first preferred embodiment of the present invention.
Figure 45B:
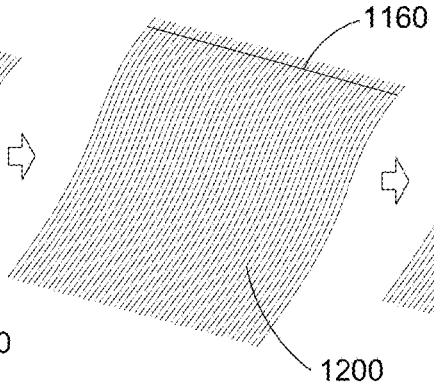
Figure 45C:
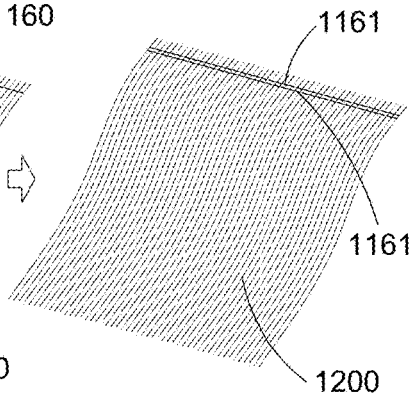
Figure 45F:
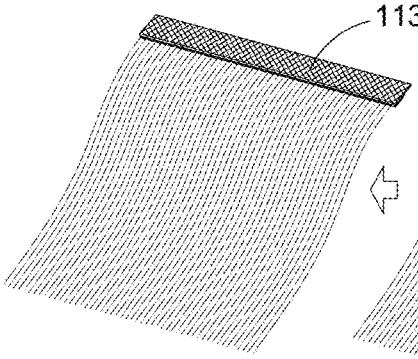
Figure 45E:
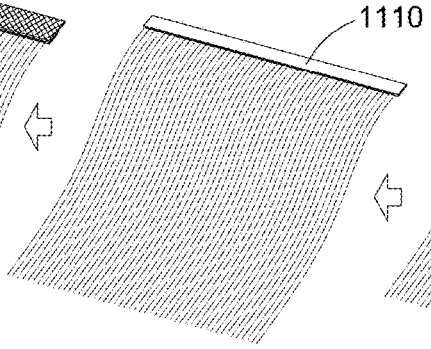
Figure 45D:
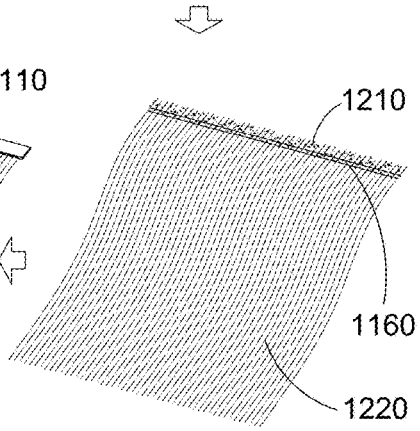
Figure 45G:
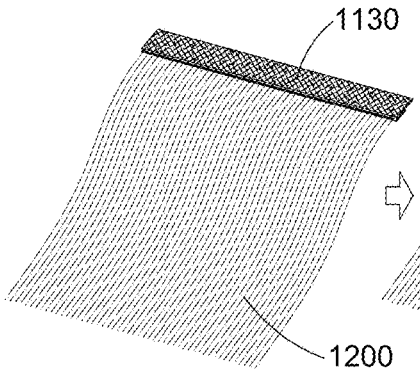
Figure 45H:
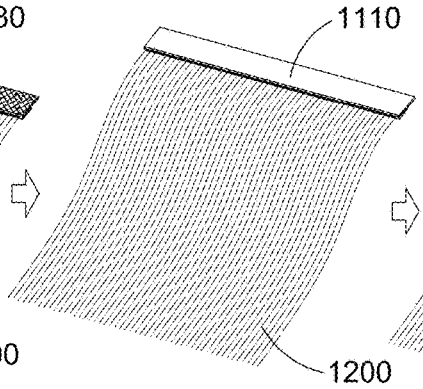
Figure 45I:
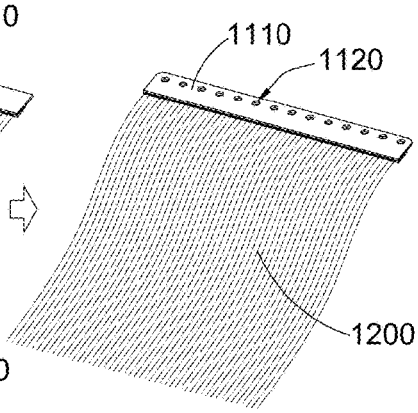

Referring to FIGS. 44 to 45I of the drawings, as another alternative mode of the above embodiment, the hair extension 1000 comprises a hair base 1100 and a plurality of hair members 1200 which is fixed to the hair base 1100. The hair base 1100 in this embodiment comprises a glue base 1110 and an opening base 1140 which has one or more openings 1120 for natural hair of the user to pass through, so as to allow the hair extension 1000 to be worn on the user. The glue base 1110 is further provided with a stitching means 1160 for fixing the hair members 1200.

In this embodiment, the opening base 1140 is not integrated with the glue base 1110, but can be an independent base that is attached to the glue base 1110 by a glue. The openings 1120 are formed in the opening base 1140, not the glue base 1110. The opening base 1140 may comprise a mesh layer 1141 which can be made of PU, fabric, netting or silk, and an adhesive applied on the mesh layer. A typical example of the adhesive is the PU adhesive.

Figure 46:
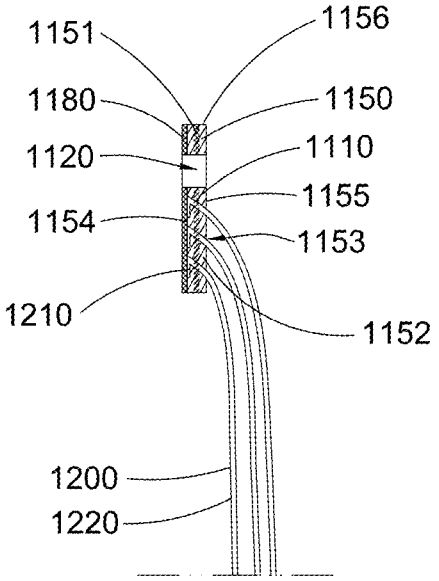
FIG. 46 is a sectional view of a hair extension according to a seventh alternative mode of above first preferred embodiment of the present invention.
Figure 47:
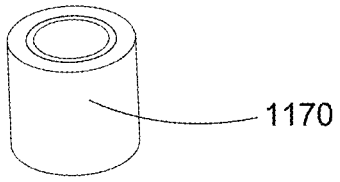
FIG. 47 is a perspective view of a mounting tube of the hair extension according to the above first preferred embodiment of the present invention.

Referring to FIG. 46 of the drawings, as another alternative mode of the above embodiment, the hair extension 1000 comprises a hair base 1100 and a plurality of hair members 1200 which is fixed to the hair base 1100. The hair base 1100 in this embodiment comprises a hair transplantation base 1150 which has one or more openings 1120 for natural hair of the user to pass through, so as to allow the hair extension 1000 to be worn on the user.

The hair transplantation base 1150 comprises a silk mesh 1151 and a glue layer 1152 applied to the silk mesh 1151, the glue material of the glue layer 1152 is filled into the mesh holes of the silk mesh 1151, so that the hair transplantation base 1150 is an integral rigid and smooth layer which is suitable for the hair transplantation process. The material of the silk mesh 1151 can be natural silk, synthetic silk, mesh or netting. The glue layer 1152 may comprise one or more of acrylic resin, epoxy resin, polyurethane, plasticizers such as phthalates, fillers such as calcium carbonate, and solvents such as ethyl acetate, ethanol, acetone. Alternatively, the hair transplantation base 1150 comprises a fabric layer or a textile layer and a glue layer applied to the fabric layer or the textile layer. The hair transplantation base 1150 may also be made of plastic material such as polyvinyl chloride and polyurethane.

The hair transplantation base 1150 has a plurality of hair transplantation holes 1153, one or more hair members 1200, such as four hair members 1200, are planted in the corresponding hair transplantation hole 1153.

Accordingly, in this embodiment, the hair members 1200 can be manually planted on the hair transplantation base 1150 or by a transplantation machine. The root part 1210 of each hair member 1200 is penetrating the thickness of the hair transplantation base 1150 and is fixed to a front surface 1154 of the hair transplantation base 1150 which is a side adjacent to the scalp of the user when the hair extension 1000 is worn on the user and the hair body part 1220 of each hair member 1200 is extended from a rear surface 1155 of the hair transplantation base 1150.

The hair extension 1000 in this embodiment can be embodied as the above first hair weft unit 30 with the openings 1120. The manufacturing process of the hair extension 1000 is similar as the preparing method of the first hair weft unit 30 except that an additional step of forming the openings 1120 is required.

As shown in FIG. 46 of the drawings, the openings 1120 can be formed between the hair members 1200 and a top edge 1156 of the hair transplantation base 1150, so that the formation of the openings 1120 will not result in the cut off of the hair members 1200. Alternatively, the openings 1120 may be formed at the transplantation area of the hair members 1200.

In addition, the hair base 1100 may further comprise a silk mesh layer 1180 attached to the front surface 1154 of the hair transplantation base 1150. The material of the silk mesh layer 1180 can be natural silk, synthetic silk, mesh or netting.

Figure 36A:
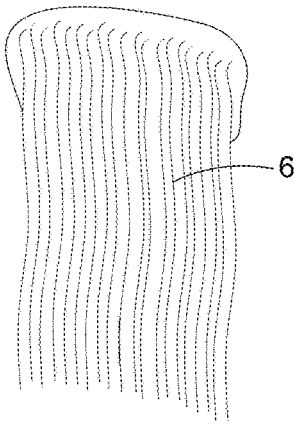
FIGS. 36A, 36B, 36C, 36D, 36E and 36F are schematic views illustrating a wearing manner of the hair extension according to the above first preferred embodiment of the present invention.
Figure 36B:
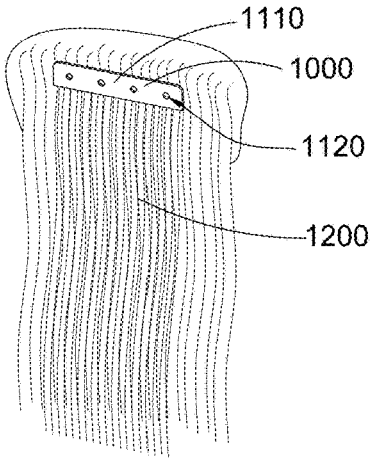
Figure 36D:
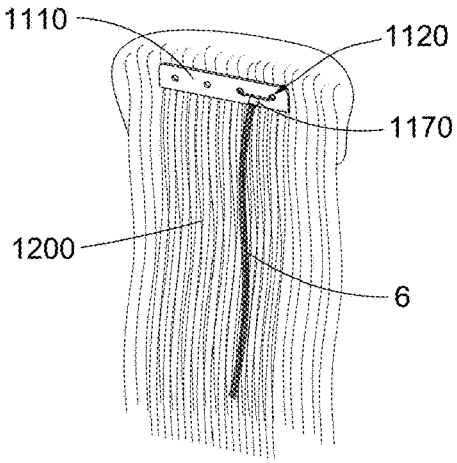
Figure 36C:
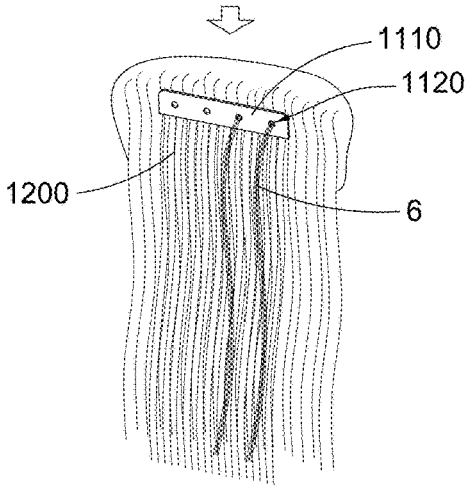
Figure 36E:
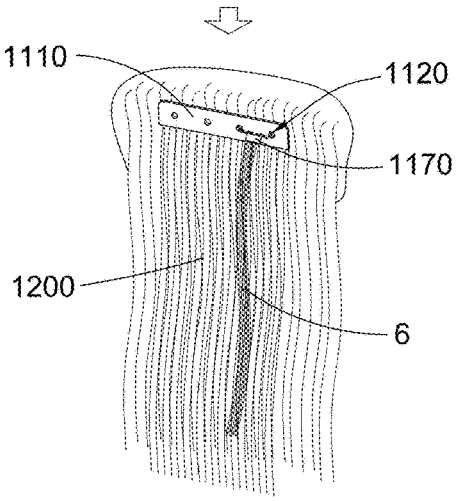
Figure 36F:
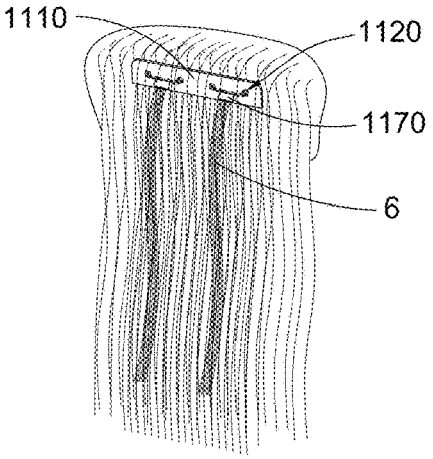
Figure 37A:
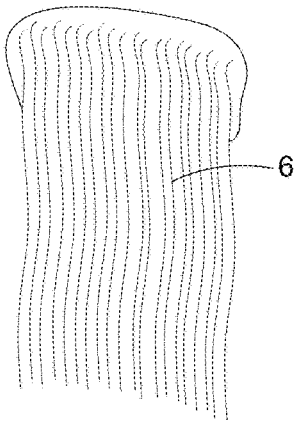
FIGS. 37A, 37B, 37C, 37D, 37E and 37F are schematic views illustrating another wearing manner of the hair extension according to the above first preferred embodiment of the present invention.
Figure 37B:
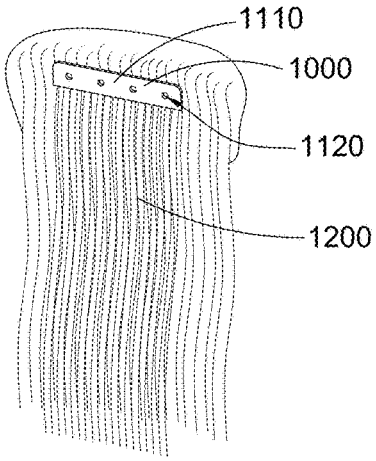
Figure 37C:
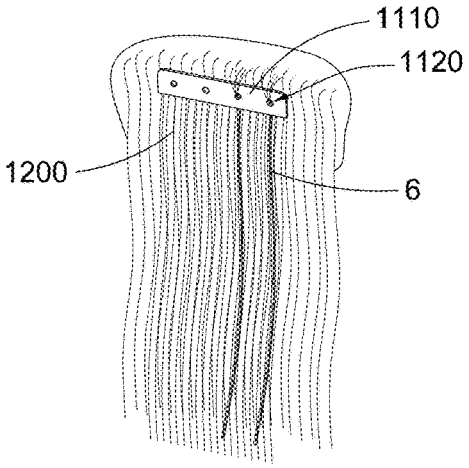
Figure 37D:
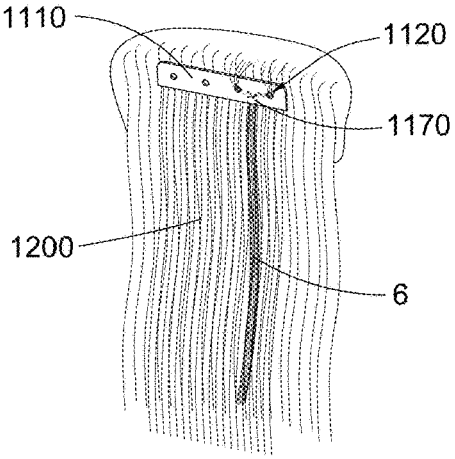
Figure 37E:
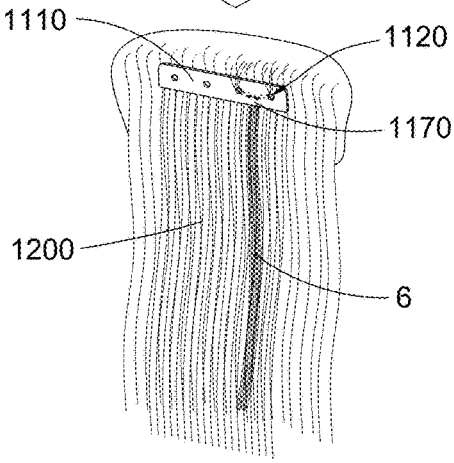
Figure 37F:
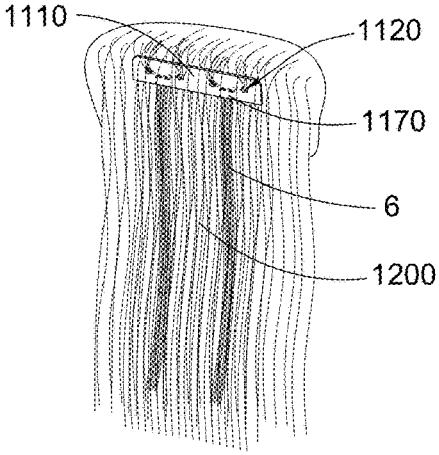

The hair extension 1000 further comprises one or more mounting tubes 1170. Referring to FIGS. 36A to 36F of the drawings, when wearing the hair extension 1000 on the head of the user, hair strands 6 of natural hair of the user can be guided by a hook device to pass through the openings 1120. As shown in FIGS. 36C to 36E, the hair strands 6 of natural hair of the user on the outer side of the hair extension 1000 is guided to pass through the openings 1120 from the front side of the hair extension 1000 adjacent to the scalp of the user to the rear side of the hair extension 1000, and then one or more hair strands 6 of natural hair of the user, such as two hair strands 6 of natural hair of the user is sleeved by one mounting tube 1170 which is position on the rear side of the glue base 1110 which is adjacent to the scalp of the user, so as to fix the hair extension 1000 to the natural hair of the user by the mounting tubes 1170. Each mounting tube 1170 can then be pressed by a clamping tool, so as to firmly fix the strands 6 of natural hair of the user. And then, as shown in FIG. 36F, a layer of the natural hair can be covered on the hair extension 1100 to cover the hair extension 1000, so that the mounting tubes 1170 are not visible.

As shown in FIGS. 37A to 37F, the hair strands 6 of natural hair of the user is guided to pass through the openings 1120 from the rear side of the hair extension 1000 to the front side of the hair extension 1000, and then one or more hair strands 6 of natural hair of the user, such as two hair strands 6 of natural hair of the user is sleeved by one mounting tube 1170, so as to fix the hair extension 1000 to the natural hair of the user by the mounting tubes 1170 which are positioned on the front side of the glue base 1110 adjacent the scalp of the user.

When the hair extension 1000 is provided with the double-sided binding tape 52, a protective surface layer of the double-sided binding tape 52 can be removed, and then the hair extension 1000 can be adhered to the natural hair of the user by the double-sided binding tape 52 before the above step of fixing the hair strands 6 of natural hair of the user through the openings 1120 and the mounting tubes 1170.

Figure 48:
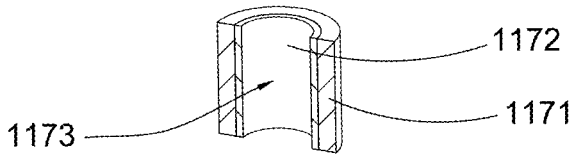
FIG. 48 is a schematic view of the mounting tube of the hair extension according to the above first preferred embodiment of the present invention.
Figure 49:
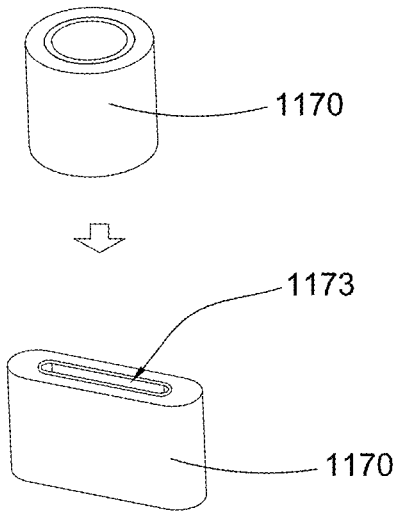
FIG. 49 is a schematic view illustrating the pressing of the mounting tube of the hair extension according to the above first preferred embodiment of the present invention.

Referring to FIGS. 47 to 52 of the drawings, each mounting tube 1170 can be preferred to comprise a tube body 1171 which is made of a flexible material such as aluminum and copper, an inner passage 1173 is defined in the tube body 1171. As shown in FIG. 49, each mounting tube 1170 can be pressed, so as to fix the hair stands 6 of natural hair of the user.

Figure 52:
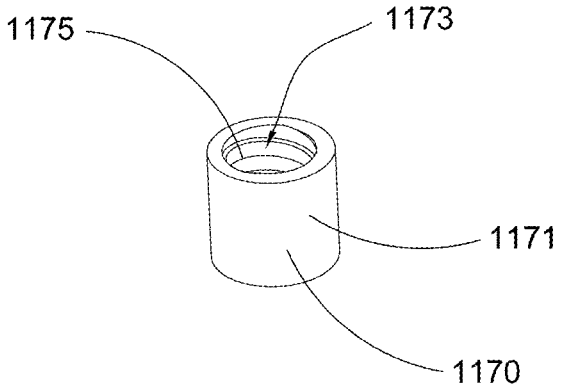
FIG. 52 is a perspective view of a second alternative mounting tube of the hair extension according to the above first preferred embodiment of the present invention.

In some embodiments, each mounting tube 1170 may comprises an inner flexible tube 1172 disposed in the tube body 1171 to define the inner passage 1173, as shown in FIG. 48, the inner flexible tube 1172 may be made of rubber or silicon, so as to act as a cushion between the metal and the natural hair to prevent hair damage during compression. Alternatively, as shown in FIG. 52, the tube body 1171 can be provided with inner threads 1175, so that the threaded designs increase friction and holding strength, making them suitable for thicker hair or larger wefts.

Figure 50:
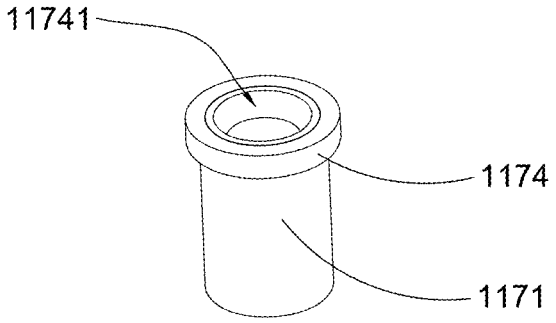
FIG. 50 is a perspective view of a first alternative mounting tube of the hair extension according to the above first preferred embodiment of the present invention.
Figure 51:
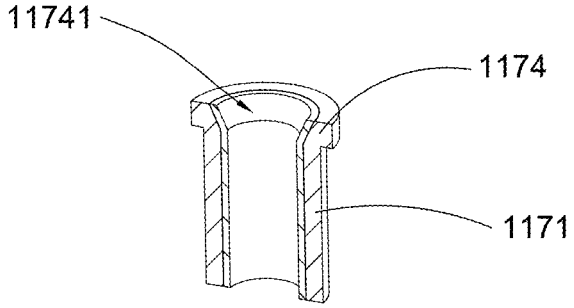
FIG. 51 is a schematic view of the first alternative mounting tube of the hair extension according to the above first preferred embodiment of the present invention.

As shown in FIGS. 50 and 51 of the drawings, each mounting tube 1170 may comprises an enlarged tube portion 1174 which is extended from the tube body 1171, the enlarge tube portion 1174 may have a larger tube opening 11741, so as to facilitate the sleeve of the mounting tube 1170 on the hair strand 6 of the natural hair of the user.

Referring to FIGS. 53 to 61 of the drawings, a hair extension 2000 according to a second preferred embodiment of the present invention is illustrated, the hair extension 2000 comprises two or more hair extension units such as an upper hair extension unit 2100 and a lower hair extension unit 2200, the hair extension further comprises a foldable opening base 2300 connected to the upper hair extension unit 2100 and the lower hair extension unit 2200. The foldable opening base 2300 has one or more openings 2310 located between the upper hair extension unit 2100 and the lower hair extension unit 2200 for aiding the user to wear the hair extension with the above mentioned mounting tubes 1170.

More specifically, the foldable opening base 2300 comprises an upper end portion 2320 and a lower end portion 2330, the upper hair extension unit 2100 and the lower hair extension unit 2200 are respectively installed at the upper end portion 2320 and the lower end portion 2330 of the foldable opening base 2300. Initially, the hair strands of the upper hair extension unit 2100 and the lower hair extension unit 2200 extend in opposite directions. During use, the user's natural hair is guided through these openings 2310, and the mounting tubes 1170 are used to secure the hair extension 2000 to the natural hair. After fixation, the foldable opening base 2300 is folded, and the upper hair extension unit 2100 is flipped downward, so that the hair strands of the upper hair extension unit 2100 extend downward, in the same direction as the lower hair extension unit 2200. As a result, both the upper hair extension unit 2100 and the lower hair extension unit 2200 produce a natural downward flow of hair strands, achieving a seamless and voluminous appearance that closely mimics the look of natural hair growth.

The upper hair extension unit 2100 comprises an upper hair base 2110 and a plurality of upper hair members 2120 fixed to the upper hair base 2110, the lower hair extension unit 2200 comprises a lower hair base 2210 and a plurality of lower hair members 2220 fixed to the lower hair base 2210.

In this embodiment, the upper hair base 2110 comprises an upper glue base 2111, the lower hair base 2210 comprises a lower glue base 2211. Each upper hair member 2120 comprises an upper root part 2121 and an upper hair body part 2122 which is integrally extended from the upper root part 2121, the upper root part 2121 is embedded in the upper glue base 2111. Each lower hair member 2220 comprises a lower root part 2221 and a lower hair body part 2222 which is integrally extended from the lower root part 2221, the lower root part 2221 is embedded in the lower glue base 2211.

The upper hair members 2120 and the lower hair members 2220 are disposed on opposite end portions of the foldable opening base 2300, extending in opposite directions. After the foldable opening base 2300 is folded, the extending directions of the upper hair members 2120 and the lower hair members 2220 become the same, both conforming to the natural downward flow of human hair when worn. In other words, prior to folding, the upper hair members 2120 and the lower hair members 2220 can be in a state that they are extended in opposite directions. Once the foldable opening base 2300 is folded during wear, both the upper hair members 2120 and the lower hair members 2220 point downward, aligning with the natural fall of the user's hair. Integrating two hair extension units into one structure allows for greater volume and thickness using a single hair extension product. Accordingly, the hair extension 2000 is configured with multiple layers of hair arranged in a vertically staggered or overlapping manner, thereby simulating the layered and voluminous structure of natural human hair. By incorporating upper hair extension unit 2100 and the lower hair extension unit 2200 that are folded and oriented to extend in the same downward direction after assembly, the hair extension 2000 creates a multi-dimensional visual effect, mimicking the natural gradation and depth found in real hair growth.

Figure 53:
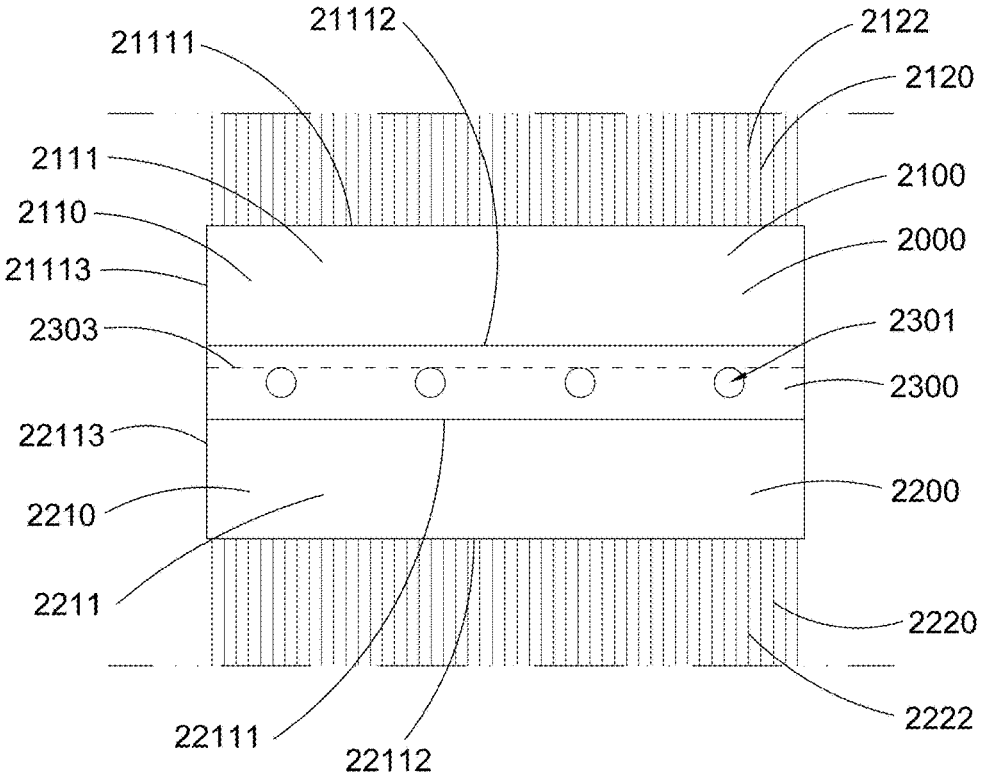
FIG. 53 is a schematic view of a hair extension according to a second preferred embodiment of the present invention.

In this embodiment, as shown in FIG. 53, the upper glue base 2111 has a top edge 21111, a bottom edge 21112, and two side edges 21113, the upper root part 2121 of each upper hair member 2120 is embedded between the top edge 21111 and the bottom edge 21112 of the upper glue base 2111. The upper hair body part 2122 of each upper hair member 2120 is extended from the top edge 21111 of the upper glue base 2111. The lower glue base 2211 has a top edge 22111, a bottom edge 22112, and two side edges 22113, the lower root part 221 of each lower hair member 2220 is embedded between the top edge 22111 and the bottom edge 22112 of the lower glue base 2211. The lower hair body part 2122 of each lower hair member 2220 is extended from the bottom edge 22112 of the lower glue base 2211.

As a result, the upper and lower hair body parts 2122 and 2222 extend in two opposite directions when the hair extension 2000 is in its unfolded state. However, upon folding the foldable opening base 2300, the upper hair extension unit 2100 is flipped downward, causing the upper hair body parts 2122 to reorient and extend downward, in alignment with the lower hair body parts 2222. This folding structure allows both layers of hair to fall naturally in the same downward direction, thereby enhancing the overall realism and visual consistency of the hair extension 2000.

Preferably, each of the foldable opening base 2310 and the upper glue base 2111 may have two upper side corner edges each is a curved edge, preferred an arc edge. The upper glue base has two lower side corner edges each is an orthogonal edge. The arc-shaped upper side corner edges contribute to a smoother transition between the upper boundary of the glue base and the user's scalp or surrounding hair. This curved contour reduces the risk of irritation or pressure points, especially when the extension is worn for extended periods. The rounded design of the upper corners also offers aesthetic benefits, as it more naturally mimics the contours of the scalp or hairline, making the hair extension less detectable and more realistic in appearance. The orthogonal lower side corner edges provide a stable base geometry at the lower portion of the glue base. These right-angled edges enhance the structural alignment and adherence of the glue base to the user's head, ensuring secure placement and minimizing unintended lifting or curling of the base during wear.

The material of the hair members 2120 and 2220 can be but not limited to real human hair, synthetic fiber, blended materials and animal hair. The hair members 2120 and 2220 made from real human hair can offer the most natural look and feel, and can be styled, dyed, and treated like natural hair. Artificial fibers, such as heat-resistant or low-temperature fibers, can be used for preparing the hair members 2120 and 2220 as then may not look as natural as human hair. The blended materials combine human hair with synthetic fibers to provide a balance between natural appearance and affordability. This mix aims to offer both the realistic look of human hair and the durability of synthetic fibers. The hair members 2120 and 2220 also may be made from hair of animals like horses or yak, so as to offer a natural texture.

Each of the upper glue base 2111 and the lower glue base 2211 can be formed by a glue material which comprises a polyurethane glue, such as a mixture of polyurethane glue, adhesive, and thinner or diluent. Preferably, a weight content of polyurethane glue is ranged from 40%-60%, a weight content of adhesive is ranged from 10%-30%, and a weight content of thinner is ranged from 20%-40%.

In this embodiment, a row of openings 2310 is formed in the foldable opening base 2300 between the upper end portion 2320 and the lower end portion 2330, each opening 2310 is penetrating through a thickness of the foldable opening base 2300. A distance between two adjacent openings 2310 is 0.1-20 mm, a distance between a side edge of the foldable opening base 2300 and the opening 2310 adjacent to the side edge is 0.1-10 mm. Each opening 2310 can be configured to have any shape, such as triangle, square, rectangular, circular, and oval. In this embodiment, each opening 2310 is shown have a circular shape and a diameter of the opening 2310 is 0.1-3.5 mm.

Figure 60:
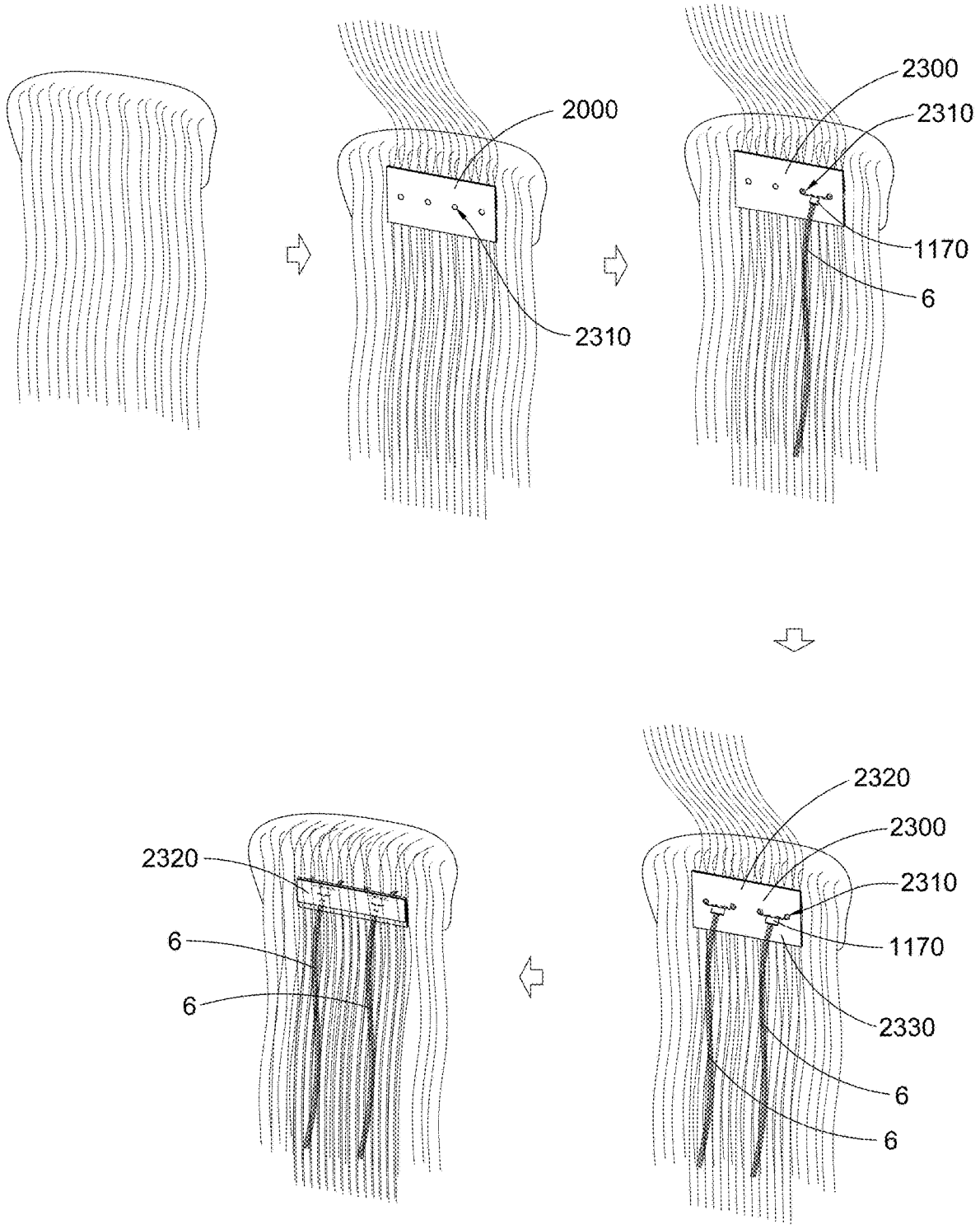
FIG. 60 is a schematic view illustrating the process of wearing the hair extension on natural hair of the user according to the above second preferred embodiment of the present invention.
Figure 61:
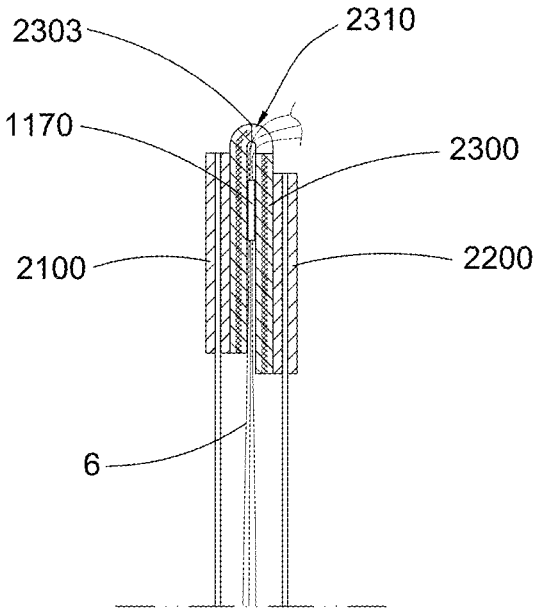
FIG. 61 is a sectional view illustrating the hair extension which is worn on natural hair of the user according to the above second preferred embodiment of the present invention.

The foldable opening base 2300 comprises a middle portion 2340 between the upper end portion 2320 and the lower end portion 2330, multiple openings 2310 is formed in the middle portion 2340. As shown in FIGS. 60 and 61 of the drawings, when in the use state, the middle portion 2340 is folded and is posited above the upper hair extension unit 2100 and the lower hair extension unit 2200. Preferably, a height of the middle portion 2340 is 0.5-1.5 cm, preferably 1-1.5 cm. In other words, a distance between the upper hair extension unit 2100 and the lower hair extension unit 2200 which is a gap 2304 formed between the upper hair extension unit 2100 and the lower hair extension unit 2200 is 0.5-1.5 cm.

Figure 57:
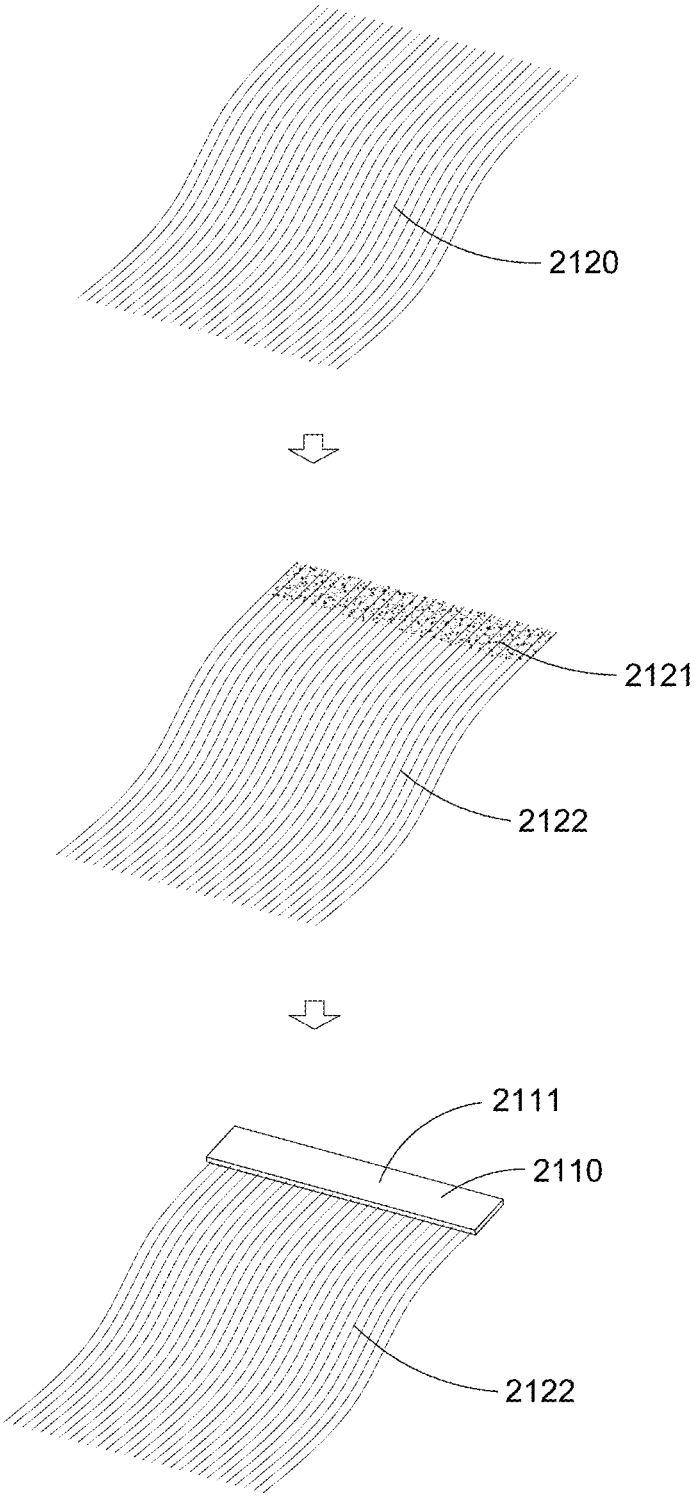
FIG. 57 is a schematic view illustrating the manufacturing process of a hair extension unit of the hair extension according to the above second preferred embodiment of the present invention.

Referring to FIG. 57 of the drawings, when preparing each of the two hair extension units 2100 and 2200. A masking tape may be attached about 1.2-1.5 cm away from the top of the corresponding hair members 2120 or 2220, so that the masking tape covers the hair to prevent the glue from penetrating into the bottom of the hair members 2120 or 2220 during the subsequent gluing step, and play a shaping role.

Use a polycarbonate glue, an adhesive, and a diluent or thinner to mix in proportion to obtain the glue material for making the corresponding upper glue base 2111 or lower glue base 2211.

Apply the glue material to the hair members hair members 2120 or 2220 above the masking tape and use a scraper to scrape repeatedly to make the glue material contact with the hair members hair members 2120 or 2220 evenly and fix it. After finishing, put it in the drying box for drying at a temperature of 50-55° C. for 10-15 minutes.

In addition, before applying the glue material, a single-needle sewing machine may be used to run a water-soluble sewing thread about 4 to 5 cm away from the top of the hair members 2120 or 2220 to fix the hair members 2120 or 2220 to obtain a hair extension material and prevent the hair members 2120 or 2220 from spreading during production.

Figure 62:
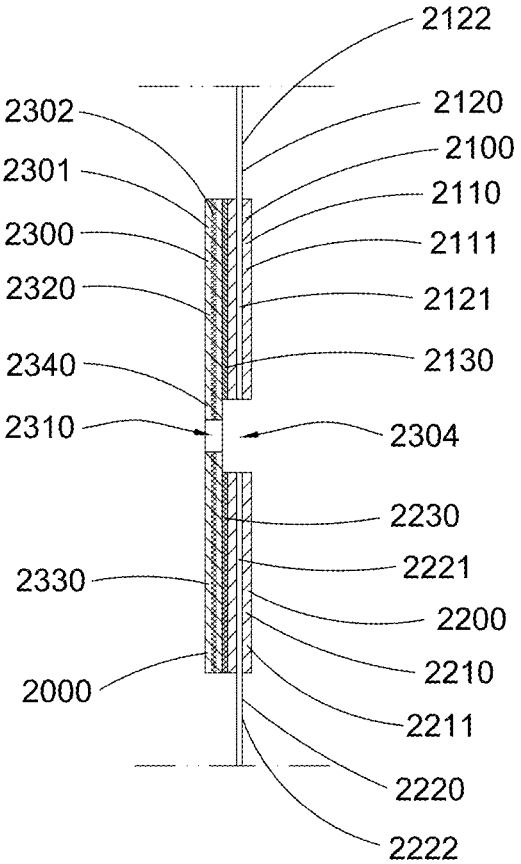
FIG. 62 is a sectional view of a hair extension according to a first alternative mode of the above second preferred embodiment of the present invention.

As shown in FIG. 62 of the drawings, a layer of upper mesh yarn 2130 may be further applied on the upper glue base 2111, a layer of lower mesh yarn 2230 may be further applied on the lower glue base 2211. The person of ordinary skilled in the art should understand that the employment of the upper mesh yarn 2130 and the lower mesh yarn 2230 can be used in other embodiments.

After the upper glue base 2111 and the lower glue base 2211 are formed, the hair members 2120 and 2220 are fixed to the upper glue base 2111 and the lower glue base 2211 respectively.

Figure 54:
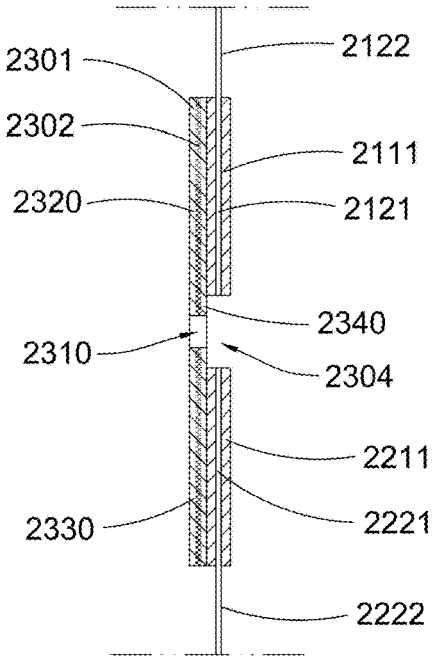
FIG. 54 is a sectional view of the hair extension according to the above second preferred embodiment of the present invention.
Figure 55:
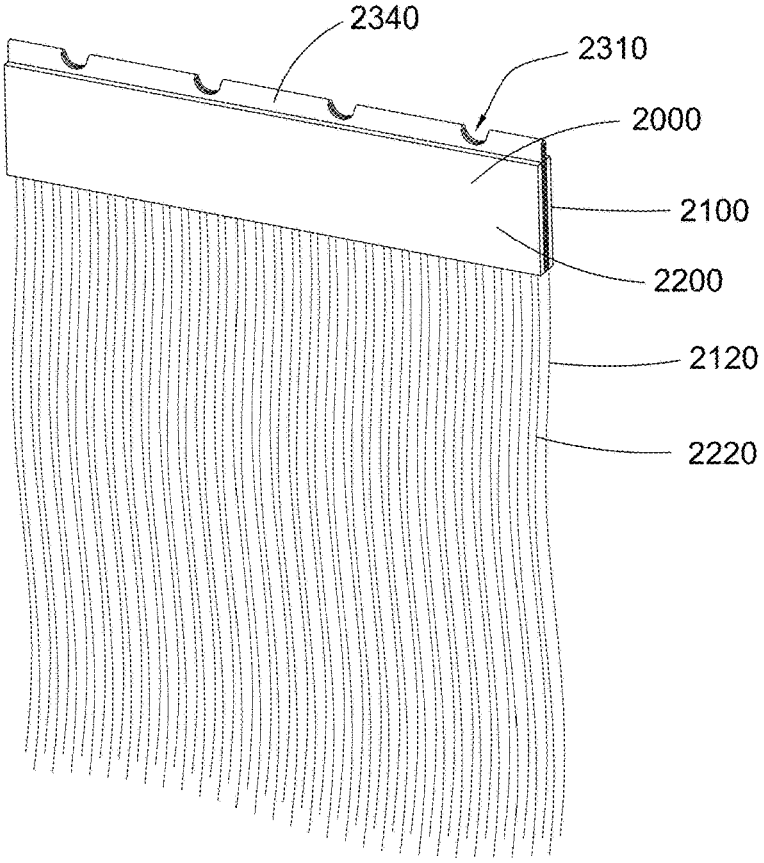
FIG. 55 is a perspective view illustrating the hair extension being in a folded state along a middle of a foldable opening base according to the above second preferred embodiment of the present invention.
Figure 56:
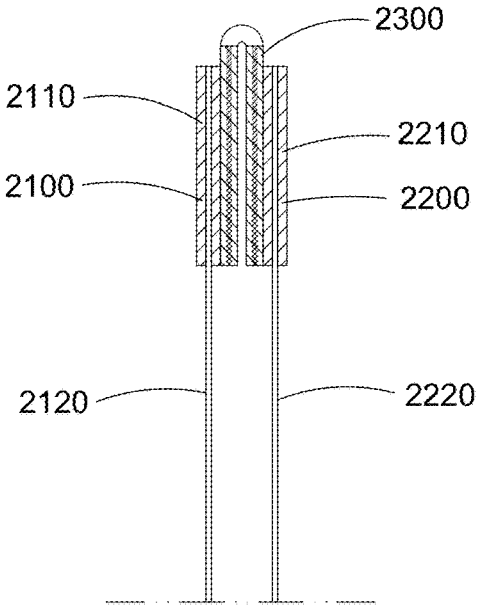
FIG. 56 is a sectional view illustrating the hair extension being in a folded state along a middle of the foldable opening base according to the above second preferred embodiment of the present invention.

As shown in FIG. 54 of the drawings, the foldable opening base 2300 comprises a glue base body 2301. A mesh layer 2302 may be further attached to the glue base body 2301, the openings 2310 are penetrating through the glue base body 2301 and the mesh layer 2302. A glue material of the glue base body 2301 can be but not limited to polyurethane, a material of the mesh layer 2302 can be but not limited to yarn, fabric, mesh and silk. In the wearing state, the upper end portion 2320 of the foldable opening base 2300 is folded along a folding line 2303 which is above the openings 2310, so as to align the upper end portion 2320 with the lower end portion 2330 of the foldable opening base 2300.

Figure 58:
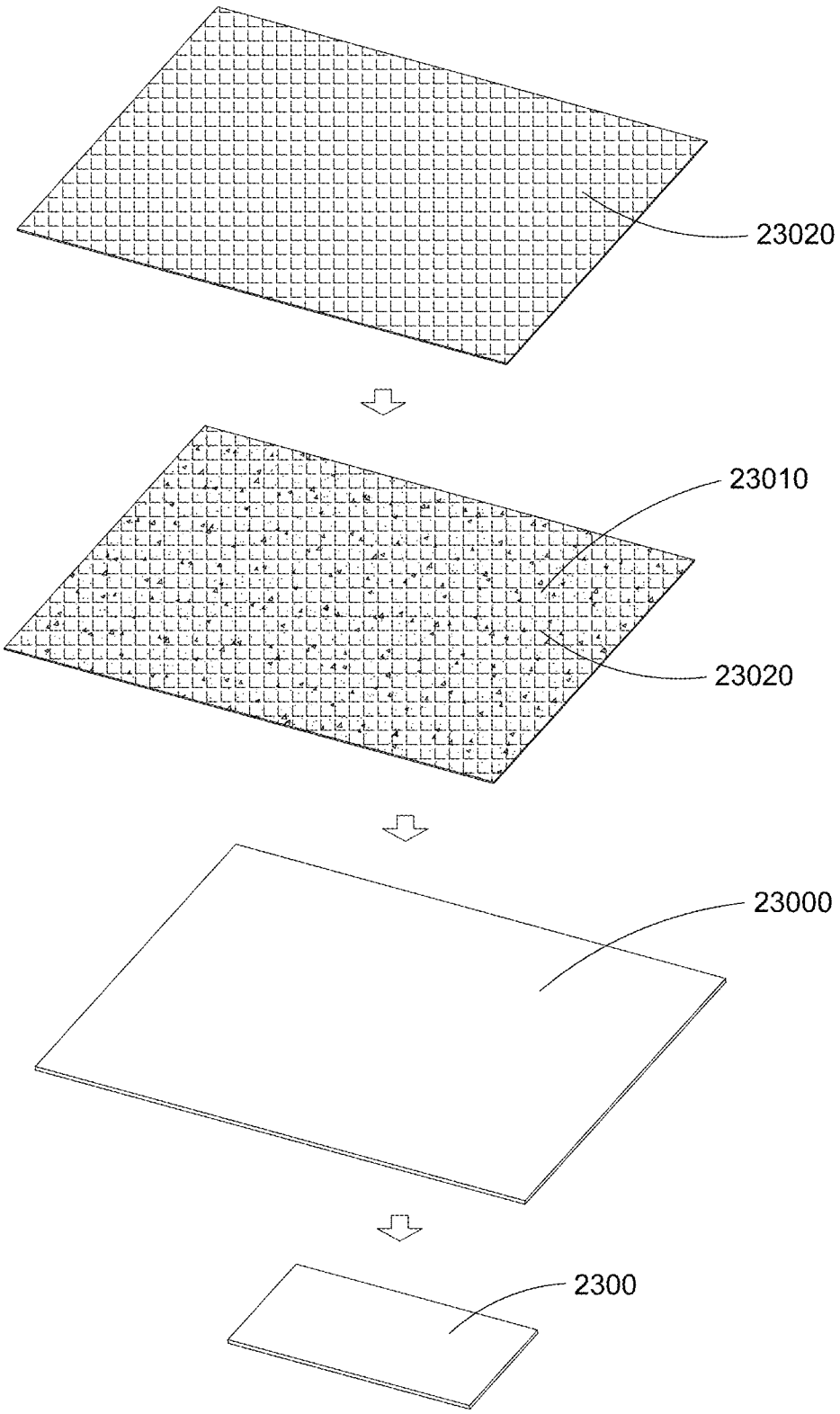
FIG. 58 is a schematic view illustrating the manufacturing process of a foldable opening base of the hair extension according to the above second preferred embodiment of the present invention.
Figure 59:
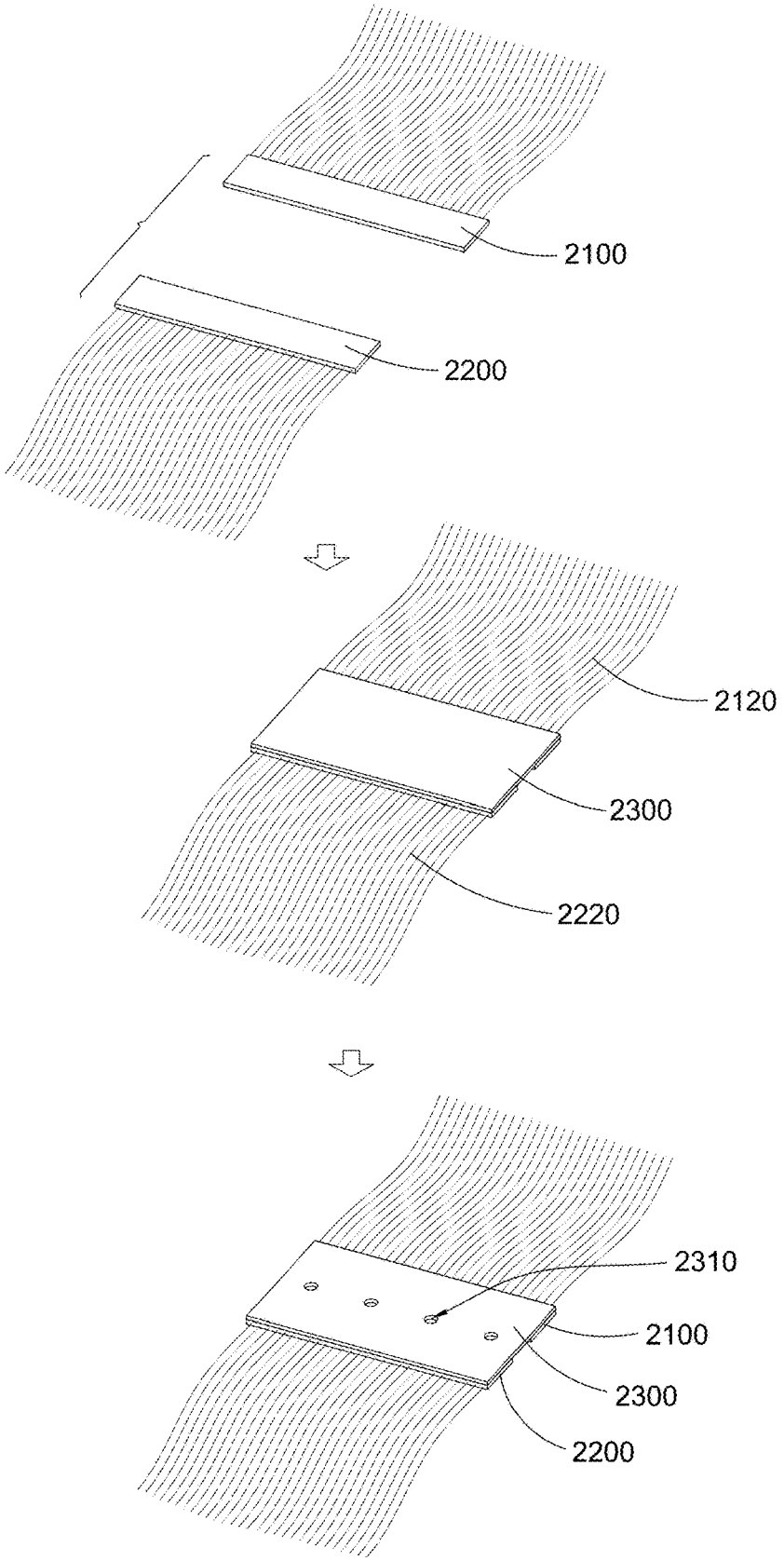
FIG. 59 is a schematic view illustrating the process of attaching the hair extension units on the foldable opening base of the hair extension according to the above second preferred embodiment of the present invention.

Referring to FIG. 58 of the drawings, the foldable opening base 2300 can be obtained from an opening base material 23000. More specifically, a mesh material 23020 is applied with glue material at both sides thereof, so to form a glue material layer 23010 on the mesh material 23020 to provide the opening base material 23000, then the opening base material 23000 is cut to provide the foldable opening bases 2300.

The hair extension 2000 further comprises one or more above mounting tubes 1170. Referring to FIG. 60 of the drawings, when wearing the hair extension 2000 on the head of the user, the lower hair extension unit 2200 can be attached to natural hair of the user, hair strands 6 of natural hair of the user can be guided by a hook device to pass through the openings 2310. The hair strands 6 of natural hair of the user at the inner side of the hair extension 2000 is guided to pass through the openings 2310 from the front side of the hair extension 2000 adjacent to the scalp of the user to the rear side of the hair extension 2000, and then one or more hair strands 6 of natural hair of the user, such as two hair strands 6 of natural hair of the user is sleeved by one mounting tube 1170 which is position on the rear side of the foldable opening base 2300, so as to fix the hair extension 2000 to the natural hair of the user by the mounting tubes 1170. Each mounting tube 1170 can then be pressed by a clamping tool, so as to firmly fix the strands 6 of natural hair of the user. And then, the foldable opening base 2310 is folded to align the upper end portion 2320 to the lower end portion 2330, the upper hair extension unit 2100 is stacked on the lower hair extension unit 2200, the upper hair body part 2122 of each upper hair member 2120 is extending downward and is covered on the lower hair body part 2222 of each lower hair member 2220, so that the mounting tubes 1170 are hidden between the upper end portion 2320 and the lower end portion 2330 of the foldable opening base 2300. In this wearing state, as shown in FIG. 61, the foldable opening base 2300 is sandwiched between the two hair extension units 2100 and 2200.

Alternatively, when wearing the hair extension 2000 on the head of the user, the foldable opening base 2300 can be attached to natural hair of the user, the hair strands 6 of natural hair of the user is guided to pass through the openings 2310 from the rear side of the hair extension 2000 to the front side of the hair extension 2000, and then one or more hair strands 6 of natural hair of the user, such as two hair strands 6 of natural hair of the user is sleeved by one mounting tube 1170, so as to fix the hair extension 2000 to the natural hair of the user by the mounting tubes 1170 which are positioned on the front side of the foldable opening base 2300. In this manner, the two hair extension units 2100 and 2200 are stacked at the outer side of the foldable opening base 2300.

Figure 63:
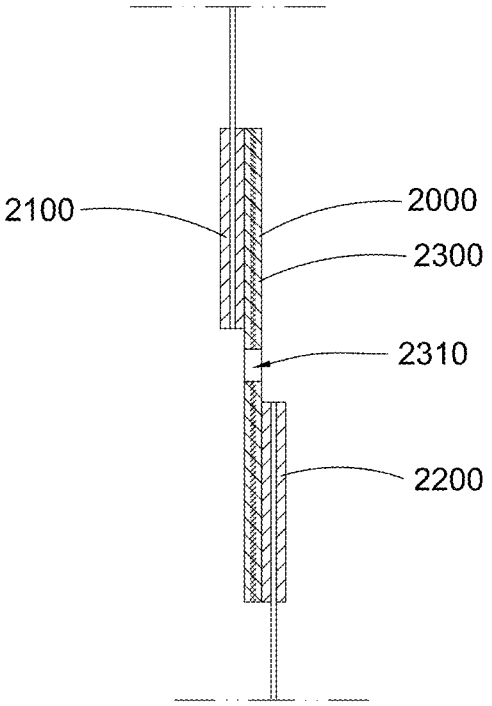
FIG. 63 is a sectional view of a hair extension according to a second alternative mode of the above second preferred embodiment of the present invention.
Figure 64:
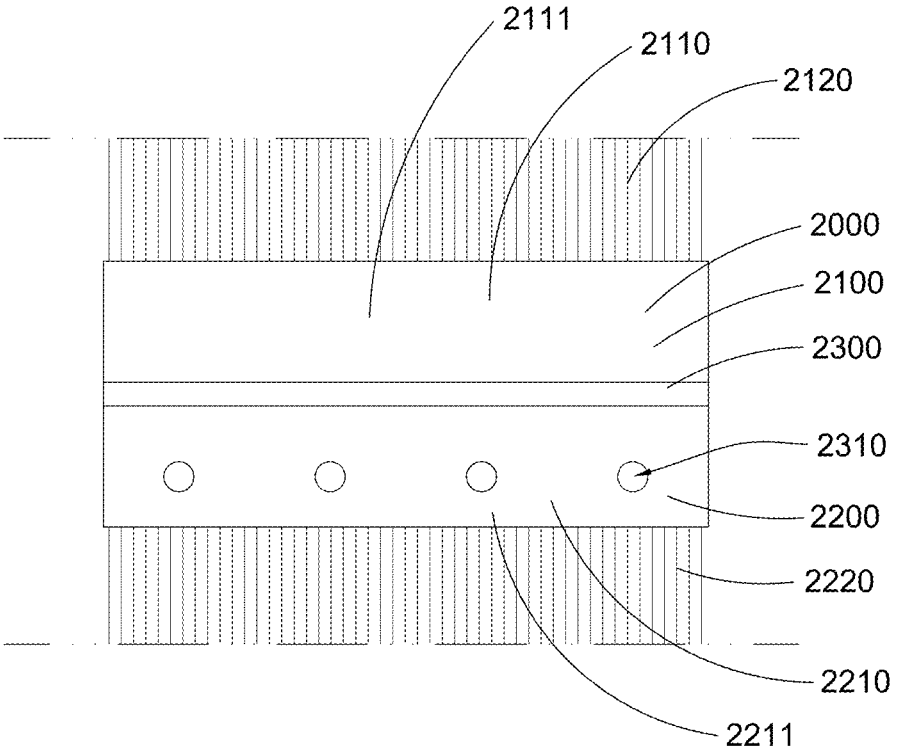
FIG. 64 is a schematic view of a hair extension according to a third alternative mode of the above second preferred embodiment of the present invention.
Figure 65:
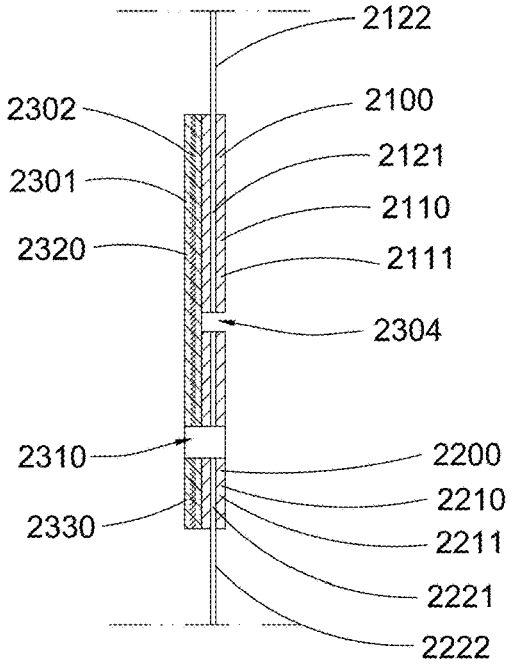
FIG. 65 is a sectional view of the hair extension according to the third alternative mode of the above second preferred embodiment of the present invention.
Figure 66:
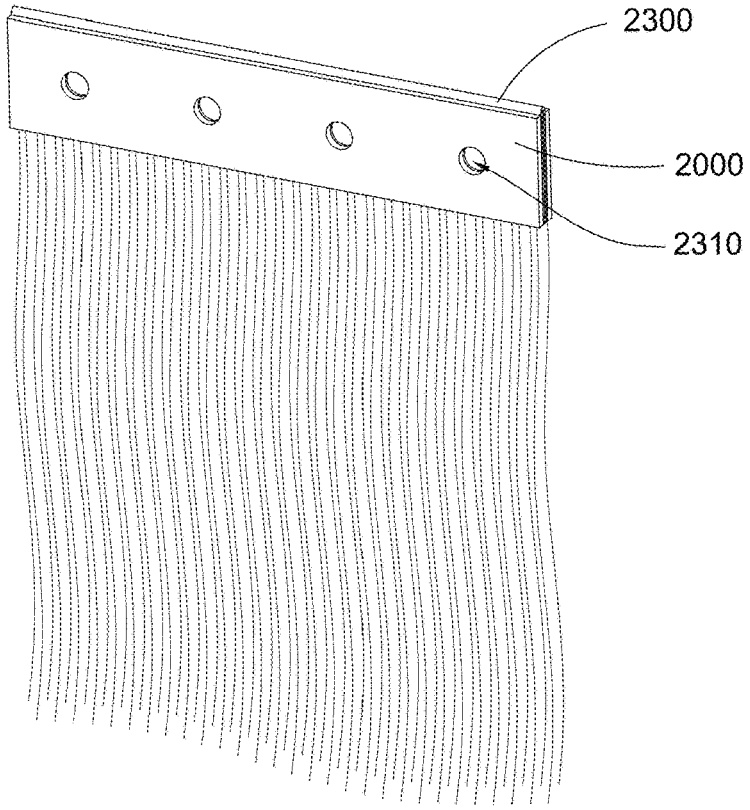
FIG. 66 is a perspective view of the hair extension being folded according to the third alternative mode of the above second preferred embodiment of the present invention.
Figure 67:
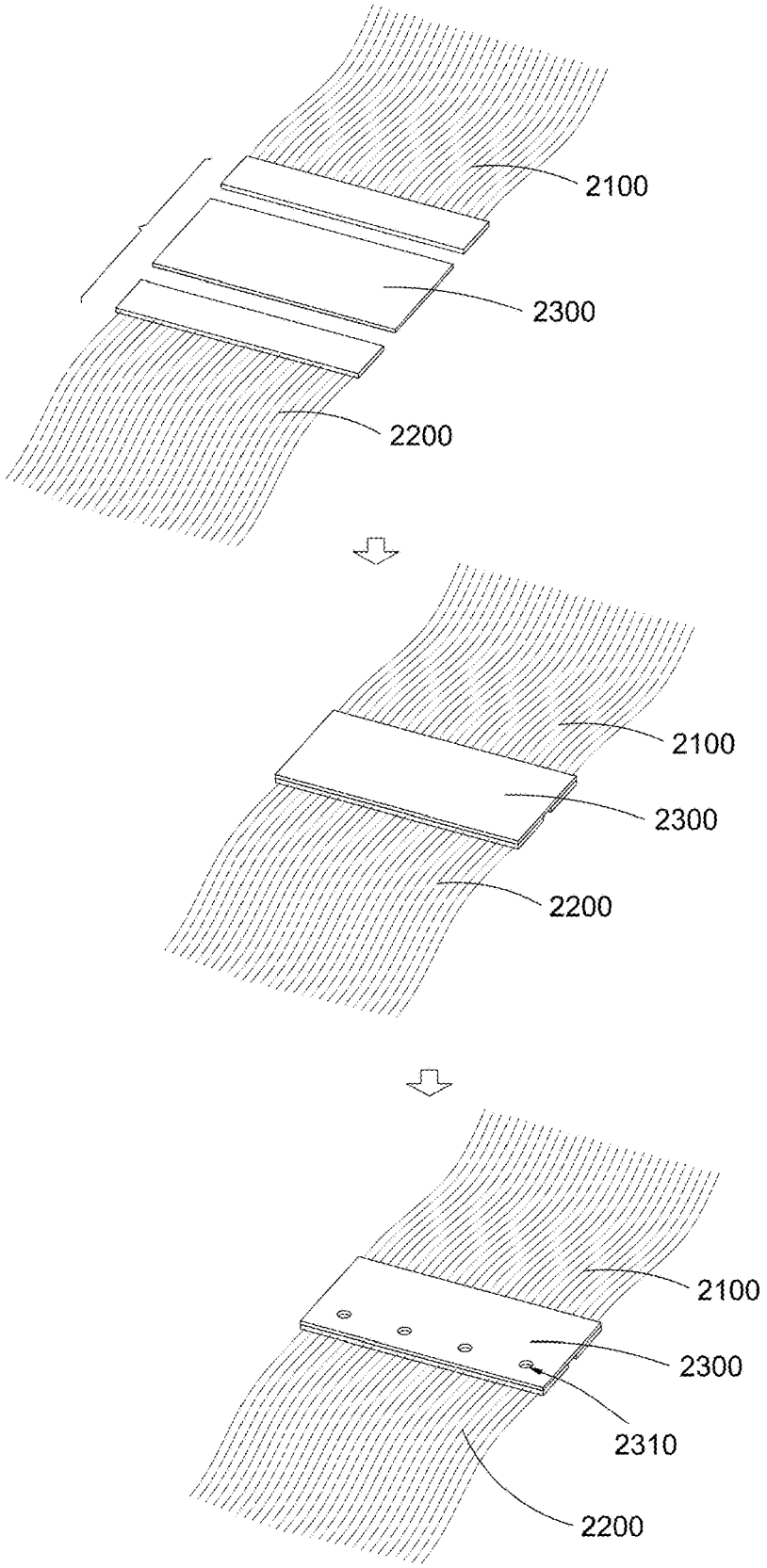
FIG. 67 is a schematic view illustrating the manufacturing process of the hair extension according to the third alternative mode of the above second preferred embodiment of the present invention.
Figure 68:
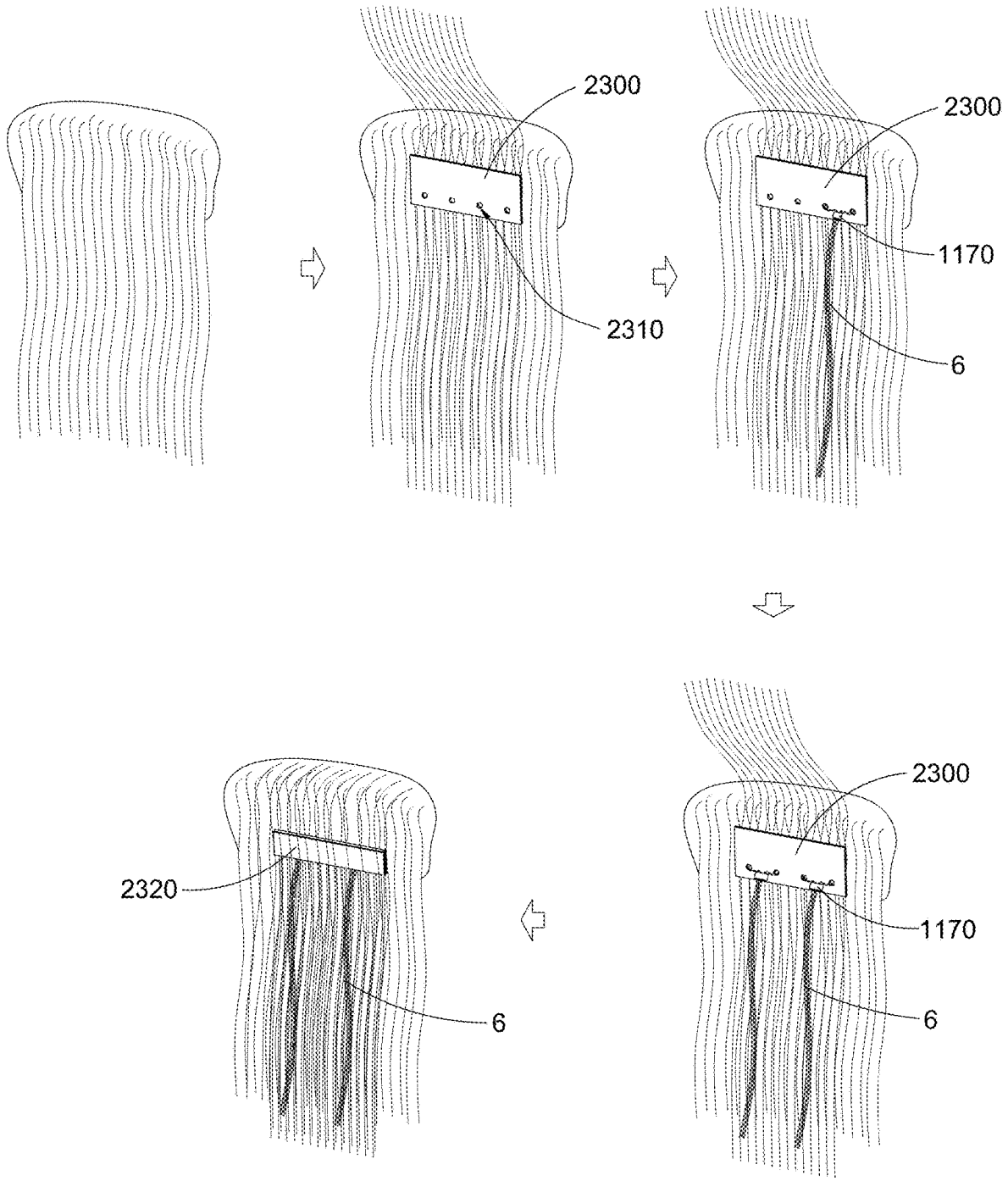
FIG. 68 is a schematic view illustrating the process of wearing the hair extension on natural hair of the user according to the third alternative mode of the above second preferred embodiment of the present invention.

In this embodiment, the upper hair extension unit 2100 and the lower hair extension unit 2200 can be provided at a same side of the foldable opening base 2300. As shown in FIG. 63, as a second alternative mode, the upper hair extension unit 2100 and the lower hair extension unit 2200 can be provided at two opposite sides of the foldable opening base 2300.

Figure 69:
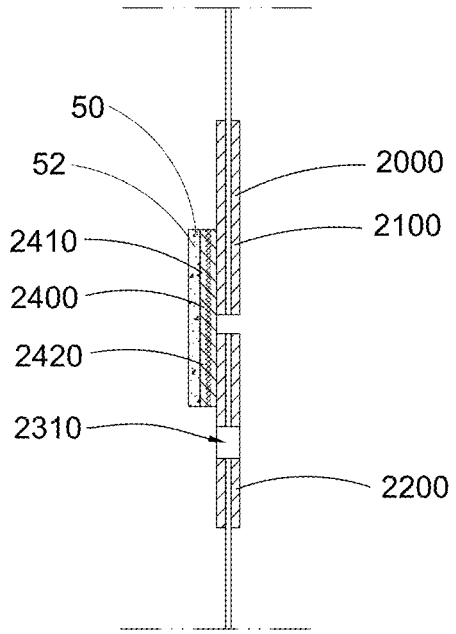
FIG. 69 is a sectional view of a hair extension according to a fourth alternative mode of the above second preferred embodiment of the present invention.

As shown in FIGS. 64 to 68 of the drawings, as a third alternative mode, the openings 2310 can be formed at positions penetrating through both the foldable opening base 2310 and the lower glue base 2211 of the lower hair extension unit 2200. A distance between the upper hair extension unit 2100 and the lower hair extension unit 2200 can be 0.1-0.5 cm, preferably 0.1-0.15 cm. Alternatively, as shown in FIG. 69, the openings 2310 can be formed only penetrating through the lower glue base 2211 of the lower hair extension unit 2200, the foldable opening base 2310 of the above embodiment is replaced by just a base 2400 without the openings 2310. The base 2400 comprises an upper end portion 2410 and a lower end portion 2420, the upper hair extension unit 2100 and the lower hair extension unit 2200 are respectively attached to the upper end portion 2410 and the lower end portion 2420 of the base 2400. In addition, an attaching unit 50 such as a double-sided binding tape 52 can be further attached to the base 2400, so that when wearing the hair extension 2000 with the base 2400, the double-sided binding tape 52 can be employed for aiding the hair extension 2000 to be attached to the natural hair of the user.

Figure 70:
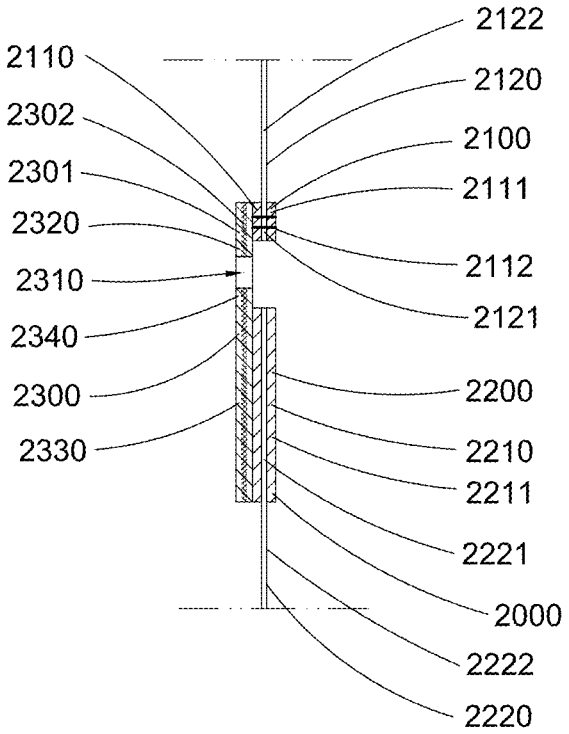
FIG. 70 is a sectional view of a hair extension according to a fifth alternative mode of the above second preferred embodiment of the present invention.

As shown in FIG. 70 of the drawings, as a fifth alternative mode, the upper hair extension unit 2100 can be embodied to have a structure of the above first hair weft unit 80. In other words, the upper hair base 2110 further comprises one or more stitching lines 2112 to fix the upper hair members 2120. When there are two stitching lines 2112, a distance between the two stitching lines 2112 can be smaller than 3 mm.

Figure 71:
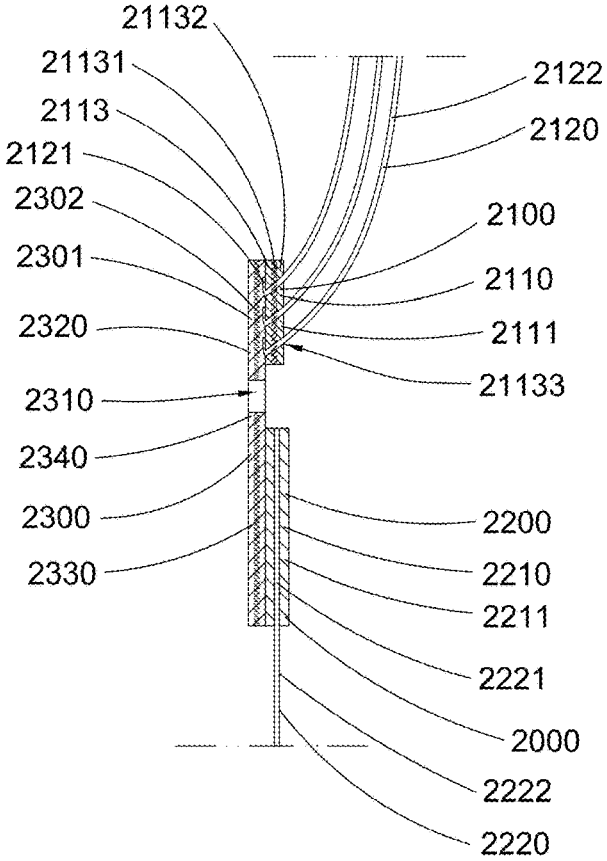
FIG. 71 is a sectional view of a hair extension according to a sixth alternative mode of the above second preferred embodiment of the present invention.

As shown in FIG. 71 of the drawings, as a sixth alternative mode, the upper hair extension unit 2100 can be embodied to have a structure of the above first hair weft unit 30. More specifically, the upper hair extension unit 2100 comprises an upper hair base 2110 and a plurality of upper hair members 2120 which is fixed to the upper hair base 2110. The upper hair base 2110 in this embodiment comprises a hair transplantation base 2113.

The hair transplantation base 2113 comprises a silk mesh 21131 and a glue layer 21132 applied to the silk mesh 21131, the glue material of the glue layer 21132 is filled into the mesh holes of the silk mesh 21131, so that the hair transplantation base 2113 is an integral rigid and smooth layer which is suitable for the hair transplantation process. The material of the silk mesh 21131 can be natural silk, synthetic silk, mesh or netting. The glue layer 21132 may comprise one or more of acrylic resin, epoxy resin, polyurethane, plasticizers such as phthalates, fillers such as calcium carbonate, and solvents such as ethyl acetate, ethanol, acetone. Alternatively, the hair transplantation base 2113 comprises a fabric layer or a textile layer and a glue layer applied to the fabric layer or the textile layer. The hair transplantation base 2113 may also be made of plastic material such as polyvinyl chloride and polyurethane.

The hair transplantation base 2113 has a plurality of hair transplantation holes 21133, one or more upper hair members 2120 can be planted in the corresponding hair transplantation hole 21133.

Accordingly, in this embodiment, the hair members 2120 can be manually planted on the hair transplantation base 2113 or by a transplantation machine. The upper root part 2121 of each upper hair member 2120 is penetrating the thickness of the hair transplantation base 2113 and is fixed to a front surface of the hair transplantation base 2113 which is a side adjacent to the scalp of the user when the hair extension 2000 is worn on the user and the upper hair body part 2122 of each upper hair member 2120 is extended from a rear surface of the hair transplantation base 2113.

Figure 72:
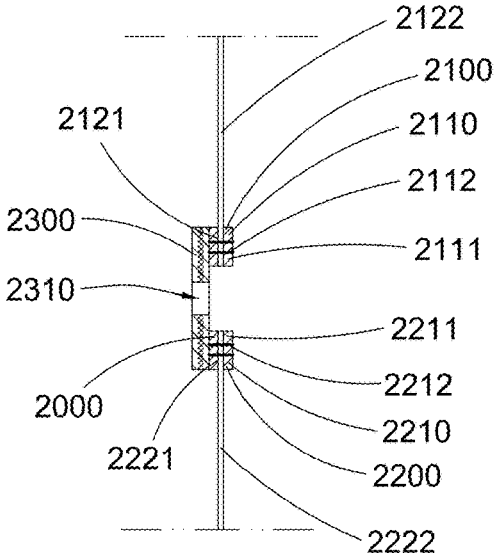
FIG. 72 is a sectional view of a hair extension according to a seventh alternative mode of the above second preferred embodiment of the present invention.

As shown in FIG. 72 of the drawings, as a seventh alternative mode, both of the upper hair extension unit 2100 and the lower hair extension unit 2200 can be embodied to have a structure of the above fourth alternative mode. In other words, the upper hair base 2110 further comprises one or more stitching lines 2112, the lower hair base 2210 further comprises one or more stitching liens 2212.

Figure 73:
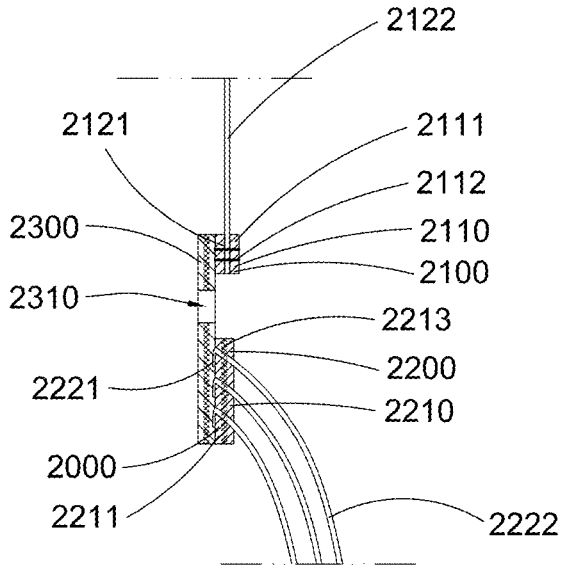
FIG. 73 is a sectional view of a hair extension according to an eighth alternative mode of the above second preferred embodiment of the present invention.

As shown in FIG. 73 of the drawings, as an eighth alternative mode, the upper hair extension unit 2100 is embodied to comprise the upper hair base 2110 having the one or more stitching lines 2112. The lower hair extension unit 2200 is embodied to comprise a hair transplantation base 2213 to plant the lower hair members 2220.

Figure 74:
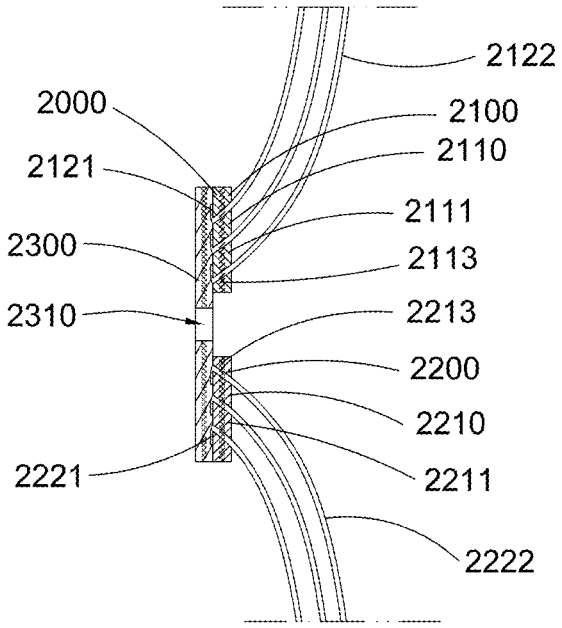
FIG. 74 is a sectional view of a hair extension according to a ninth alternative mode of the above second preferred embodiment of the present invention.

As shown in FIG. 74 of the drawings, as a ninth alternative mode, the upper hair extension unit 2100 is embodied to comprise the hair transplantation base 2113 to plant the upper hair members 2120, the lower hair extension unit 2200 is embodied to comprise a hair transplantation base 2213 to plant the lower hair members 2220.

Figure 75:
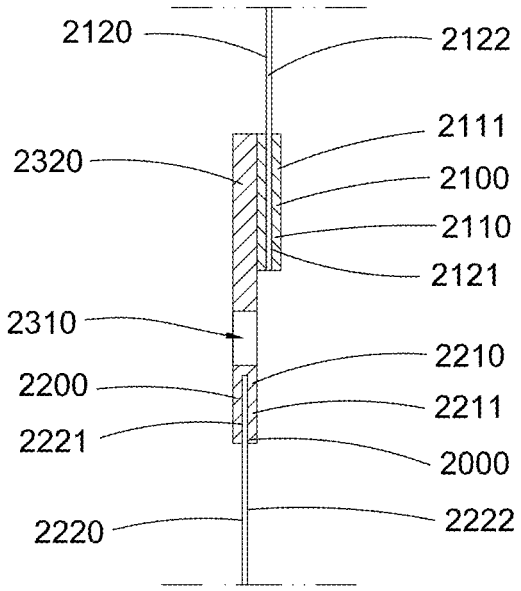
FIG. 75 is a sectional view of a hair extension according to third preferred embodiment of the present invention.

As shown in FIG. 75 of the drawings, according to a third embodiment of the present invention, a hair extension 2000 according to a third preferred embodiment of the present invention is illustrated, the hair extension 2000 comprises two or more hair extension units such as an upper hair extension unit 2100 and a lower hair extension unit 2200. In this embodiment, the hair extension 2000 further comprises a foldable opening base 2300 which is an integral part of one of the upper hair extension unit 2100 and the lower hair extension unit 2200.

More specifically, as an example in this embodiment, the lower hair extension unit 2200 comprises a lower hair base 2210 which comprises a lower glue base 2211 and a foldable opening base 2300 integrally extended from the lower glue base 2211. The foldable opening base 2300 has one or more openings 2310 penetrating a thickness thereof and comprises an upper end portion 2320 which is attached with the upper hair extension 2100 which comprises the upper hair base 2110 and the plurality of upper hair members 2120 fixed to the upper hair base 2110.

Figure 76:
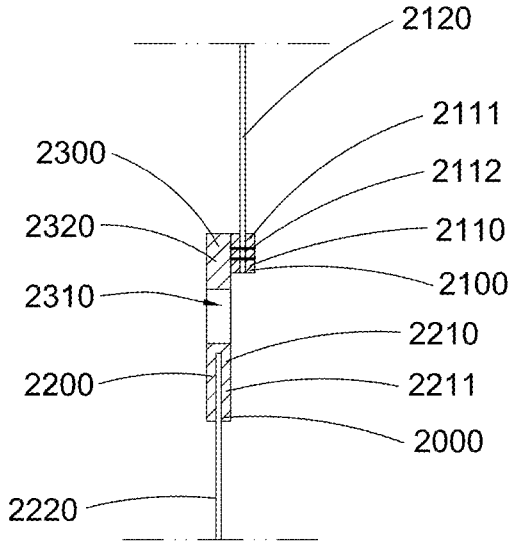
FIG. 76 is a sectional view of a hair extension according to a first alternative mode of the above third preferred embodiment of the present invention.

Referring to FIG. 76, as a first alternative mode of the above third embodiment, the hair extension 2000 comprises an upper hair extension unit 2100 and a lower hair extension unit 2200, the lower hair extension unit 2200 comprises a lower hair base 2210 which comprises a lower glue base 2211 and a foldable opening base 2300 integrally extended from the lower glue base 2211. The upper hair extension unit 2100 comprises an upper hair base 2110 and a plurality of upper hair members 2120 which is fixed to the upper hair base 2110. The upper hair base 2110 comprises an upper glue base 2111 and one or more stitching lines 2112 provided on the upper glue base 2111 for fixing the upper hair members 2120.

Figure 77:
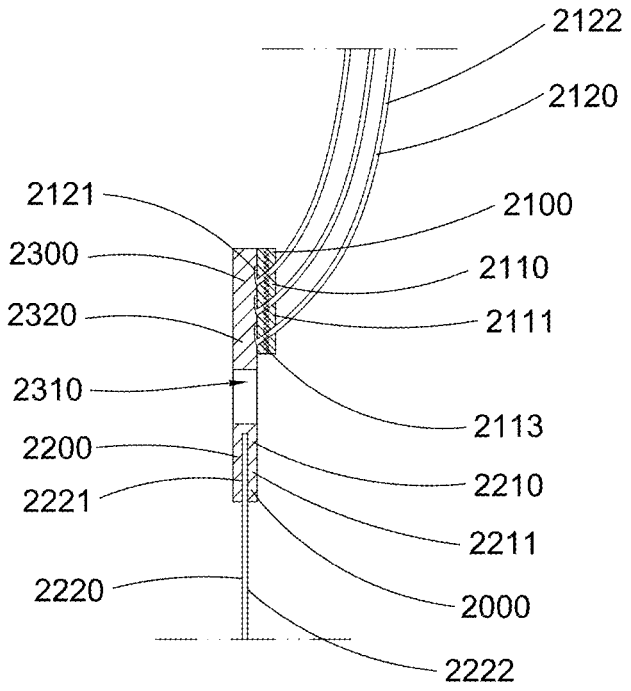
FIG. 77 is a sectional view of a hair extension according to a second alternative mode of the above third preferred embodiment of the present invention.

Referring to FIG. 77, as a second alternative mode of the above third embodiment, The upper hair base 2110 in this embodiment comprises a hair transplantation base 2113 for transplanting the upper hair members 2120.

Figure 78:
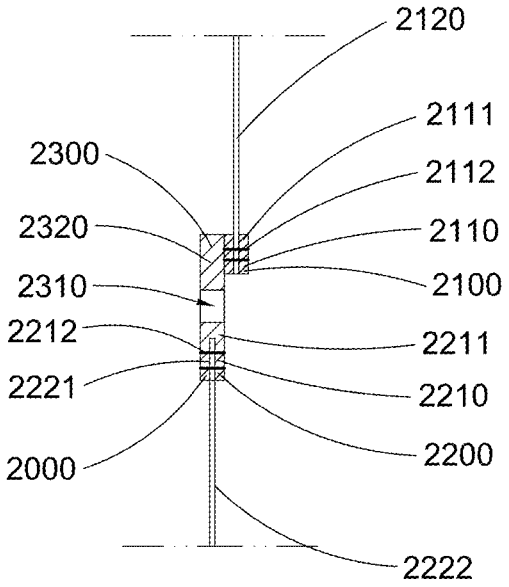
FIG. 78 is a sectional view of a hair extension according to a third alternative mode of the above third preferred embodiment of the present invention.

Referring to FIG. 78, as a third alternative mode of the above third embodiment, the hair extension 2000 comprises an upper hair extension unit 2100 and a lower hair extension unit 2200, the lower hair extension unit 2200 comprises a lower hair base 2210 which comprises a lower glue base 2211 and a foldable opening base 2300 integrally extended from the lower glue base 2211. The upper hair extension unit 2100 comprises an upper hair base 2110 and a plurality of upper hair members 2120 which is fixed to the upper hair base 2110. The upper hair base 2110 in this embodiment comprises an upper glue base 2111 and one or more stitching lines 2112 provided on the upper glue base 2111. The lower hair base 2210 comprises a lower glue base 2211 and one or more stitching lines 2212 provided on the lower glue base 2211.

Figure 79:
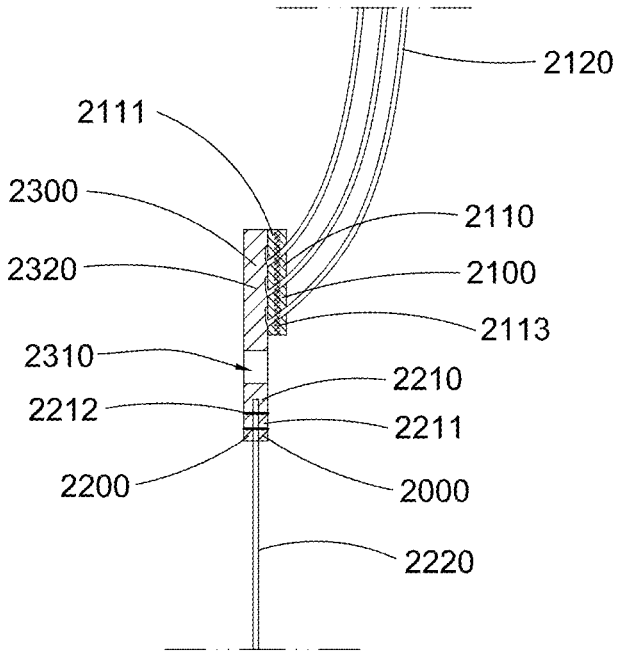
FIG. 79 is a sectional view of a hair extension according to a fourth alternative mode of the above third preferred embodiment of the present invention.

Referring to FIG. 79, as a fourth alternative mode of the above third embodiment, the hair extension 2000 comprises an upper hair extension unit 2100 and a lower hair extension unit 2200, the lower hair extension unit 2200 comprises a lower hair base 2210 which comprises a lower glue base 2211 and a foldable opening base 2300 integrally extended from the lower glue base 2211, the lower glue base 2211 is provided with one or more stitching lines 2212. The upper hair extension unit 2100 comprises an upper hair base 2110 and a plurality of upper hair members 2120 which is fixed to the upper hair base 2110. The upper hair base 2110 in this embodiment comprises a hair transplantation base 2113 for transplanting the upper hair members 2210.

Figure 80:
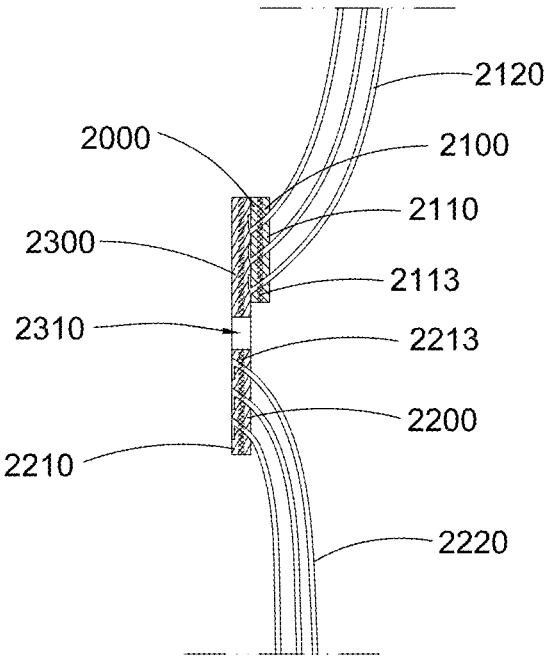
FIG. 80 is a sectional view of a hair extension according to a fifth alternative mode of the above third preferred embodiment of the present invention.
Figure 81:
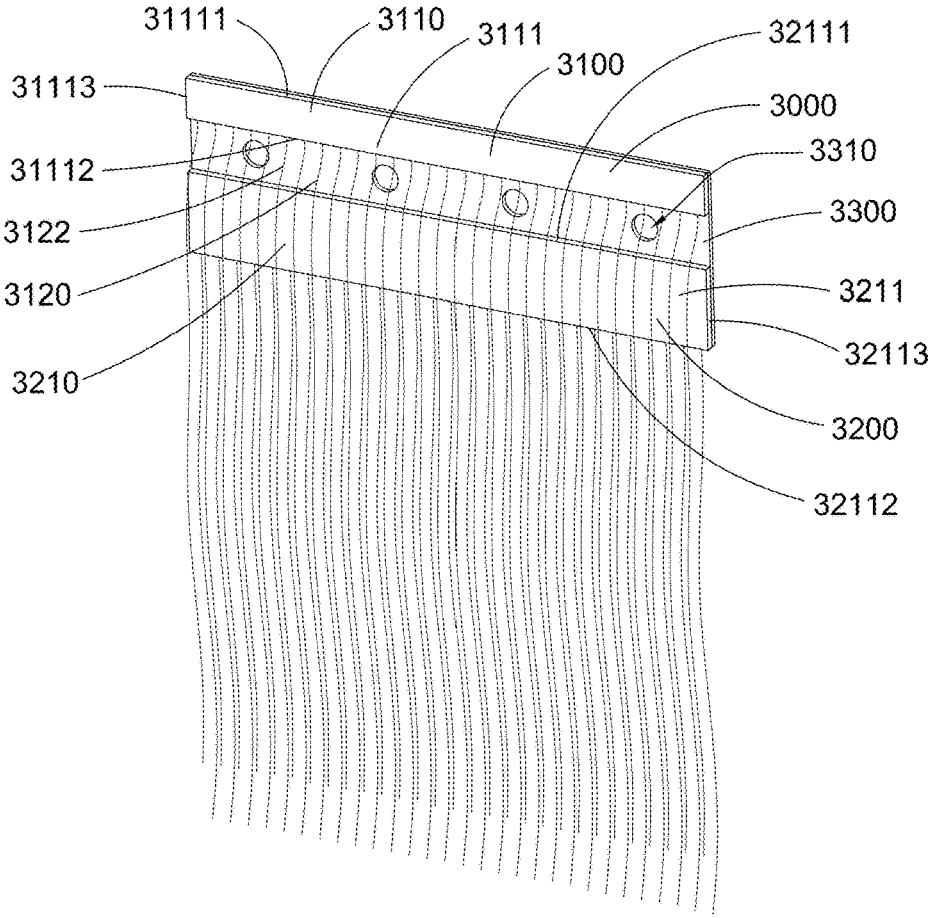
FIG. 81 is a perspective view of a hair extension according to a fourth preferred embodiment of the present invention.

Referring to FIG. 80. as a fifth alternative mode of the above third embodiment, the hair extension 2000 comprises an upper hair extension unit 2100 and a lower hair extension unit 2200, the lower hair extension unit 2200 comprises a lower hair base 2210 which comprises a hair transplantation base 2213 and a foldable opening base 2300 integrally extended from the hair transplantation base 2213 for transplanting the lower hair members 2220. The upper hair extension unit 2100 comprises an upper hair base 2110 and a plurality of upper hair members 2120 which is fixed to the upper hair base 2110. The upper hair base 2110 in this embodiment comprises a hair transplantation base 2113 for transplanting the upper hair members 2120.

Referring to FIGS. 81 to 84 of the drawings, a hair extension 3000 according to a four embodiment of the present invention is illustrated, the hair extension 3000 comprises two or more hair extension units such as an upper hair extension unit 3100 and a lower hair extension unit 3200. The hair extension 3000 further comprises an opening base 3300 connected to the upper hair extension unit 3100 and the lower hair extension unit 3200, the opening base 3300 has one or more openings 3310 for aiding the wearing of the hair extension 3000 with the one or more mounting tubes 1170.

The opening base 3300 comprises an upper end portion 3320 and a lower end portion 3330, the upper hair extension unit 3100 and the lower hair extension unit 3200 are respectively attached at the upper end portion 3320 and the lower end portion 3330 of the opening base 3300. In this embodiment, the hair strands of the upper hair extension unit 3100 and the lower hair extension unit 3200 extend in same directions. During use, the user's natural hair is guided through these openings 3310, and the mounting tubes 1170 are used to secure the hair extension 3000 to the natural hair. During wearing, the opening base 3300 is not required to folded, and the hair strands of the upper hair extension unit 2100 is extended downward, in the same direction as hair strands of the lower hair extension unit 3200, so as to produce a natural downward flow of hair strands, achieving a seamless and voluminous appearance that closely mimics the look of natural hair growth.

The upper hair extension unit 3100 comprises an upper hair base 3110 and a plurality of upper hair members 3120 fixed to the upper hair base 3110, the lower hair extension unit 3200 comprises a lower hair base 3210 and a plurality of lower hair members 3220 fixed to the lower hair base 3210.

In this embodiment, the upper hair base 3110 comprises an upper glue base 3111, the lower hair base 3210 comprises a lower glue base 3211. Each upper hair member 3120 comprises an upper root part 3121 and an upper hair body part 3122 which is integrally extended from the upper root part 3121, the upper root part 3121 is embedded in the upper glue base 3111. Each lower hair member 3220 comprises a lower root part 3221 and a lower hair body part 3222 which is integrally extended from the lower root part 3221, the lower root part 3221 is embedded in the lower glue base 3211.

The upper hair members 3120 and the lower hair members 3220 are disposed on opposite sides of the opening base 3230, extending in the same direction. During wearing, the upper hair members 3120 are flipped up to expose the openings 3310, so that the hair strands of the natural hair of the user can be passed through the openings 3310 for fixation. And then, the upper hair members 3120 are flipped down, so as to be oriented to extend in the same downward direction with the lower hair members 3220, the hair extension 3000 creates a multi-dimensional visual effect, mimicking the natural gradation and depth found in real hair growth.

In this embodiment, the upper glue base 3111 has a top edge 31111, a bottom edge 31112, and two side edges 31113, the upper root part 3121 of each upper hair member 3120 is embedded between the top edge 31111 and the bottom edge 31112 of the upper glue base 3111. The upper hair body part 3122 of each upper hair member 3120 is extended from the bottom edge 31112 of the upper glue base 3111. The lower glue base 3211 has a top edge 32111, a bottom edge 32112, and two side edges 32113, the lower root part 3121 of each lower hair member 3220 is embedded between the top edge 32111 and the bottom edge 32112 of the lower glue base 3211. The lower hair body part 3122 of each lower hair member 3220 is extended from the bottom edge 32112 of the lower glue base 3211.

As a result, the upper and lower hair body parts 3122 and 3222 extend in the same downward direction. When the hair extension 3000 is worn on the user, two layers of hair members fall naturally in the same downward direction, thereby enhancing the overall realism and visual consistency of the hair extension 3000.

Preferably, each of the opening base 3310 and the upper glue base 3111 has two upper side corner edges each is a curved edge, preferred an arc edge. The upper glue base has two lower side corner edges each is an orthogonal edge. The arc-shaped upper side corner edges contribute to a smoother transition between the upper boundary of the glue base and the user's scalp or surrounding hair. This curved contour reduces the risk of irritation or pressure points, especially when the extension is worn for extended periods. The rounded design of the upper corners also offers aesthetic benefits, as it more naturally mimics the contours of the scalp or hairline, making the hair extension less detectable and more realistic in appearance.

The material of the hair members 3120 and 3220 can be but not limited to real human hair, synthetic fiber, blended materials and animal hair. The hair members 3120 and 3220 made from real human hair can offer the most natural look and feel, and can be styled, dyed, and treated like natural hair. Artificial fibers, such as heat-resistant or low-temperature fibers, can be used for preparing the hair members 3120 and 3220 as then may not look as natural as human hair. The blended materials combine human hair with synthetic fibers to provide a balance between natural appearance and affordability. This mix aims to offer both the realistic look of human hair and the durability of synthetic fibers. The hair members 3120 and 3220 also may be made from hair of animals like horses or yak, so as to offer a natural texture.

As shown in the drawings, the upper hair extension unit 3100 and the lower hair extension unit 3200 are provided at a rear side of the opening base 3300. Alternatively, the upper hair extension unit 3100 and the lower hair extension unit 3200 can be provided at two opposite sides of the opening base 3300. As an example, the upper hair extension unit 310 is provided at the rear side of the opening base 3300 and the lower hair extension unit 3200 is provided the front side of the opening base 3300.

Each of the upper glue base 3111 and the lower glue base 3211 can be formed by a glue material which comprises a polyurethane glue, such as a mixture of polyurethane glue, adhesive, and thinner or diluent. Preferably, a weight content of polyurethane glue is ranged from 40%-60%, a weight content of adhesive is ranged from 10%-30%, and a weight content of thinner is ranged from 20%-40%.

In this embodiment, a row of openings 3310 is formed in the opening base 3300 between the upper end portion 3320 and the lower end portion 3330, each opening 3310 is penetrating through a thickness of the opening base 3300. A distance between two adjacent openings 2310 is 0.1-20 mm, a distance between a side edge of the opening base 3300 and the opening 3310 adjacent to the side edge is 0.1-10 mm. Each opening 3310 can be configured to have any shape, such as triangle, square, rectangular, circular, and oval. In this embodiment, each opening 3310 is shown have a circular shape and a diameter of the opening 3310 is 0.1-3.5 mm.

The opening base 3300 comprises a middle portion 3340 between the upper end portion 3320 and the lower end portion 3330, multiple openings 2310 are formed in the middle portion 3340. Preferably, a height of the middle portion 3340 is 0.5-1.5 cm. In other words, a distance between the upper hair extension unit 3100 and the lower hair extension unit 3200 which is a length of a gap 3304 between the upper hair extension unit 3100 and the lower hair extension unit 3200 is 0.5-1.5 cm.

Figure 82:
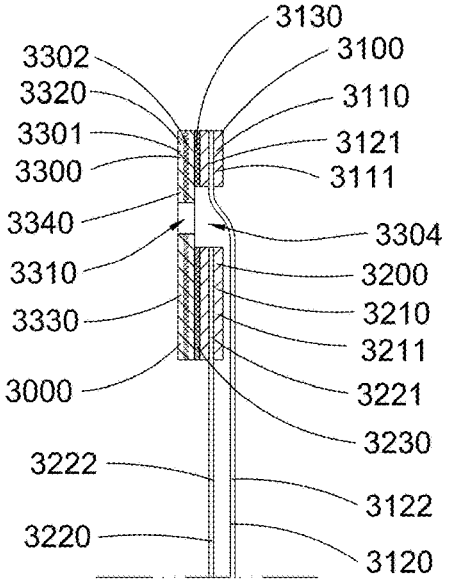
FIG. 82 is a sectional view of the hair extension according to the above fourth preferred embodiment of the present invention.
Figure 83:
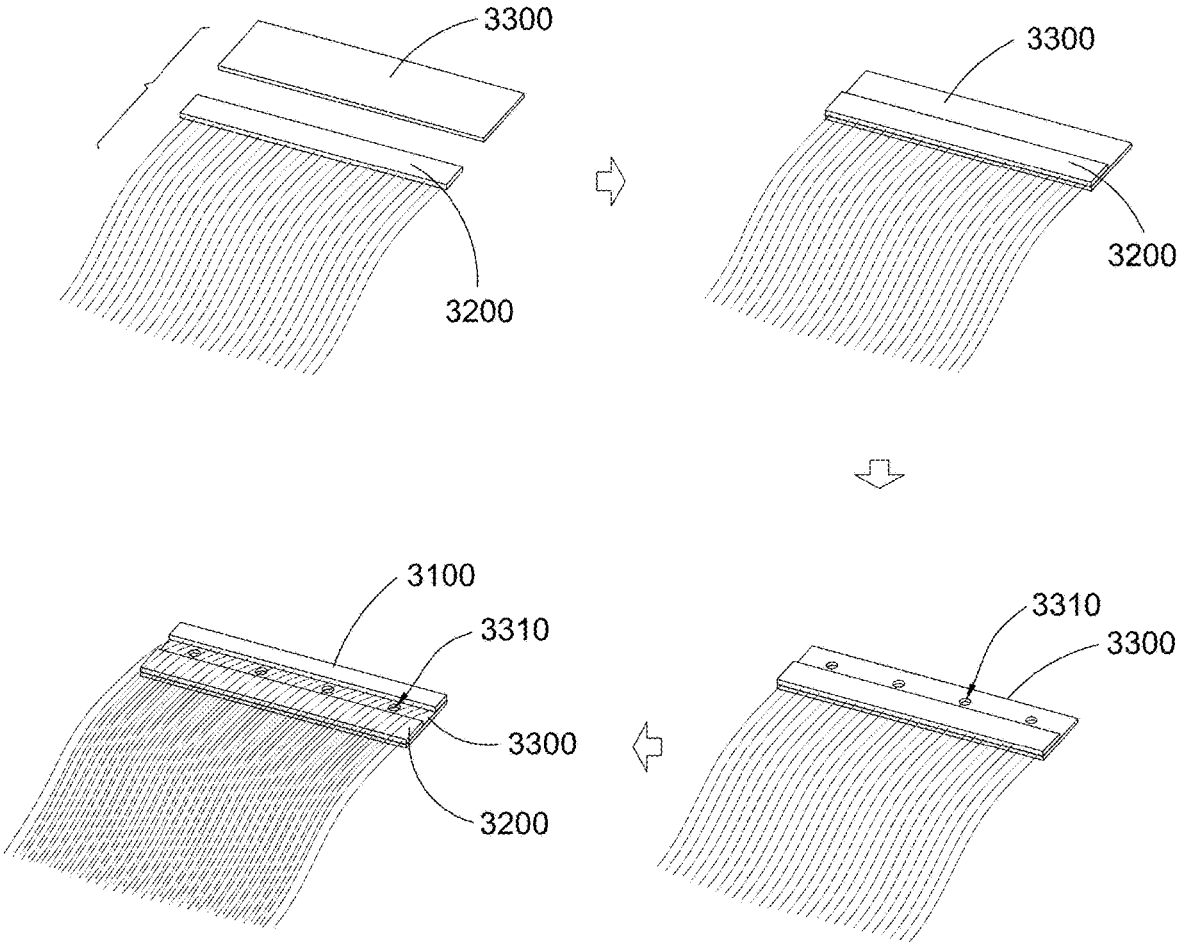
FIG. 83 is a perspective view illustrating the manufacturing process of the hair extension according to the above fourth preferred embodiment of the present invention.

As shown in FIG. 82 of the drawings, a layer of upper mesh yarn 3130 may be further applied on the upper glue base 3111, a layer of lower mesh yarn 3230 may be further applied on the lower glue base 3211. After the upper glue base 3111 and the lower glue base 3211 are formed, the hair members 3120 and 3220 are fixed to the upper glue base 3111 and the lower glue base 3211 respectively.

As shown in FIG. 82 of the drawings, the opening base 3300 comprises a glue base body 3301. A mesh layer 3302 may be further attached to the glue base body 3301, the openings 3310 are penetrating through the glue base body 3301 and the mesh layer 3302. A glue material of the glue base body 3301 can be but not limited to polyurethane, a material of the mesh layer 3302 can be but not limited to yarn, fabric, mesh and silk. In this embodiment, the mesh layer 3302 is preferred to be made of silk with a denser structure and greater strength, making it less prone to deform and bend. In other words, the opening base 3300 is not required to be folded during wearing, and the mesh layer 3302 of this embodiment is preferred to be provided with enhanced strength.

The opening base 3300 can be obtained from an opening base material. More specifically, a mesh material is applied with glue material at both sides thereof, so to form a glue material layer on the mesh material to provide the opening base material, then the opening base material is cut to provide the opening bases 3300 which can be punched with the openings 3310.

Figure 84:
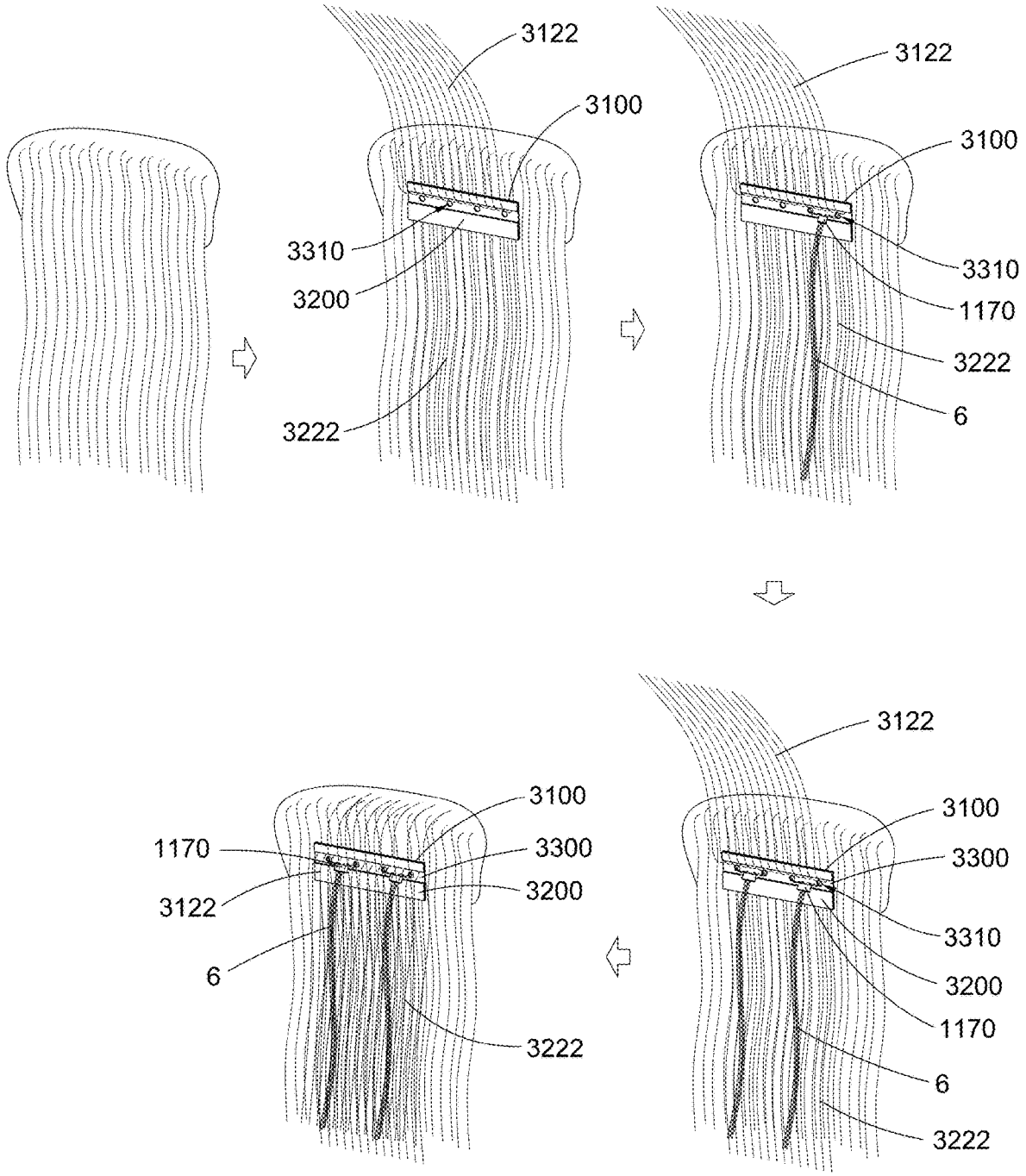
FIG. 84 is a schematic view illustrating the process of wearing the hair extension on natural hair of the user according to the above fourth preferred embodiment of the present invention.

The hair extension 3000 further comprises one or more above mounting tubes 1170. Referring to FIG. 84 of the drawings, when wearing the hair extension 3000 on the head of the user, a front surface of the opening base 3330 can be attached to natural hair of the user, the upper hair extension unit 3310 and the lower hair extension unit 3320 are positioned on the rear surface of the opening base 3330. The upper hair body parts 3122 of the upper hair members 3120 are flipped up to expose the openings 3310. The hair strands 6 of natural hair of the user covered by the hair extension 3000 can be guided by a hook device to pass through the openings 3310. The hair strands 6 of natural hair of the user at the inner side of the hair extension 3000 is guided to pass through the openings 3310 from the front side of the hair extension 3000 to the rear side of the hair extension 3000, and then one or more hair strands 6 of natural hair of the user, such as two hair strands 6 of natural hair of the user is sleeved by one mounting tube 1170 which is position on the rear side of the opening base 3300, so as to fix the hair extension 3000 to the natural hair of the user by the mounting tubes 1170. Each mounting tube 1170 can then be pressed by a clamping tool, so as to firmly fix the strands 6 of natural hair of the user. And then, the upper hair body parts 3122 of the upper hair members 3120 are flipped downward, so that the upper hair body parts 3122 of the upper hair members 3120 are covered on the lower hair extension unit 3320 to hide the openings 3310 and the mounting tubes 1170. Accordingly, the upper hair body parts 3122 of upper hair members 3120 is extending downward and is covered on the lower hair body parts 3222 of lower hair members 3220 to form multiple layers of hairs which are naturally falling down.

In the above second and third embodiment, the foldable opening base 2300 is folded to cover the openings 2310, such a folding configuration increases the thickness of the hair extension and compromises its breathability, which may result in odor accumulation during prolonged use. This added thickness may negatively affect the comfort and natural appearance when worn, especially for users seeking a lightweight or inconspicuous hairpiece.

In this embodiment, the opening base 3300, the two hair extension units 3100 and 3200 are not required to be folded. The openings 3310 are only covered by the upper hair members 3120, not by any hair base. By eliminating the need to fold the opening base 3300 or the hair extension units 3100 and 3200, the overall thickness of the hair extension 3000 remains minimal. This streamlined profile offers improved wearing comfort, especially for long-term use, and avoids the bulkiness associated with folded configurations. Since no additional layers are introduced by folding, the hair extension 3000 maintains better airflow and ventilation. This helps dissipate heat and moisture, reducing the likelihood of odor accumulation and improving hygiene during prolonged wear. The upper hair members 3120 are configured to naturally drape over and cover the openings 3310 without creating visible seams or unnatural bulges. This ensures a smooth and aesthetically pleasing appearance that better mimics the natural flow and density of real hair.

Figure 85:
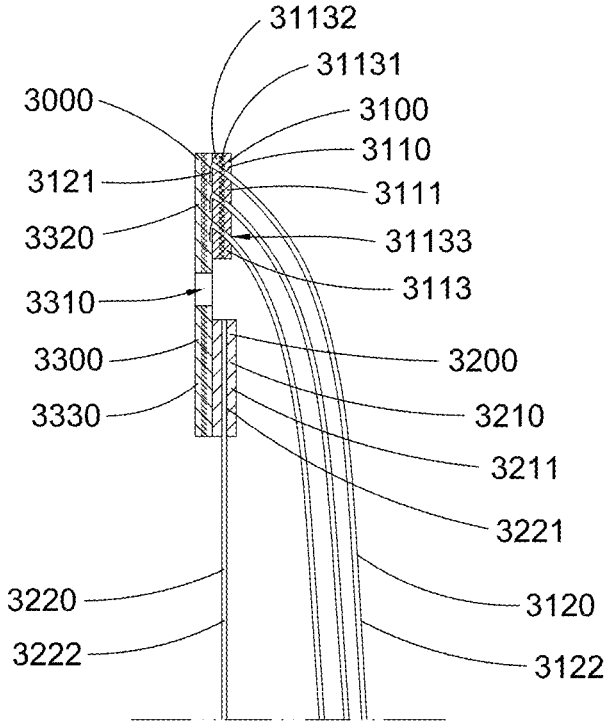
FIG. 85 is a sectional view of a hair extension according to a first alternative mode of the above fourth preferred embodiment of the present invention.

As shown in FIG. 85 of the drawings, as a first alternative mode, the upper hair extension unit 3100 can be embodied to have a structure of the above first hair weft unit 30. More specifically, the upper hair extension unit 3100 comprises an upper hair base 3110 and a plurality of upper hair members 3120 which is fixed to the upper hair base 3110. The upper hair base 3110 in this embodiment comprises a hair transplantation base 3113.

The hair transplantation base 3113 comprises a silk mesh 31131 and a glue layer 31132 applied to the silk mesh 31131, the glue material of the glue layer 31132 is filled into the mesh holes of the silk mesh 31131, so that the hair transplantation base 3113 is an integral rigid and smooth layer which is suitable for the hair transplantation process. The material of the silk mesh 31131 can be natural silk, synthetic silk, mesh or netting. The glue layer 31132 may comprise one or more of acrylic resin, epoxy resin, polyurethane, plasticizers such as phthalates, fillers such as calcium carbonate, and solvents such as ethyl acetate, ethanol, acetone. Alternatively, the hair transplantation base 3113 comprises a fabric layer or a textile layer and a glue layer applied to the fabric layer or the textile layer. The hair transplantation base 3113 may also be made of plastic material such as polyvinyl chloride and polyurethane.

The hair transplantation base 3113 has a plurality of hair transplantation holes 31133, one or more upper hair members 3120 can be planted in the corresponding hair transplantation hole 31133.

Accordingly, in this embodiment, the upper hair members 3120 can be manually planted on the hair transplantation base 3113 or by a transplantation machine. The upper root part 3121 of each upper hair member 3120 is penetrating the thickness of the hair transplantation base 3113 and is fixed to a front surface of the hair transplantation base 3113 which is a side adjacent to the scalp of the user when the hair extension 3000 is worn on the user and the upper hair body part 3122 of each upper hair member 3120 is extended from a rear surface of the hair transplantation base 3113.

Figure 86:
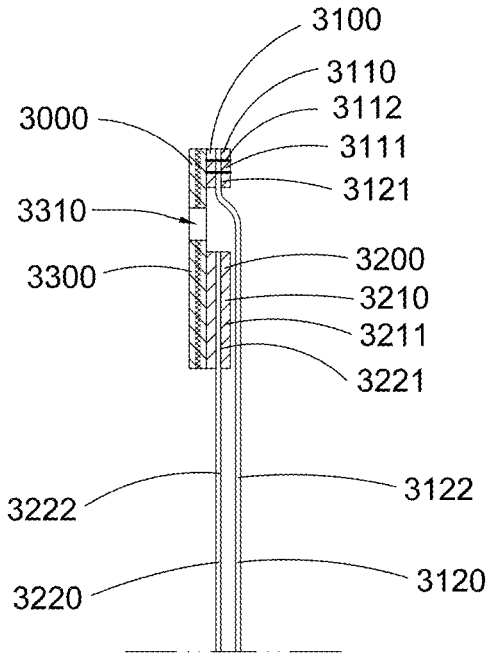
FIG. 86 is a sectional view of a hair extension according to a second alternative mode of the above fourth preferred embodiment of the present invention.

Referring to FIG. 86 of the drawings, as a second alternative mode, the upper hair extension unit 3100 can be embodied to have a structure of the above first hair weft unit 80. In other words, the upper hair base 3110 further comprises one or more stitching lines 3112 to fix the upper hair members 3120. When there are two stitching lines 3112, a distance between the two stitching lines 3112 can be smaller than 3 mm. A height of the upper hair base 3110 is significantly reduced.

In the examples of the fourth embodiment of the present invention, when the height of the upper hair extension unit 3100 is smaller the height of the lower hair extension unit 3200, so that the upper hair base 3110 of the upper hair extension unit 3100 can remain flat and smooth against the surface of the product and is not easy to be protruding or curling upward.

Figure 87:
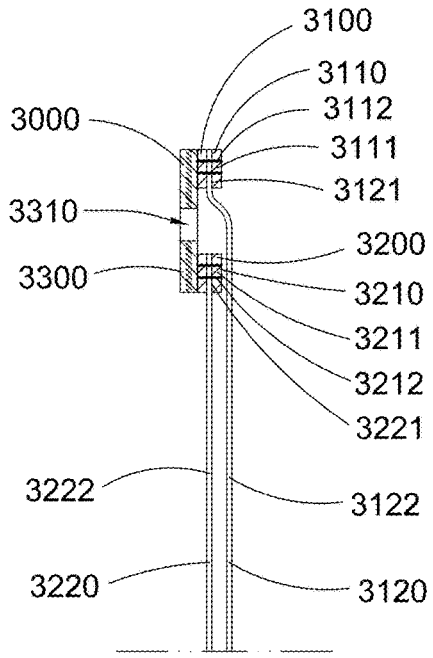
FIG. 87 is a sectional view of a hair extension according to a third alternative mode of the above fourth preferred embodiment of the present invention.

As shown in FIG. 87 of the drawings, as a third alternative mode, both of the upper hair extension unit 3100 and the lower hair extension unit 3200 can be embodied to have a structure of the above third alternative mode. In other words, the upper hair base 3110 further comprises one or more stitching lines 3112 provided on the upper glue base 3111, the lower hair base 3210 further comprises one or more stitching liens 3212 provided on the lower glue base 3211.

Figure 88:
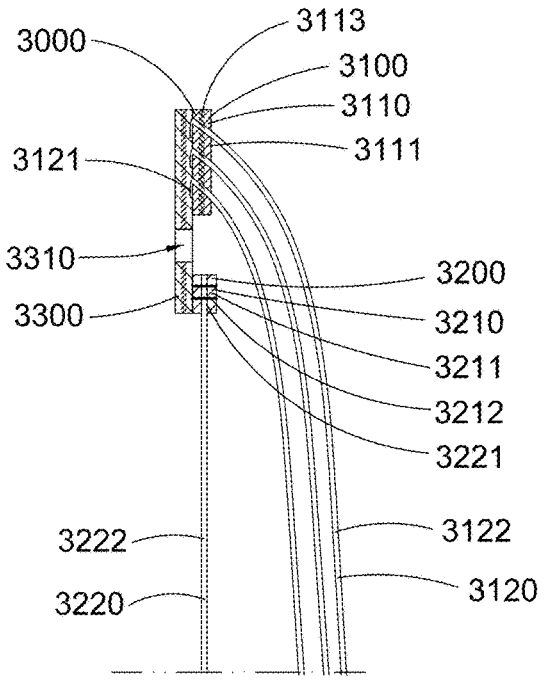
FIG. 88 is a sectional view of a hair extension according to a fourth alternative mode of the above fourth preferred embodiment of the present invention.

As shown in FIG. 88 of the drawings, as a fourth alternative mode, the upper hair extension unit 3100 is embodied to comprise the hair transplantation base 3113 to plant the upper hair members 3120, the lower hair base 3210 of the lower hair extension unit 3200 further comprises one or more stitching liens 3212 provided on the lower glue base 3211.

Figure 89:
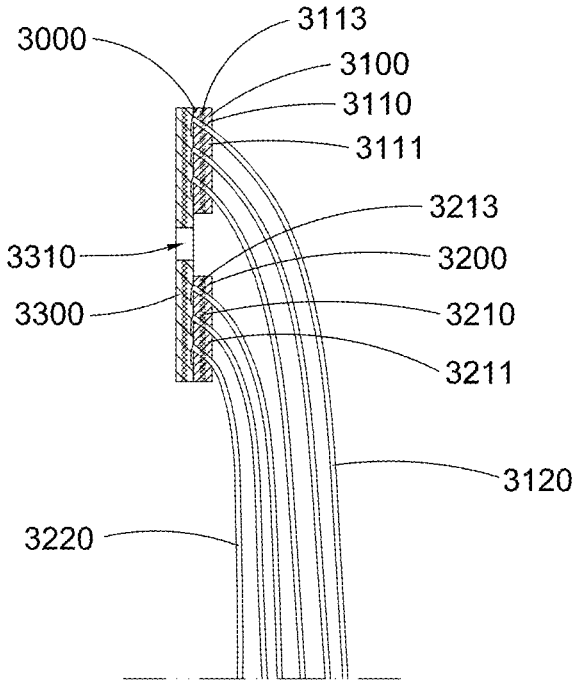
FIG. 89 is a sectional view of a hair extension according to a fifth alternative mode of the above fourth preferred embodiment of the present invention.

As shown in FIG. 89 of the drawings, as a fifth alternative mode, the upper hair extension unit 3100 is embodied to comprise the hair transplantation base 3113 to plant the upper hair members 3120, the lower hair extension unit 3200 is embodied to comprise a hair transplantation base 3213 to plant the lower hair members 3220.

Figure 90:
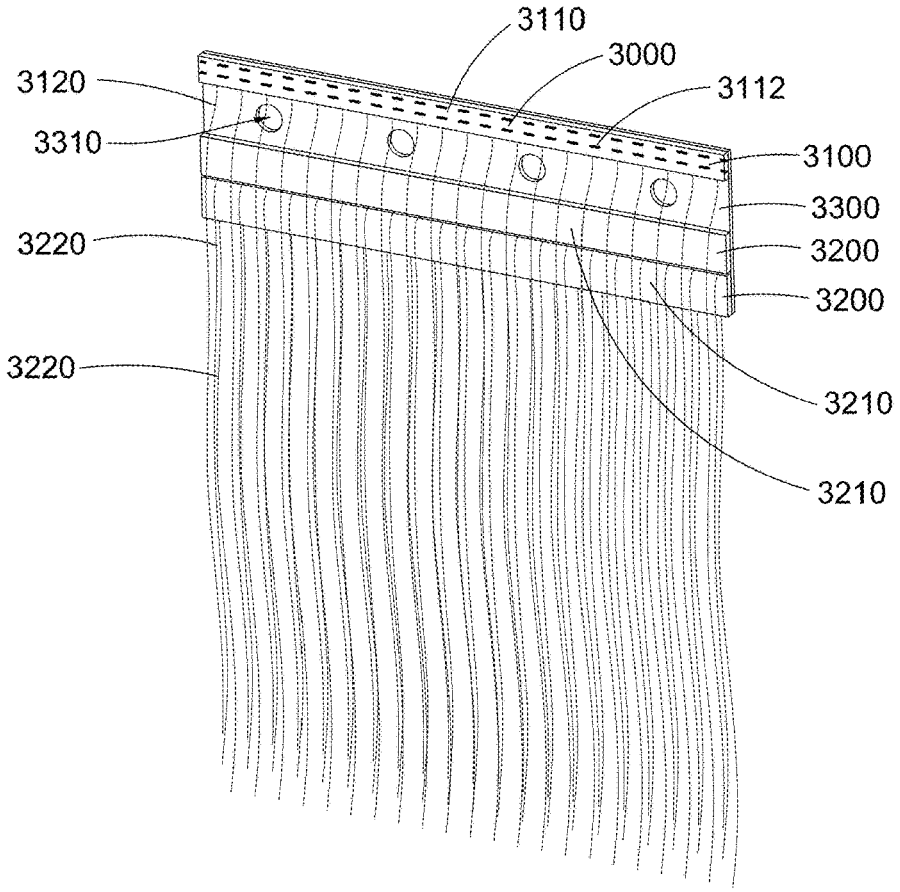
FIG. 90 is a perspective view of a hair extension according to a sixth alternative mode of the above fourth preferred embodiment of the present invention.

As shown in FIG. 90 of the drawings, as a sixth alternative mode, the upper hair extension unit 3100 is embodied to comprise the upper hair base 3110 having the one or more stitching lines 3112 provided on the upper glue base 3111. The lower hair extension unit 3200 is embodied to comprise a hair transplantation base 3213 to plant the lower hair members 3220.

Figure 91:
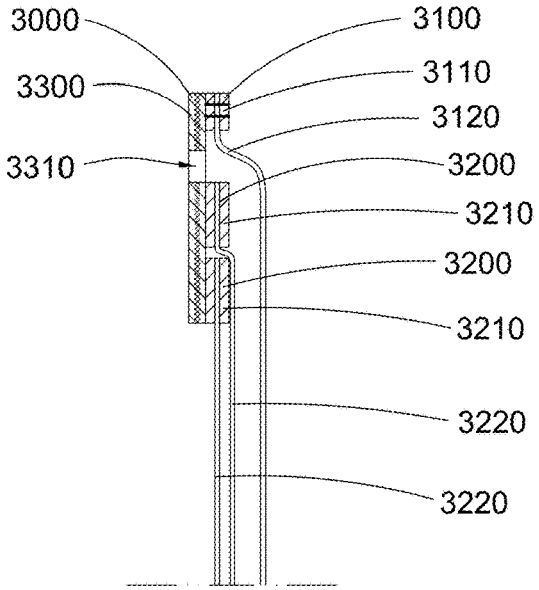
FIG. 91 is a sectional view of the hair extension according to the seventh alternative mode of the above fourth preferred embodiment of the present invention.
Figure 92:
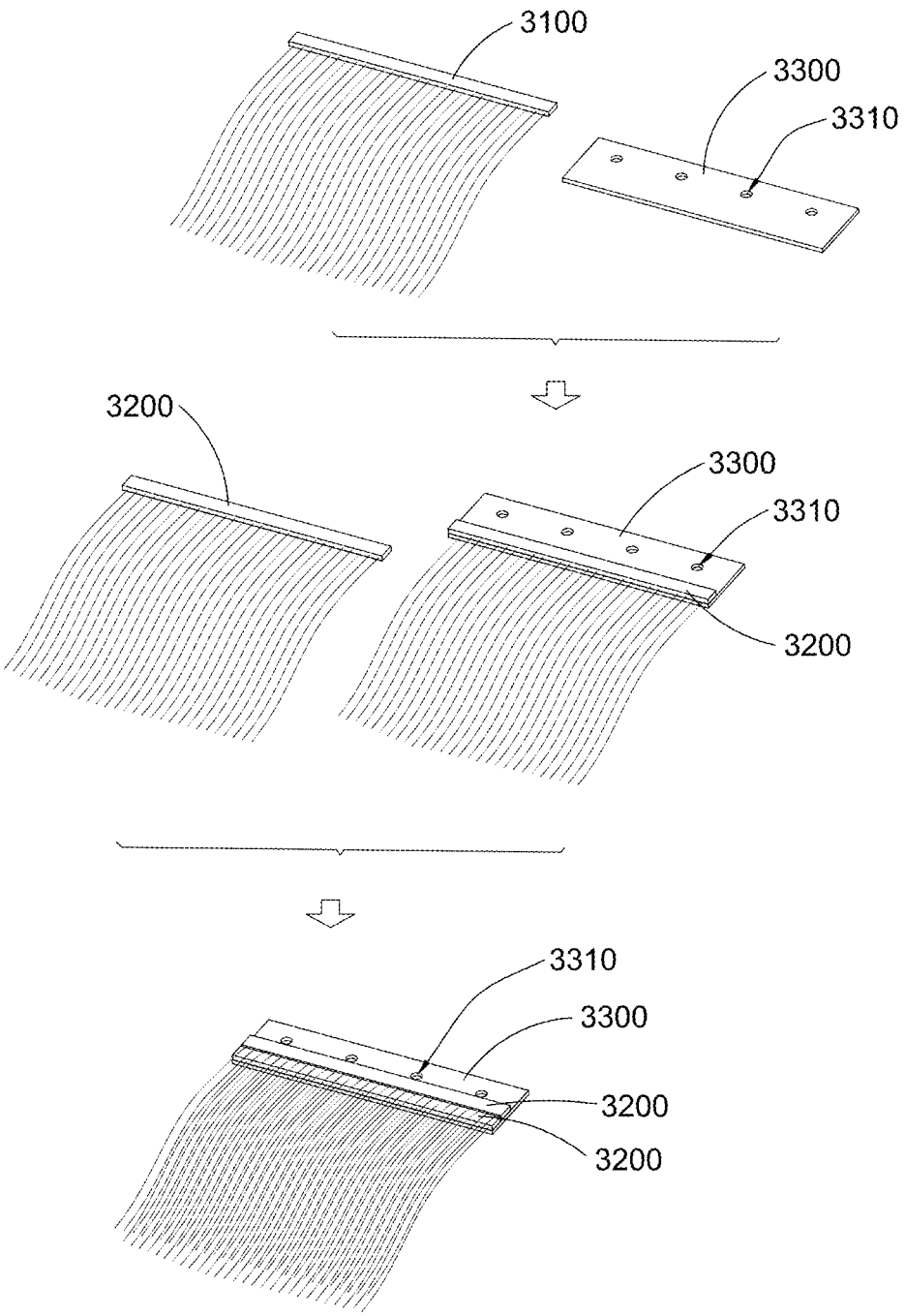
FIGS. 92 and 93 are schematic view illustrating the manufacturing process of the hair extension according to the seventh alternative mode of the above fourth preferred embodiment of the present invention.
Figure 93:
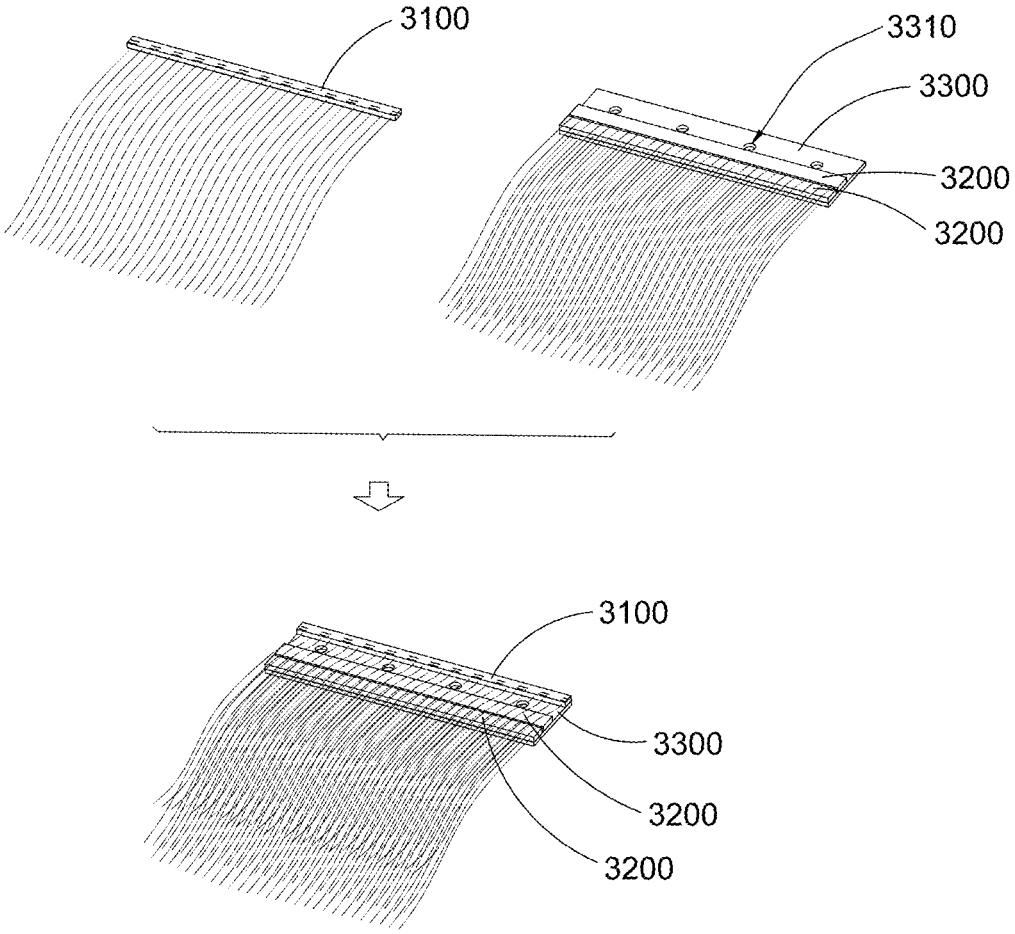
Figure 94:
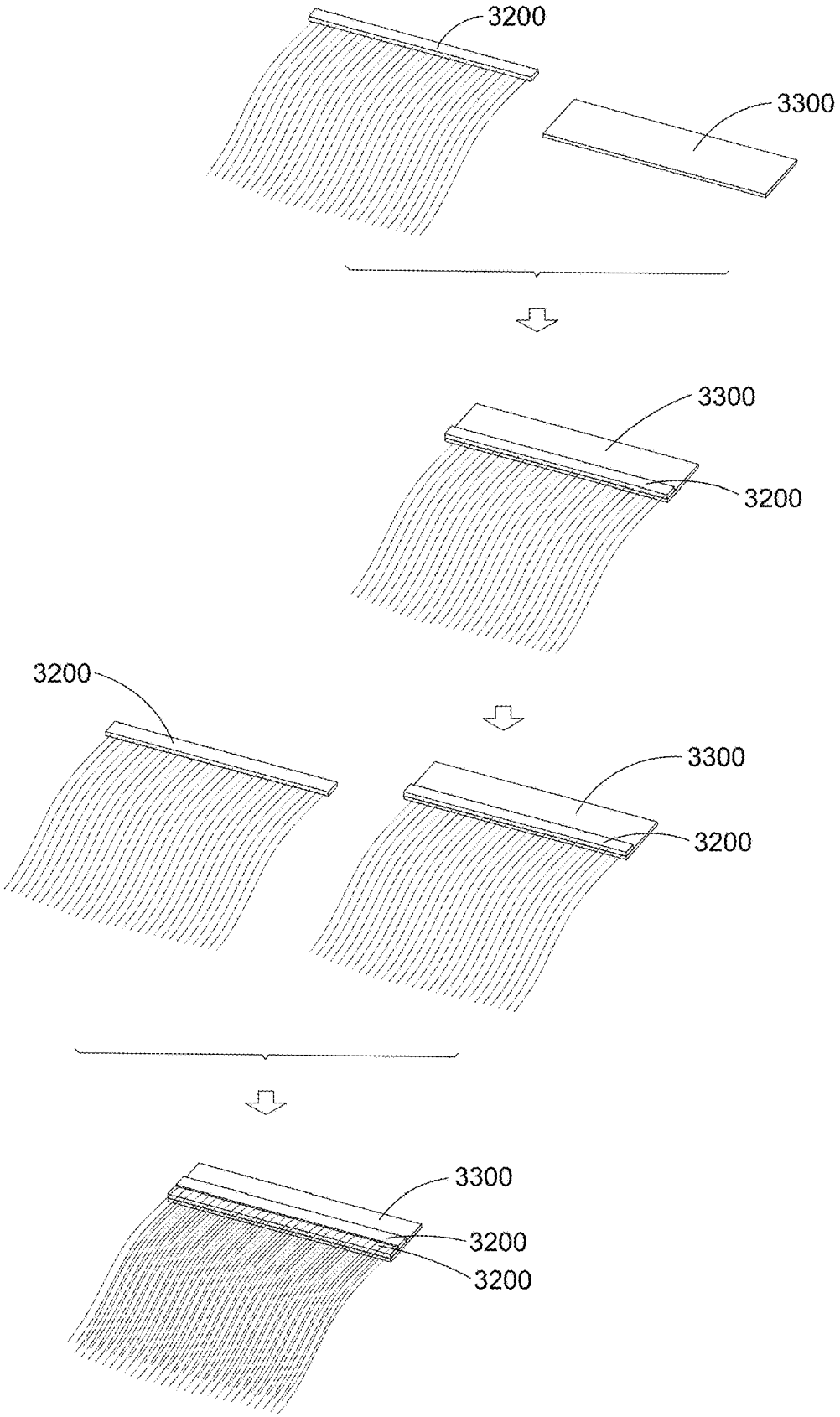
FIGS. 94 and 95 are schematic view illustrating another manufacturing process of the hair extension according to the seventh alternative mode of the above fourth preferred embodiment of the present invention.
Figure 95:
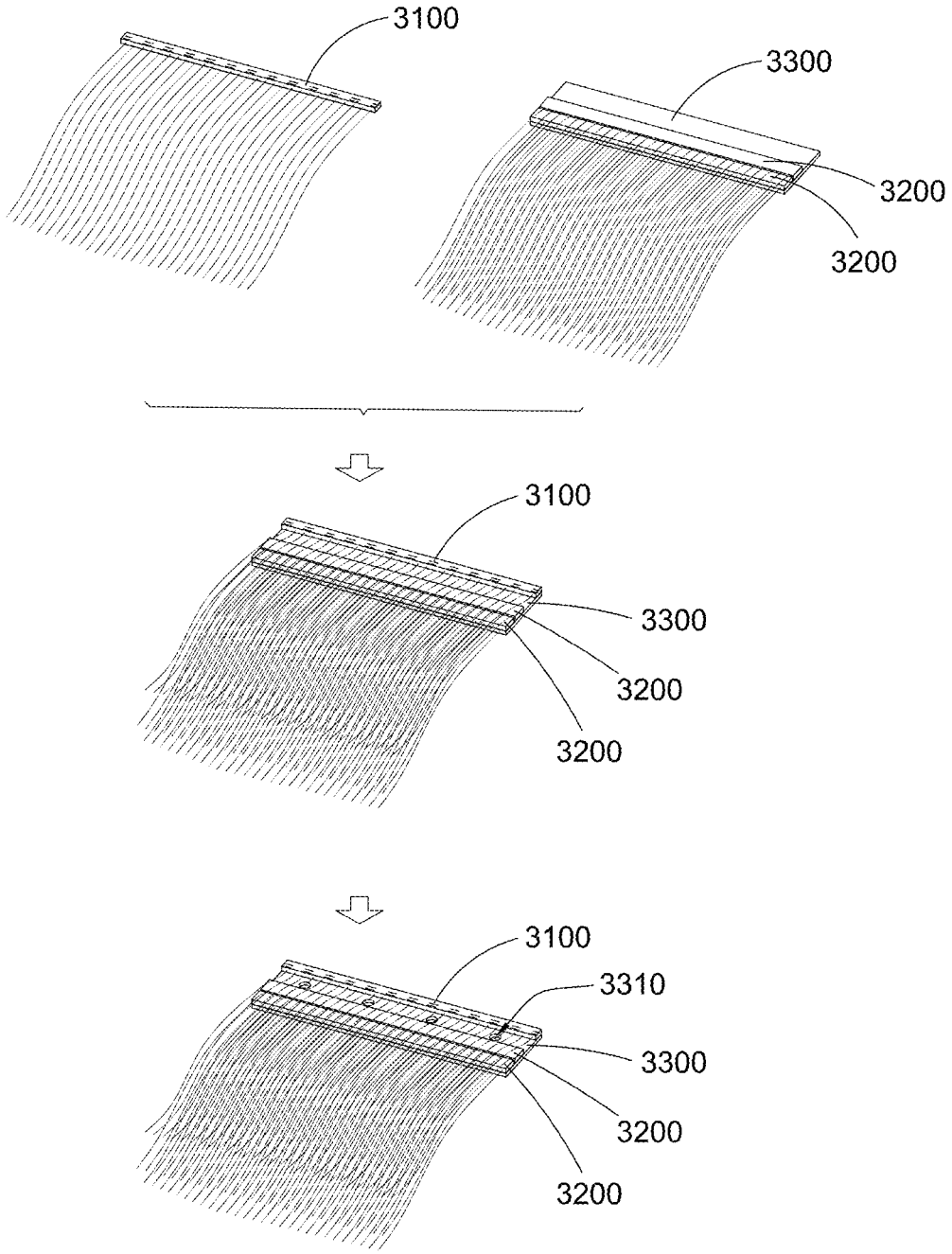

As shown in FIG. 91 of the drawings, as a seventh alternative mode, the upper hair extension unit 3100 can be embodied to comprise the structure of the above upper hair extensions units 3100, such as the upper hair extension unit 3100 comprising the upper hair base 3110 having the one or more stitching lines 3112 provided on the upper glue base 3111. The hair extension 3000 comprises two or more of the lower hair extension units 3200 attached to the opening base 3300, each the lower hair extension units 3200 can be embodied to comprise the structure of the above lower hair extensions units 3100.

As shown in FIGS. 92 to 93 and FIGS. 94 to 95 of the drawings, during the manufacturing process of the hair extension 3000, the openings 3310 can formed in the opening base 3300 before the hair extension units 3100 and 3200 are attached to the opening base 3300. Alternatively, the openings 3310 can formed in the opening base 3300 after the hair extension units 3100 and 3200 are attached to the opening base 3300.

Figure 96:
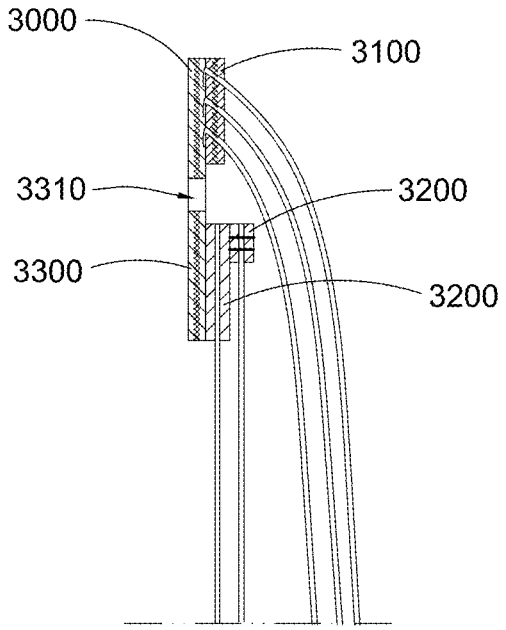
FIG. 96 is a sectional view of a hair extension according to an eighth alternative mode of the above fourth preferred embodiment of the present invention.
Figure 97:
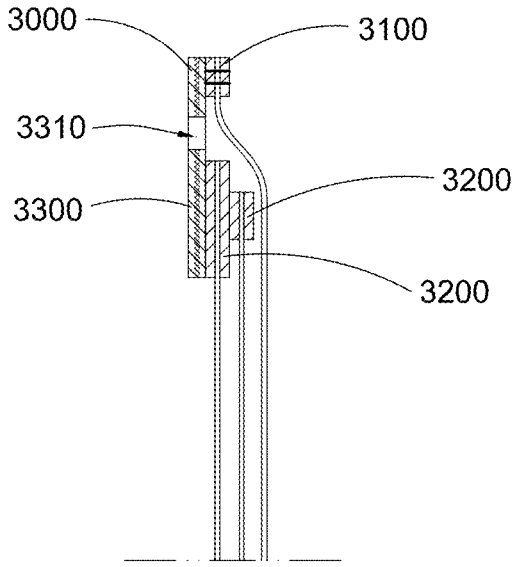
FIG. 97 is a sectional view of a hair extension according to a ninth alternative mode of the above fourth preferred embodiment of the present invention.

As shown in FIG. 96 of the drawings, as an eighth alternative mode, the upper hair extension unit 3100 can be embodied to comprise the structures of the above upper hair extensions units 3100, such as the upper hair extension unit 3100 comprising the upper hair base 3110 which comprises the hair transplanting base 3113. Alternatively, the upper hair base 3110 comprises the upper glue base 3111 and one or more stitching lines 3112 provided on the upper glue base 3111, as show in FIG. 97. The hair extension 3000 comprises two or more of the lower hair extension units 3200 which are staked on each other, and then is attached to the opening base 3300, each the lower hair extension units 3200 can be embodied to comprise the structure of the above lower hair extensions units 3200.

Figure 98:
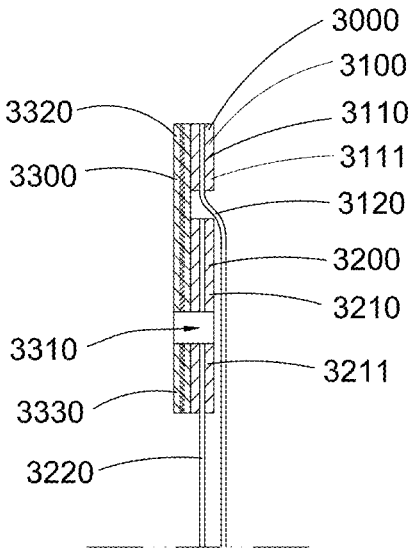
FIG. 98 is a sectional view of a hair extension according to a tenth alternative mode of the above fourth preferred embodiment of the present invention.

As shown in FIG. 98 of the drawings, as a tenth alternative mode, opening 2310 can be embodied to penetrate the opening base 3300 and the lower hair base 3210 of the lower hair extension unit 3200.

Figure 99:
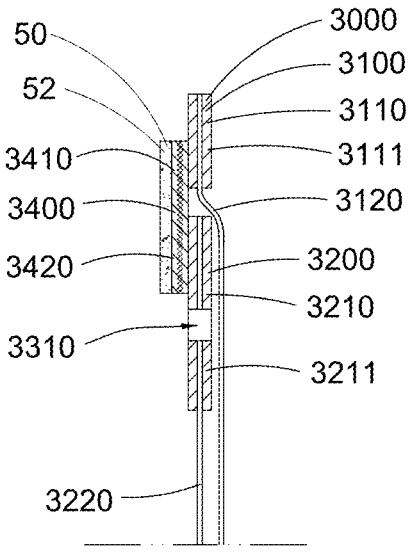
FIG. 99 is a sectional view of a hair extension according to a eleventh alternative mode of the above fourth preferred embodiment of the present invention.

As shown in FIG. 99 of the drawings, as an eleventh alternative mode, opening 2310 is formed in one of the hair base of the two hair extension units, such as the lower hair base 3210 of the lower hair extension unit 3200. The hair extension 3000 comprises a base 3400 which comprises an upper end portion 3410 and a lower end portion 3420, the upper hair extension unit 3100 is attached on the upper end portion of the base 3400, the lower hair extension unit 3200 is attached to the lower end portion 3420 of the base 3400. In addition, an attaching unit 50 such as a double-sided binding tape 52 can be further attached to the base 3400, so that when wearing the hair extension 3000 with the base 3400, the double-sided binding tape 52 can be employed for aiding the hair extension 3000 to be attached to the natural hair of the user.

Figure 100:
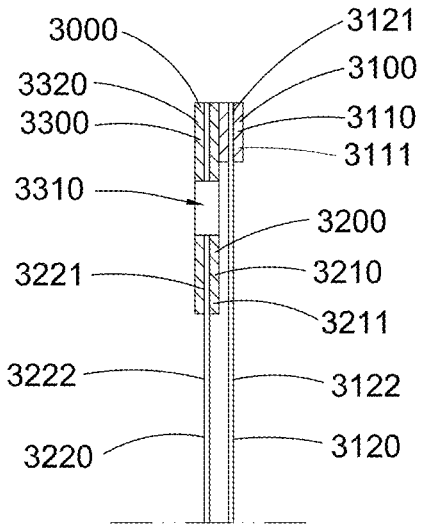
FIG. 100 is a sectional view of a hair extension according to a fifth preferred embodiment of the present invention.

As shown in FIG. 100 of the drawings, a hair extension 3000 according to a fifth preferred embodiment of the present invention is illustrated, the hair extension 3000 comprises two or more hair extension units such as an upper hair extension unit 3100 and a lower hair extension unit 3200. In this embodiment, the hair extension 3000 further comprises an opening base 3300 which is an integral part of one of the upper hair extension unit 3000 and the lower hair extension unit 3200.

More specifically, as an example, the lower hair extension unit 3200 comprises a lower hair base 3210 which comprises a lower glue base 3211 and an opening base 3300 integrally extended from the lower glue base 3211. The opening base 2300 has one or more openings 3310 penetrating a thickness thereof and comprises an upper end portion 3320 which is attached with the upper hair extension 3100 which comprises the upper hair base 3110 and the plurality of upper hair members 3120 fixed to the upper hair base 3110. In this embodiment, the upper hair base 3110 can be embodied to comprise the upper glue base 3111.

Figure 101:
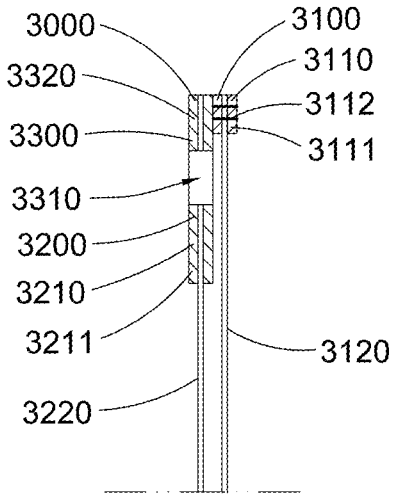
FIG. 101 is a sectional view of a hair extension according to a first alternative mode of the above fifth preferred embodiment of the present invention.
Figure 102:
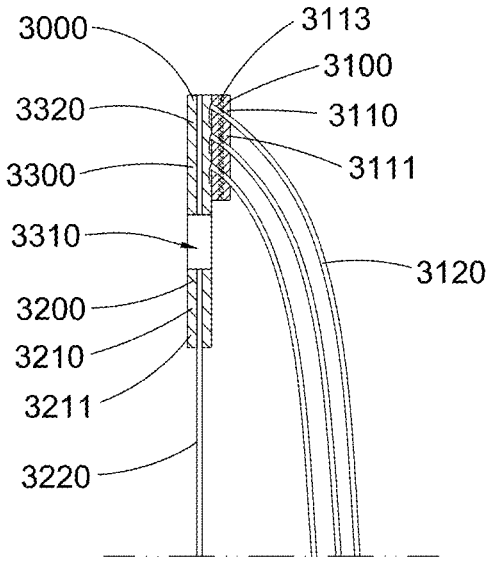
FIG. 102 is a sectional view of a hair extension according to a second alternative mode of the above fifth preferred embodiment of the present invention.
Figure 103:
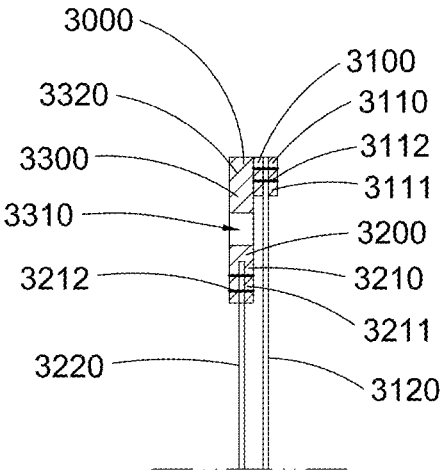
FIG. 103 is a sectional view of a hair extension according to a third alternative mode of the above fifth preferred embodiment of the present invention.
Figure 104:
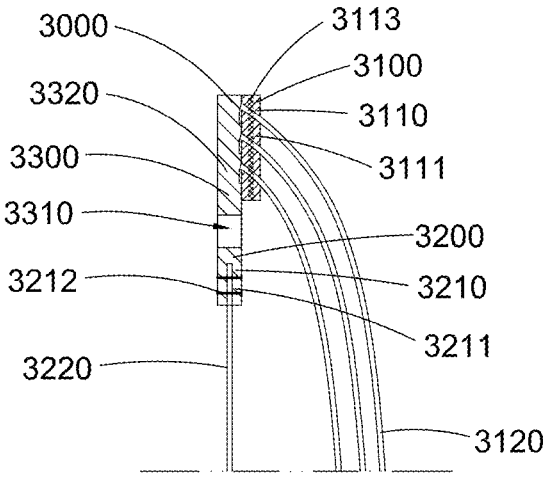
FIG. 104 is a sectional view of a hair extension according to a fourth alternative mode of the above fifth preferred embodiment of the present invention.
Figure 105:
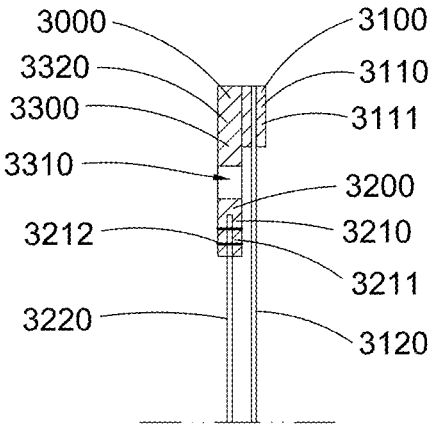
FIG. 105 is a sectional view of a hair extension according to a fifth alternative mode of the above fifth preferred embodiment of the present invention.
Figure 106:
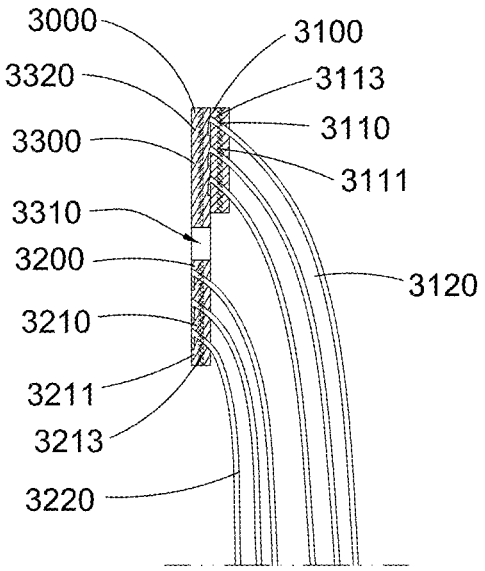
FIG. 106 is a sectional view of a hair extension according to a sixth alternative mode of the above fifth preferred embodiment of the present invention.
Figure 107:
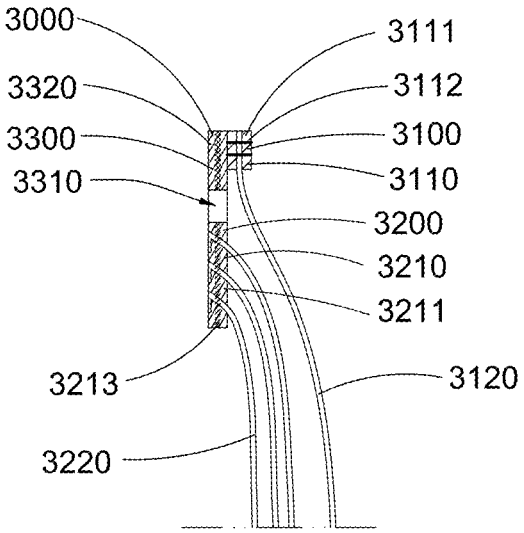
FIG. 107 is a sectional view of a hair extension according to a seventh alternative mode of the above fifth preferred embodiment of the present invention.

As shown in FIGS. 101, 103 and 107 of the drawings, the upper hair base 3110 can be embodied to comprise the upper glue base 3111 and the one or more stitching lines 3112 provided on the upper glue base 3111. As shown in FIGS. 102, 104 and 106 of the drawings, the upper hair base 3110 can be embodied to comprise the upper hair transplantation base 3113 for transplanting the upper hair members 3120. As shown in FIGS. 103 to 105 of the drawings, the lower hair base 210 can be embodied to comprise the lower glue base 3211 and the one or more stitching lines 3212 provided on the lower glue base 3211 for fixing the lower hair members 3220. As shown in FIGS. 106 to 107 of the drawings, the lower hair base 210 can be embodied to comprise the lower hair transplantation base 3213 for transplanting the lower hair members 3220.

Figure 108:
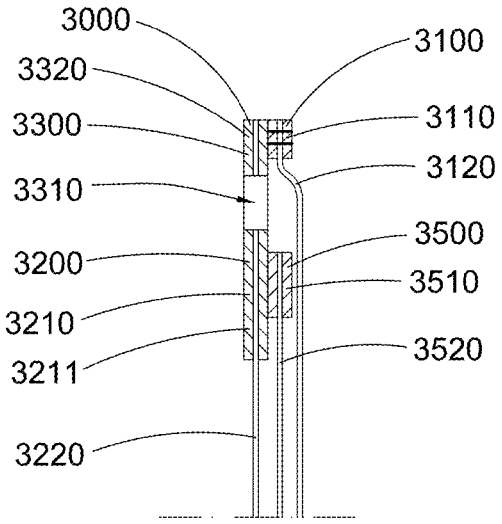
FIG. 108 is a sectional view of a hair extension according to an eighth alternative mode of the above fifth preferred embodiment of the present invention.
Figure 109:
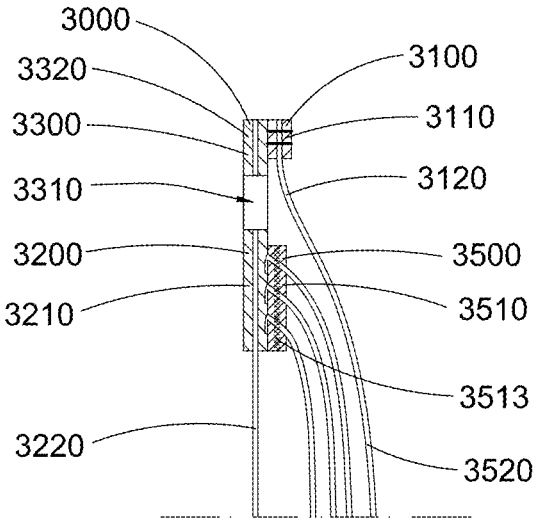
FIG. 109 is a sectional view of a hair extension according to a ninth alternative mode of the above fifth preferred embodiment of the present invention.
Figure 110:
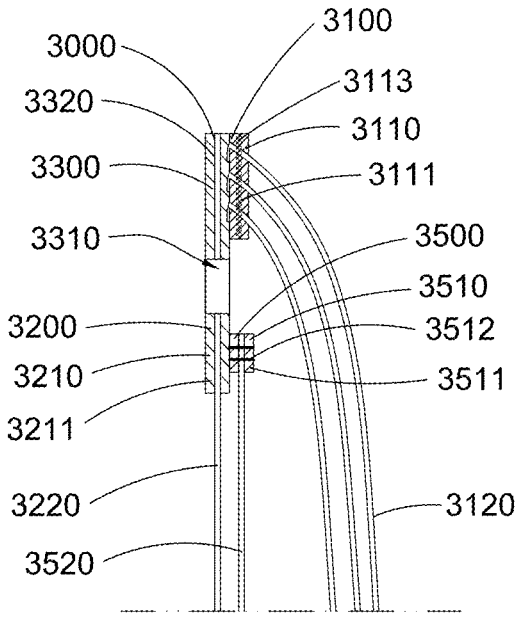
FIG. 110 is a sectional view of a hair extension according to a tenth alternative mode of the above fifth preferred embodiment of the present invention.

Referring to FIGS. 108 to 110 of the drawings, the hair extension comprises an upper hair extension unit 3100, a lower hair extension unit 3200 and an additional lower hair extension unit 3500 attached to the lower hair extension unit 3200. In this embodiment, the hair extension 3000 further comprises an opening base 3300 which is an integral part of the lower hair extension unit 3200.

More specifically, the lower hair extension unit 3200 comprises a lower hair base 3210 which comprises a lower glue base 3211 and an opening base 3300 integrally extended from the lower glue base 3211. The opening base 2300 has one or more openings 3310 penetrating a thickness thereof and comprises an upper end portion 3320 which is attached with the upper hair extension 3100 which comprises the upper hair base 3110 and the plurality of upper hair members 3120 fixed to the upper hair base 3110. The lower hair base 3210 also may be embodied to comprise the lower glue base 3211 and one or more stitching lines 3212, or comprise the hair transplantation base 3213.

The additional lower hair extension unit 3500, together with the upper hair extension unit 3100 can be provided on a same side of the lower hair extension unit 3200, comprises an additional lower hair base 3510 and a plurality of additional lower hair members 3520. As shown in FIG. 108, the additional lower hair base 3510 comprises an additional lower glue base 3511 for fixing the additional lower hair members 3520. As shown in FIG. 109, the additional lower hair base 3510 comprises an additional hair transplantation base 3513 for fixing the additional lower hair members 3520. As shown in FIG. 110, the additional lower hair base 3510 comprises an additional lower glue base 3511 and one or more stitching lines 3512 for fixing the additional lower hair members 3520.

It should be understood that, within the apparatus and method disclosed in this application, the respective components or steps in different embodiments may be disassembled and/or recombined without departing from the spirit and scope of the present invention. Such variations are to be considered within the scope of the inventive concept described herein.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and are subject to change without departure from such principles. Therefore, this invention includes all modifications encompassed within the spirit and scope of the following claims.

What is claimed is:

1. A hair extension, comprising:

an upper hair extension unit comprising an upper hair base and a plurality of upper hair members fixed to the upper hair base;

a lower hair extension unit comprising a lower hair base and a plurality of lower hair members fixed to the lower hair base; and an opening base comprising an upper end portion, a lower end portion and a middle portion between the upper end portion and the lower end portion, wherein the middle portion of the opening base has one or more openings, wherein the plurality of upper hair members are extended downward from the upper hair base which is located at a position higher than the plurality of lower hair members, so as to be stacked on the plurality of lower hair members;

wherein the one or more openings are located between the upper hair base and the lower hair base;

wherein the upper hair base is attached to the upper end portion of the opening base, the lower hair base is attached to the lower end portion of the opening base, wherein the upper hair base and the lower hair base are spaced apart from each other and a gap is defined between the upper hair base and the lower hair base, wherein the one or more openings are communicated to the gap, wherein the plurality of upper hair members and the plurality of lower hair members are extended downward at a same side of the opening base;

wherein the upper hair base comprises an upper glue base, wherein each of the plurality of upper hair members comprises an upper root part which is embedded in the upper glue base and an upper hair body part which is integrally extended from the upper root part, wherein the upper hair body part is extended out of the upper glue base from a bottom edge of the upper glue base to cover the one or more openings;

wherein the upper hair base further comprises two stitching lines which are continual sewing threads provided on the upper glue base for fixing the plurality of upper hair members, a distance between the two stitching lines is smaller than 3 mm.

2. The hair extension according to claim 1, wherein the opening base is adapted for being attached on a head of a user, the plurality of upper hair members are extended downward to cover the one or more openings, wherein the upper hair base is glued to the upper end portion of the opening base, the lower hair base is glued to the lower end portion of the opening base.

3. The hair extension according to claim 1, wherein the lower hair base comprises a lower glue base, wherein each of the plurality of lower hair members comprises a lower root part which is embedded in the lower glue base and a lower hair body part which is integrally extended from the lower root part, wherein the lower hair body part is extended out of the lower glue base from a bottom edge of the lower glue base.

4. The hair extension according to claim 3, wherein the lower hair base further comprises one or more stitching lines which are continual sewing threads provided on the lower glue base for fixing the plurality of lower hair members.

5. The hair extension according to claim 3, wherein the lower hair base further comprises a lower mesh yarn integrated with the lower glue base.

6. The hair extension according to claim 1, wherein the lower hair base comprises a hair transplantation base, wherein each of the plurality of lower hair members comprises a lower root part which is penetrating a thickness of the hair transplantation base and a lower hair body part which is integrally extended from the lower root part, wherein the hair transplantation base has an inner side surface and an outer side surface which is opposite to the inner side surface, wherein the lower root part is located between the inner side surface of the hair transplantation base and the lower end portion of the opening base, the lower hair body is extended from the outer side surface of the hair transplantation base.

7. The hair extension according to claim 1, wherein the upper hair base further comprises an upper mesh yarn integrated with the upper glue base.

8. The hair extension according to claim 1, wherein the upper glue base is formed between the two stitching lines.

9. The hair extension according to claim 1, wherein the opening base comprises a glue base body and a mesh layer integrated with the glue base body, wherein the one or more openings are penetrating through the glue base body and the mesh layer.

10. The hair extension according to claim 1, wherein the opening base has multiple openings, wherein a distance between two adjacent openings is 0.1-20 mm.

11. The hair extension according to claim 10, wherein each opening has a circular shape, a diameter of each opening is 0.1-3.5 mm, a distance between a side of the opening base and the corresponding opening adjacent to the side of said glue base is 0.1-10 mm.

12. The hair extension according to claim 1, further comprising one or more mounting tubes for mounting the hair extension to natural hair of a user, wherein each mounting tube comprises a tube body and an inner flexible tube disposed in the tube body.

13. The hair extension, as recited in claim 1, further comprising one or more mounting tubes for mounting the hair extension to natural hair of a user, wherein each mounting tube comprises a tube body defining an inner passage, wherein said tube body has inner threads in said inner passage.

14. A hair extension, comprising:

an upper hair extension unit comprising an upper hair base and a plurality of upper hair members fixed to the upper hair base;

a lower hair extension unit comprising a lower hair base and a plurality of lower hair members fixed to the lower hair base; and an opening base comprising an upper end portion, a lower end portion and a middle portion between the upper end portion and the lower end portion, wherein the middle portion of the opening base has one or more openings which are located between the upper hair base and the lower hair base, wherein the plurality of upper hair members are extended downward from the upper hair base which is located at a position higher than the plurality of lower hair members, so as to be stacked on the plurality of lower hair members;

wherein the upper hair base is attached to the upper end portion of the opening base, the lower hair base is attached to the lower end portion of the opening base, wherein the upper hair base and the lower hair base are attached to two opposite sides of the opening base;

wherein the upper hair base comprises an upper glue base, wherein each of the plurality of upper hair members comprises an upper root part which is embedded in the upper glue base and an upper hair body part which is integrally extended from the upper root part, wherein the upper hair body part is extended out of the upper glue base from a bottom edge of the upper glue base to cover the one or more openings, wherein the upper hair base further comprises two stitching lines which are continual sewing threads provided on the upper glue base for fixing the plurality of upper hair members, wherein a distance between the two stitching lines is smaller than 3 mm.

15. A hair extension, comprising:

an upper hair extension unit comprising an upper hair base and a plurality of upper hair members fixed to the upper hair base;

a lower hair extension unit comprising a lower hair base and a plurality of lower hair members fixed to the lower hair base; and an opening base integrally extended from the lower hair base, wherein the opening base has one or more openings, wherein the opening base comprises an upper end portion, the upper hair base, which is not formed with the one or more openings, is attached to the upper end portion of the opening base, wherein the plurality of upper hair members are extended downward, so as to cover the one or more openings and be stacked on the plurality of lower hair members;

wherein the upper hair base comprises an upper glue base, wherein each of the plurality of upper hair members comprises an upper root part which is embedded in the upper glue base and an upper hair body part which is integrally extended from the upper root part, wherein the upper hair body part is extended out of the upper glue base from a bottom edge of the upper glue base to cover the one or more openings, wherein the upper hair base further comprises two stitching lines which are continual sewing threads provided on the upper glue base for fixing the plurality of upper hair members, wherein a distance between the two stitching lines is smaller than 3 mm.

* * * * *